US008342335B2

(12) United States Patent
Couture

(10) Patent No.: US 8,342,335 B2
(45) Date of Patent: Jan. 1, 2013

(54) SHELF-READY SHIPPER DISPLAY SYSTEM

(75) Inventor: David G. Couture, Suwanee, GA (US)

(73) Assignee: Rock-Tenn Shared Services, LLC, Norcross, GA (US)

( * ) Notice: Subject to any disclaimer, the term of this patent is extended or adjusted under 35 U.S.C. 154(b) by 253 days.

(21) Appl. No.: 12/760,741

(22) Filed: Apr. 15, 2010

(65) Prior Publication Data

US 2010/0276333 A1 Nov. 4, 2010

Related U.S. Application Data

(60) Provisional application No. 61/174,161, filed on Apr. 30, 2009.

(51) Int. Cl.
*B65D 5/54* (2006.01)

(52) U.S. Cl. ..... 206/746; 53/458; 206/774; 229/103; 229/164; 229/242; 493/162

(58) Field of Classification Search ..... 206/736, 206/745–747, 749, 750, 756–760, 525, 774; 229/164, 200, 210, 237, 240–243; 53/453, 53/456, 458, 467, 468, 473, 476; 493/52, 493/55, 162

See application file for complete search history.

(56) References Cited

U.S. PATENT DOCUMENTS

| | | | |
|---|---|---|---|
| 803,966 | A | 11/1905 | Barnes |
| 1,431,133 | A | 10/1922 | Young |
| 1,770,618 | A | 7/1930 | Lambert |
| 1,916,045 | A | 6/1933 | Freymann |
| 1,925,102 | A | 9/1933 | Levkoff |
| 1,932,429 | A | 10/1933 | Wellman |
| 2,074,229 | A | 3/1937 | McKee |
| 2,343,222 | A | 2/1944 | Nelson |
| 2,426,911 | A | 9/1947 | Williamson |
| 2,540,595 | A | 2/1951 | Props |
| 2,675,913 | A | 4/1954 | Hanson |
| 2,706,593 | A | 4/1955 | Caraher |
| 2,762,550 | A | 9/1956 | Goettsch et al. |
| 2,808,190 | A | 10/1957 | Buhrmaster et al. |
| 2,836,338 | A | 5/1958 | Daniels |
| 2,964,169 | A | 12/1960 | Brachman |
| 3,007,622 | A | 11/1961 | George |
| 3,019,959 | A | 2/1962 | Skowronski |
| 3,029,008 | A | 4/1962 | Membrino |
| 3,043,490 | A | 7/1962 | Burnett |
| 3,055,573 | A | 9/1962 | Carter |

(Continued)

FOREIGN PATENT DOCUMENTS

| | | |
|---|---|---|
| DE | 2116726 | 10/1972 |

(Continued)

*Primary Examiner* — Luan K Bui
(74) *Attorney, Agent, or Firm* — Kilpartick Townsend & Stockton LLP

(57) ABSTRACT

A shelf-ready shipper display system having a tray portion, a hood portion, and one or more zones of weakness that enable the hood portion to be separated from the tray portion so that the shipper display system can be converted from a shipping configuration to a display configuration. In certain embodiments, the shipper display system is made from a single blank. In some embodiments, the shipper display system includes a reinforcement panel that is also capable of being separated from the tray portion as the shipper display system is converted from the shipping configuration and to the display configuration.

33 Claims, 46 Drawing Sheets

U.S. PATENT DOCUMENTS

| | | | | |
|---|---|---|---|---|
| 3,069,062 | A | | 12/1962 | Keith |
| 3,111,255 | A | | 11/1963 | Skowronski |
| 3,118,587 | A | | 1/1964 | Welshenbach |
| 3,157,345 | A | | 11/1964 | George |
| 3,167,179 | A | | 1/1965 | Goldstein |
| 3,227,266 | A | | 1/1966 | Soma |
| 3,235,166 | A | | 2/1966 | Guyer |
| 3,245,527 | A | | 4/1966 | Martin |
| 3,254,758 | A | | 6/1966 | Guyer |
| 3,276,667 | A | | 10/1966 | Johnson et al. |
| 3,285,492 | A | | 11/1966 | Demby et al. |
| 3,310,221 | A | | 3/1967 | Duncan |
| 3,310,223 | A | | 3/1967 | Buttery |
| 3,314,587 | A | | 4/1967 | Johnson |
| 3,371,844 | A | | 3/1968 | Perrella |
| 3,392,905 | A | | 7/1968 | Caldwell |
| 3,428,234 | A | | 2/1969 | Barry, Jr. |
| 3,476,023 | A | | 11/1969 | Fuller |
| 3,523,636 | A | | 8/1970 | Phillips, Jr. |
| 3,531,045 | A | | 9/1970 | Johnson |
| 3,543,998 | A | | 12/1970 | Dunlap |
| 3,561,669 | A | | 2/1971 | Postweiler et al. |
| 3,568,911 | A | | 3/1971 | Bebout |
| 3,606,969 | A | | 9/1971 | Voytko |
| 3,640,190 | A | | 2/1972 | Fuller |
| 3,643,856 | A | | 2/1972 | Jones |
| 3,664,494 | A | | 5/1972 | Mergens |
| 3,669,251 | A | | 6/1972 | Phillips, Jr. |
| 3,721,381 | A | | 3/1973 | Locke |
| 3,730,417 | A | | 5/1973 | Lawson |
| 3,744,702 | A | | 7/1973 | Ellison |
| 3,815,808 | A | | 6/1974 | Bunnell |
| 3,884,348 | A | | 5/1975 | Ross |
| 3,893,614 | A | | 7/1975 | Meyers |
| 3,910,482 | A | | 10/1975 | Bamburg et al. |
| 3,910,483 | A | | 10/1975 | Ritter |
| 3,917,158 | A | | 11/1975 | Dorofachuk et al. |
| 3,926,362 | A | | 12/1975 | Beck et al. |
| 3,935,798 | A | | 2/1976 | Paxton |
| 3,942,631 | A | | 3/1976 | Sutherland et al. |
| 3,955,671 | A | | 5/1976 | Ockey |
| 3,955,743 | A | | 5/1976 | Tanneberger |
| 3,960,312 | A | | 6/1976 | Gorham |
| 3,967,774 | A | | 7/1976 | Querner |
| 4,000,811 | A | * | 1/1977 | Hardison et al. ..... 229/242 |
| 4,020,946 | A | | 5/1977 | Gardner et al. |
| 4,058,206 | A | | 11/1977 | Morse et al. |
| 4,103,819 | A | | 8/1978 | Muise |
| 4,113,100 | A | * | 9/1978 | Soja et al. ..... 229/112 |
| 4,133,474 | A | | 1/1979 | Hall |
| 4,174,803 | A | | 11/1979 | Shrontz et al. |
| 4,184,625 | A | | 1/1980 | Stollberg et al. |
| 4,196,843 | A | | 4/1980 | Garmon |
| 4,211,322 | A | | 7/1980 | Crescenzi et al. |
| 4,217,984 | A | | 8/1980 | Magnuson |
| 4,350,281 | A | * | 9/1982 | Dornbusch et al. ..... 206/774 |
| 4,396,144 | A | | 8/1983 | Gutierrez et al. |
| 4,429,826 | A | | 2/1984 | Shedd |
| 4,483,095 | A | | 11/1984 | Webinger |
| 4,553,666 | A | | 11/1985 | Gullikson |
| 4,558,785 | A | | 12/1985 | Gordon |
| 4,565,316 | A | | 1/1986 | Jes |
| 4,641,746 | A | | 2/1987 | Dornbusch et al. |
| 4,784,271 | A | | 11/1988 | Wosaba, II et al. |
| 4,848,651 | A | | 7/1989 | Hartness |
| 4,869,424 | A | | 9/1989 | Wood |
| 4,871,067 | A | | 10/1989 | Valenti |
| 4,886,160 | A | | 12/1989 | Kligerman |
| 5,016,753 | A | | 5/1991 | Henderson |
| 5,076,491 | A | | 12/1991 | Freudentahl et al. |
| 5,098,757 | A | | 3/1992 | Steel |
| 5,137,211 | A | | 8/1992 | Summer et al. |
| 5,154,309 | A | | 10/1992 | Wischusen, III et al. |
| 5,167,324 | A | | 12/1992 | Miller |
| 5,181,650 | A | | 1/1993 | Hollander et al. |
| 5,195,677 | A | | 3/1993 | Quintana et al. |
| 5,201,868 | A | | 4/1993 | Johnson |
| 5,288,012 | A | | 2/1994 | DeMay |
| 5,348,147 | A | | 9/1994 | Gottfreid |
| 5,350,111 | A | | 9/1994 | Vosbikian |
| 5,413,276 | A | | 5/1995 | Sheffer |
| 5,415,343 | A | | 5/1995 | Vosbikian |
| 5,417,342 | A | | 5/1995 | Hutchison |
| 5,465,831 | A | | 11/1995 | Smith |
| 5,489,023 | A | | 2/1996 | Havlovitz |
| 5,505,368 | A | | 4/1996 | Kanter et al. |
| 5,505,369 | A | | 4/1996 | Taliaferro |
| 5,505,371 | A | | 4/1996 | O'Neill |
| 5,507,430 | A | | 4/1996 | Imhoff |
| 5,560,692 | A | | 10/1996 | Smith |
| 5,582,345 | A | | 12/1996 | Lankhuijzen |
| 5,590,788 | A | | 1/1997 | Inman |
| 5,622,309 | A | | 4/1997 | Matsuda et al. |
| 5,651,497 | A | | 7/1997 | Ventura et al. |
| 5,657,872 | A | | 8/1997 | Leftwich et al. |
| 5,690,213 | A | | 11/1997 | Matsumura |
| 5,715,993 | A | | 2/1998 | Pareike |
| 5,730,296 | A | | 3/1998 | Limmer |
| 5,826,728 | A | | 10/1998 | Sheffer |
| 5,842,576 | A | | 12/1998 | Snow |
| 5,881,884 | A | | 3/1999 | Podosek |
| 5,918,801 | A | | 7/1999 | Milio |
| 5,950,914 | A | | 9/1999 | Dunton et al. |
| 5,957,294 | A | | 9/1999 | Kanter |
| 5,975,413 | A | | 11/1999 | Moen |
| 5,979,749 | A | | 11/1999 | Bozich |
| 6,073,833 | A | | 6/2000 | Desrosiers et al. |
| 6,129,211 | A | | 10/2000 | Prakken et al. |
| 6,158,579 | A | | 12/2000 | Rosenbaum |
| 6,168,027 | B1 | | 1/2001 | Esser |
| 6,189,778 | B1 | | 2/2001 | Kanter |
| 6,189,780 | B1 | * | 2/2001 | Kanter ..... 229/242 |
| 6,209,786 | B1 | | 4/2001 | Yelton et al. |
| 6,357,654 | B1 | | 3/2002 | Gardner et al. |
| 6,371,365 | B1 | | 4/2002 | Doucette et al. |
| 6,386,369 | B2 | | 5/2002 | Yuhas et al. |
| 6,402,021 | B1 | | 6/2002 | Heathcock |
| 6,405,921 | B1 | | 6/2002 | Cochrane |
| 6,409,077 | B1 | | 6/2002 | Telesca et al. |
| 6,435,351 | B1 | | 8/2002 | Gibb |
| 6,457,637 | B1 | | 10/2002 | Fritz et al. |
| 6,478,159 | B1 | | 11/2002 | Taylor et al. |
| 6,510,982 | B2 | | 1/2003 | White et al. |
| 6,557,708 | B2 | | 5/2003 | Polacco |
| 6,729,475 | B2 | | 5/2004 | Yuhas et al. |
| 6,755,306 | B2 | | 6/2004 | Maus |
| 6,793,070 | B2 | | 9/2004 | Dye |
| 6,832,683 | B2 | | 12/2004 | Boriani et al. |
| D503,614 | S | | 4/2005 | Sax et al. |
| 6,932,265 | B2 | | 8/2005 | Sax et al. |
| 6,948,617 | B2 | | 9/2005 | Kanter et al. |
| 6,974,033 | B2 | | 12/2005 | McLeod et al. |
| 6,976,588 | B2 | | 12/2005 | Wischusen et al. |
| 6,986,456 | B2 | | 1/2006 | Jone |
| 7,066,321 | B2 | | 6/2006 | Kawaguchi et al. |
| 7,066,333 | B2 | | 6/2006 | Justice |
| 7,066,379 | B2 | | 6/2006 | McLeod et al. |
| 7,080,736 | B2 | | 7/2006 | Jackson et al. |
| 7,097,041 | B2 | | 8/2006 | Marrale |
| 7,104,435 | B2 | | 9/2006 | Holley, Jr. |
| 7,175,066 | B2 | | 2/2007 | Varanasi |
| 7,213,707 | B2 | | 5/2007 | Hubbs et al. |
| 7,237,674 | B2 | | 7/2007 | Auclair |
| 7,284,662 | B2 | | 10/2007 | DeBusk et al. |
| 7,331,508 | B2 | | 2/2008 | Kanter et al. |
| 7,373,765 | B2 | | 5/2008 | Welchel et al. |
| 7,377,385 | B2 | | 5/2008 | Giannini et al. |
| 7,401,711 | B2 | | 7/2008 | Spivey, Sr. |
| 7,431,163 | B2 | | 10/2008 | Andersen |
| 7,451,878 | B2 | | 11/2008 | Rochefort et al. |
| 7,455,215 | B2 | | 11/2008 | McLeod et al. |
| 7,478,725 | B2 | | 1/2009 | Holley, Jr. |
| 7,523,842 | B2 | | 4/2009 | Spivey |
| 7,568,611 | B2 | | 8/2009 | Cargile, Jr. |
| 7,621,438 | B2 | | 11/2009 | Spivey, Sr. |
| 7,628,746 | B2 | | 12/2009 | Varanasi |
| 7,743,921 | B2 | | 6/2010 | Hubbs et al. |

| | | | | |
|---|---|---|---|---|
| 2002/0175106 | A1 | 11/2002 | Nemoto | |
| 2004/0232038 | A1 | 11/2004 | Daniels | |
| 2004/0232039 | A1 | 11/2004 | Daniels | |
| 2005/0000853 | A1 | 1/2005 | Rochefort et al. | |
| 2005/0161496 | A1 | 7/2005 | McLeod et al. | |
| 2005/0184139 | A1 | 8/2005 | Gasior | |
| 2006/0006096 | A1 | 1/2006 | Funk | |
| 2006/0060643 | A1 | 3/2006 | Sheffer | |
| 2006/0261140 | A1 * | 11/2006 | Holley | 229/242 |
| 2006/0283927 | A1 | 12/2006 | Walsh et al. | |
| 2007/0131749 | A1 | 6/2007 | Coltri-Johnson et al. | |
| 2007/0221715 | A1 | 9/2007 | Tibbels et al. | |
| 2007/0278282 | A1 | 12/2007 | Jolley et al. | |
| 2008/0078691 | A1 | 4/2008 | Malik et al. | |
| 2008/0197182 | A1 | 8/2008 | Jackson | |
| 2008/0245850 | A1 | 10/2008 | Spivey | |
| 2009/0014352 | A1 | 1/2009 | Foden | |
| 2011/0049226 | A1 | 3/2011 | Moreau et al. | |
| 2011/0284621 | A1 | 11/2011 | Couture | |

FOREIGN PATENT DOCUMENTS

| | | |
|---|---|---|
| DE | 9005410 | 7/1990 |
| DE | 9105890 | 8/1991 |
| DE | 9210565.3 | 12/1992 |
| DE | 4325431 | 2/1994 |
| EP | 0456896 | 11/1991 |
| FR | 2383838 | 10/1978 |
| GB | 1068191 | 5/1965 |

* cited by examiner

SHELF-READY SHIPPER DISPLAY SYSTEM

CROSS-REFERENCE TO RELATED APPLICATIONS

This application claims the benefit of U.S. Provisional Application No. 61/174,161 filed Apr. 30, 2009 entitled "Shelf-Ready Display System," the contents of which are incorporated herein by this reference.

FIELD OF THE INVENTION

Embodiments of the present invention relate to shelf-ready shipper display systems having a shipping configuration and a display configuration.

BACKGROUND

Retail product sales are driven by many factors. Product demand, quality, and pricing are some factors that contribute to retail product sales. Other factors may include product advertising and product location in the retail environment. Many product display devices are designed to take advantage of valuable retail space. Display devices may also be designed to utilize advertising space creatively to include product graphics, indicia, and trademarks.

Display devices and their products ideally should be easy to assemble, easy to ship, easy to set up, and require minimal time and effort from retail employees. Some retail establishments require that displays meet particular size specifications to maximize the advertising and display space for the product. Some retail establishments also require that the display be easy to identify, easy to open, easy to replenish, and easy to break down for disposal of the display. Moreover, the display ideally should be configured so that product housed in the display be readily aligned for sale, and be easy for a consumer to identify, handle, and remove from the display. In other words, many retail establishments are moving toward a display that is "shelf-ready." Many retail establishments are also moving toward displays that use less material and are therefore more environmentally friendly.

It is thus desirable to provide a display that can be produced, assembled and filled on existing equipment, is easy and inexpensive to ship, is easy to set up at the retail location, and that provides efficient delivery of product to the end-consumer. It is further desirable to provide a display that features graphics, and to protect those graphics during shipment. It is further desirable to provide a display that is strong while using a minimal amount of material.

BRIEF SUMMARY OF THE INVENTION

Embodiments of this invention include a shelf-ready shipper display system that includes a tray portion, a hood portion, and a reinforcement panel. In some embodiments, the reinforcement panel is optional. According to one embodiment of this invention, the shipper display has a shipping configuration and a display configuration. According to one embodiment, in the shipping configuration, the hood portion and the reinforcement panel surround the tray portion to protect product housed in the tray portion. In some embodiments, the reinforcement panel covers a front panel of the tray portion, such tray front panel optionally including graphics and promotional information. In some embodiments, the reinforcement panel also provides additional support to the display. In one embodiment, the hood portion (and in certain embodiments the reinforcement panel) can be easily separated from the tray portion when the shipper display is converted from the shipping configuration to the display configuration. In some embodiments, the shipper display is made from a single blank.

DETAILED DESCRIPTION

Embodiments of the invention now will be described more fully with reference to the drawings.

Figure 1:
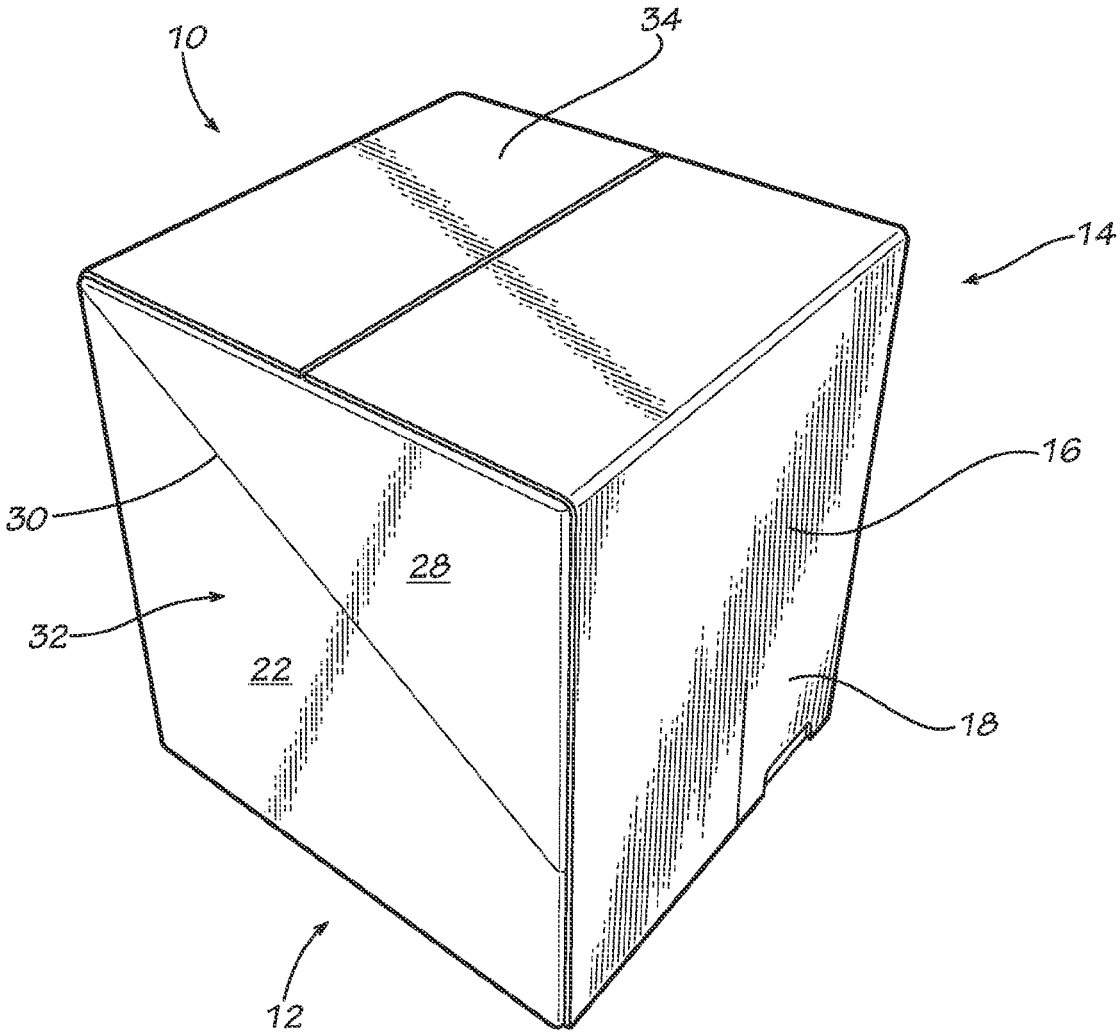
FIG. 1 is a perspective view of the shipper display system according to one embodiment of the invention, shown in the shipping configuration.
Figure 55:
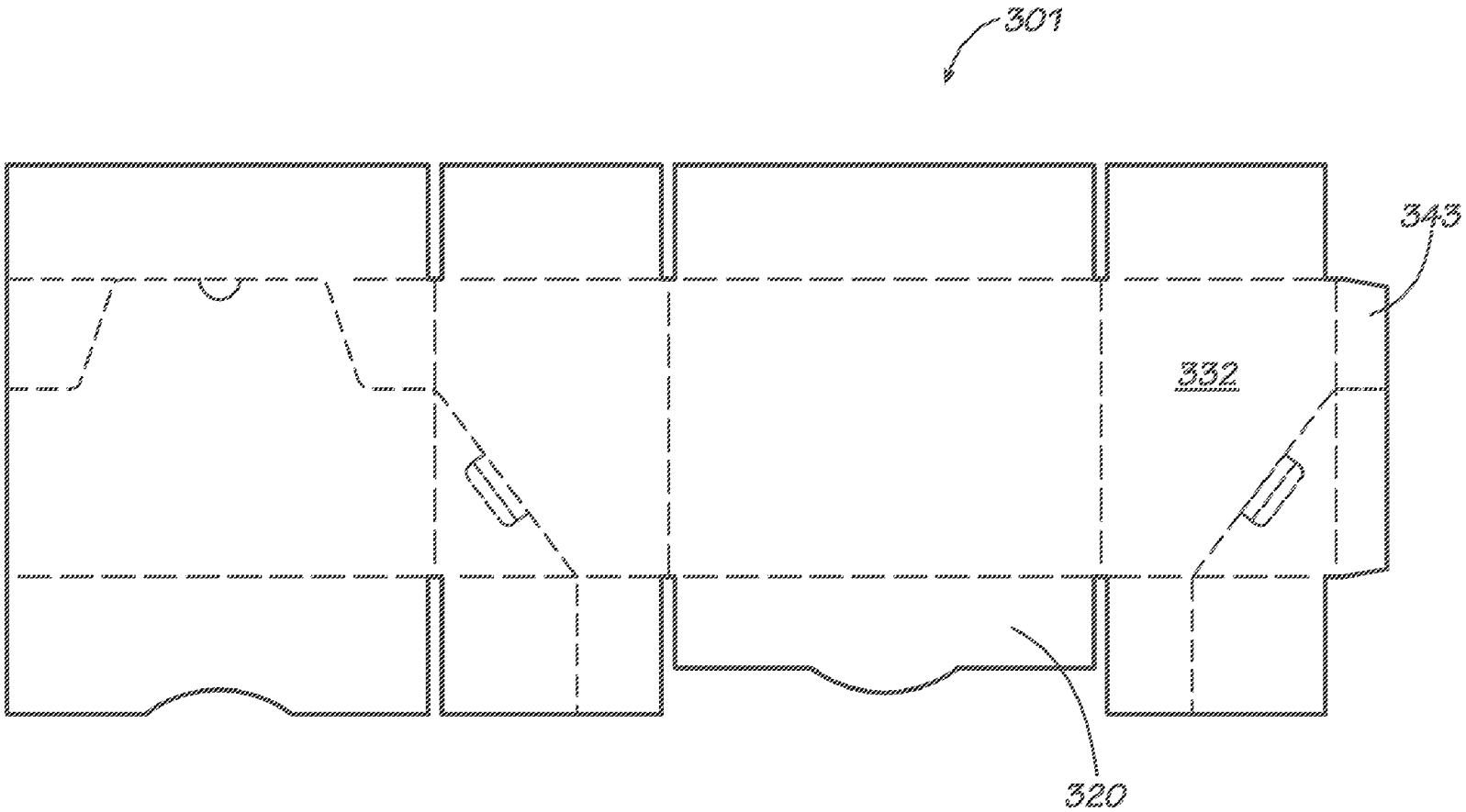
FIG. 55 is a top plan view of a blank from which a shipper display system is formed according to an alternate embodiment of the invention.

FIGS. 1-55 show various views of different embodiments of a shelf-ready shipper display system of this invention. As shown in the embodiment of FIGS. 1-6, shipper display 10 comprises: a tray portion 12, a hood portion 14, and a reinforcement panel 16. In this embodiment, the hood portion 14 and the reinforcement panel 16 are configured so that they may be separated from the tray portion 12 when the shipper display is converted from a shipping configuration into a display configuration.

Figure 8:
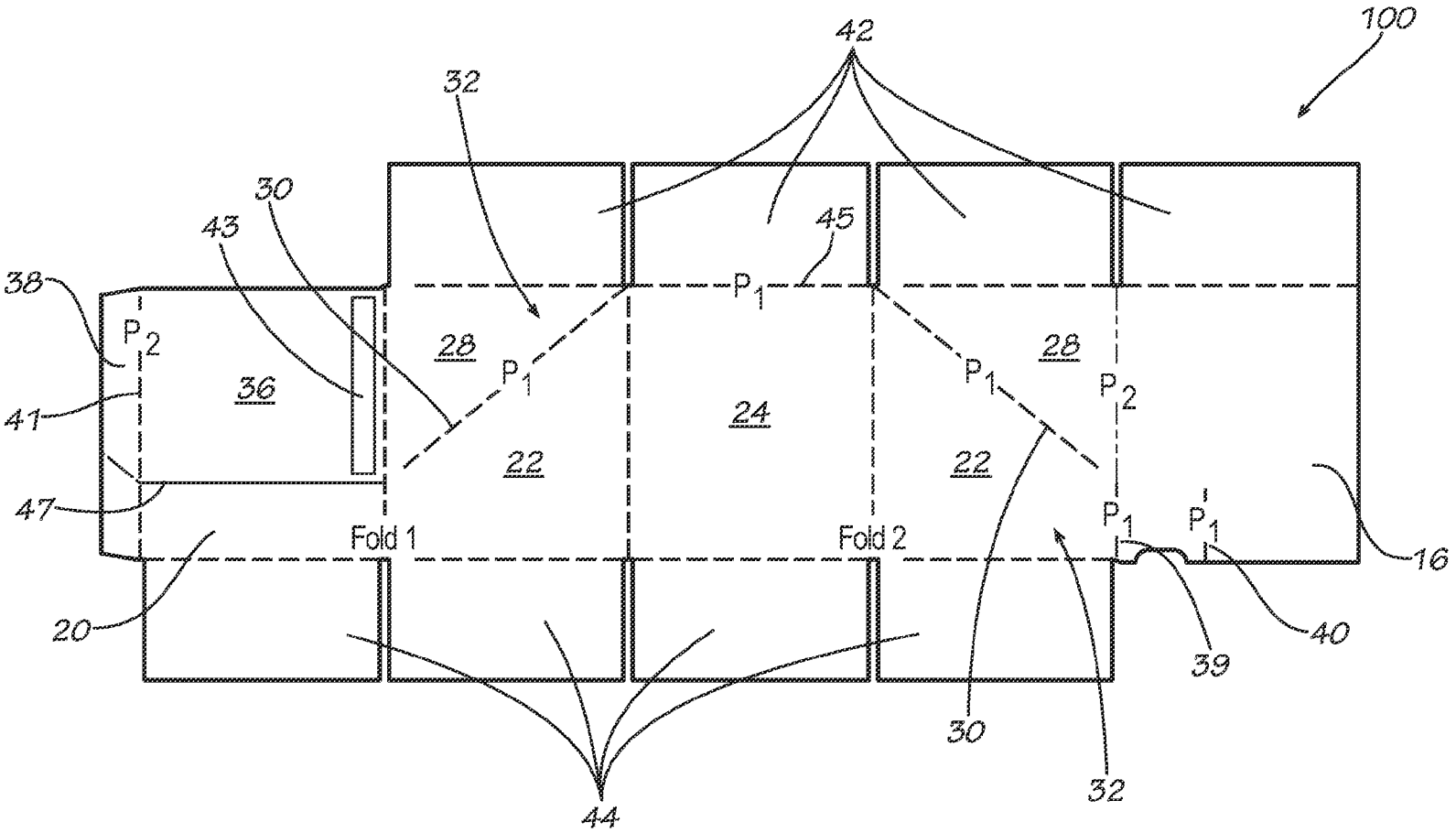
FIG. 8 is a top plan view of the blank from which the shipper display system of FIG. 1 is formed.

The shipper display shown in FIGS. 1-6 may be formed from a single blank 100, shown in FIG. 8. The blanks illustrated herein are formed from foldable substrates, which may be paper-based material such as paperboard or corrugated sheet material, although other materials may be used if desired. The blanks may be formed from virgin or recycled material, may be coated or uncoated, and may be single-ply or laminated paperboard. Unless otherwise stated, within the borders of an illustration of a blank, broken or dotted lines indicate fold lines, score lines, perforation lines, or other lines of weakness, while solid lines indicate cuts or apertures. As shown in the drawings, a broken or dotted line labeled as $P_1$ indicates a microperforation or any other perforation that is suitable for tearing, and a broken or dotted line labeled as $P_2$ indicates a standard perforation that is suitable for folding. As one of ordinary skill in the art will appreciate, however, any suitable perforation line may be used and in some embodiments, a line identified as a $P_1$ could be a standard perforation while a line identified as a $P_2$ could be a microperforation. Moreover, any perforation line with suitable spacing may be used, which may vary depending on the type and weight of material used and/or the type of case erecting equipment used.

As shown in FIG. 8, blank 100 includes reinforcement panel 16, tray front panel 20 (which is part of the tray portion 12 of the formed display 10), and side panels 32. Each side panel 32 includes a zone of weakness 30 (which may be a score line, a line of perforation, or other zone of weakness) that separates the side panel 32 into a lower side panel 22 and an upper side panel 28. Although zone of weakness 30 is shown as a straight line in FIGS. 1-18, zone of weakness 30 may instead be curved or have any other suitable configuration (see, for example, the blanks illustrated in FIGS. 19-24). The lower side panel 22 is part of the tray portion 12 of the formed shipper display 10, and the upper side panel 28 is part of the hood portion 14 of the formed shipper display 10. Blank 100 further includes a hood front panel 36 that is part of the hood portion 14 of the formed shipper display 10.

Blank 100 also includes bottom flaps 44 for forming bottom panel 26 of the tray portion 12 of the formed shipper display 10. Blank 100 further includes top flaps 42 for forming top panel 34 of the hood portion 14 of the formed shipper display 10.

Moreover, as shown in FIG. 8, in some embodiments, blank 100 includes a perforation line 45. In some embodiments, blank 100 may also include an additional perforation line 39 that helps prevent the side panel 32 and the reinforcement panel 16 of the hood portion 14 from separating during transit of the blank 100, while still allowing the shipper display 10 to be converted from its shipping configuration to its display configuration when the shipper display 10 reaches the retail environment. In some embodiments, perforation line 39 extends at least partially from the bottom of reinforcement panel 16 up to approximately the positioning of the zone of weakness 30. Thus, perforation line 39 helps prevent premature separation of hood portion 14 from tray portion 12 during handling. As detailed below, perforation line 39 is broken to release reinforcement panel 16 during conversion of the shipper display 10 from the shipping configuration to the display configuration.

As shown in FIG. 8, hood front panel 36 may be attached to reinforcement panel 16 by way of glue area 43. Glue area 43 may be located anywhere along hood front panel 36 or reinforcement panel 16, or both. Moreover, in some embodiments, when forming shipper display 10, the reinforcement panel 16 can be glued or otherwise attached via a glue panel 38 to the side panel 32. Any suitable type of adhesive, including but not limited to white glue, hot melt glue, moisture resistant adhesive, or water resistant adhesive, may be used to secure the reinforcement panel 16 to the hood front panel 36. In some embodiments, glue panel 38 is perforated so that it folds correctly when forming shipper display 10. For example, in some embodiments, a perforation line 41 is included above top edge 47 to assist with the formation of shipper display 10, as described below, while also preventing the creation of an inadvertent score line in side panel 32 that otherwise might occur during assembly if perforation line 41 was not present.

FIG. 1 illustrates a shipper display 10 in the shipping configuration after it has been erected from blank 100. The hood portion 14 of the shipper display 10 protects the product housed within the tray portion 12 during shipment. In the embodiment shown in FIG. 1, the reinforcement panel 16 extends so that it covers the tray front panel 20 of the tray portion 12. In certain embodiments, tray front panel 20 may include graphics or other advertising and promotional materials. Although tray front panel 20 is shown in FIGS. 4-8 as rectangular in shape, tray front panel 20 can be of various shapes and configurations defined by its top edge 47. This is possible because top edge 47 of tray front panel 20 of tray portion 12 is not connected to other portions of the display.

Covering the tray front panel 20 with the reinforcement panel 16 protects the tray front panel 20 (and any graphics on the tray front panel 20) from damage that may occur during shipping of the shipper display 10. Reinforcement panel 16 also provides additional structural integrity to shipper display 10, increasing the stacking strength of the shipper display so that shipper display 10 may be stacked without damage during transit. Specifically, the reinforcement panel 16 helps prevent shipper display 10 from deforming or collapsing due to compressive forces on the shipper display during shipment. This is particularly beneficial in embodiments of the shipper display where the side panels have zones of weakness, which reduce the strength of those panels. In such embodiments, any compressive force placed on the shipper display 10 is transmitted to the bottoms of the reinforcement panel 16 and the rear panel 24 of the tray portion 12, which oppose each other to balance and withstand these forces. In some embodiments, reinforcement panel 16 is free from any perforations or other zones of weakness to help maintain the structural integrity of shipper display 10.

Shipper display 10 is preferably configured so that reinforcement panel 16 provides the necessary amount of support to the shipper display during transit and permits the zones of weakness 30 on the side panels 32 to be broken relatively easily. In this way, the zones of weakness are configured to allow for both the integrity of the side panels 32 during shipment and handling, as well as ease of separating the hood portion 14 from the tray portion 12 at the point of sale. Testing of the shipper display 10 for shear, compressive, and tensile forces can be used to calculate and establish the appropriate profile, size, and spacing of the zones of weakness 30 and the relationship between the zones of weakness 30 and the overall dimensions and structural characteristics of the shipper display 10. In this way, a physical and quantifiable relationship between the dimensions of the shipper display and the forces applied to the shipper display can be calculated. Once this relationship is determined, the zones of weakness can be configured so that structural integrity of the shipper display is maintained, while still enabling ease of separation along the zones of weakness. The equipment used to create the zones of weakness (such as the cutting or perforation rules) can be adjusted to establish the desired zones of weakness.

Moreover, in certain embodiments, the configuration of shipper display 10 allows the top edge 47 of tray front panel 20 of tray portion 12 to remain clean and free of any perforations, glue spots, or other disruptions in the top edge that might lead to a rough top edge. Thus, the entire tray front panel 20 of shipper display 10 has a clean appearance when in the display configuration.

Figure 5:
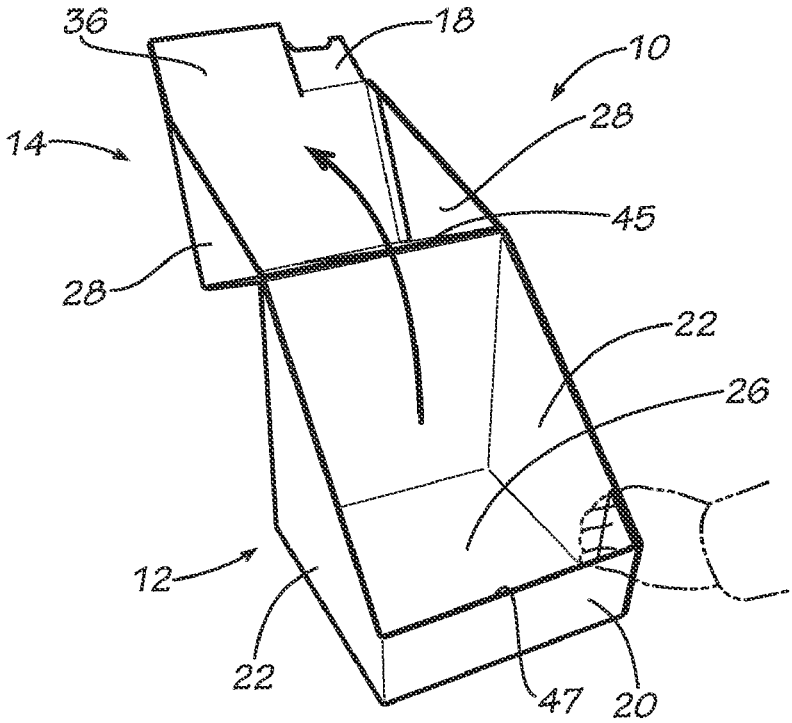
Figure 6:
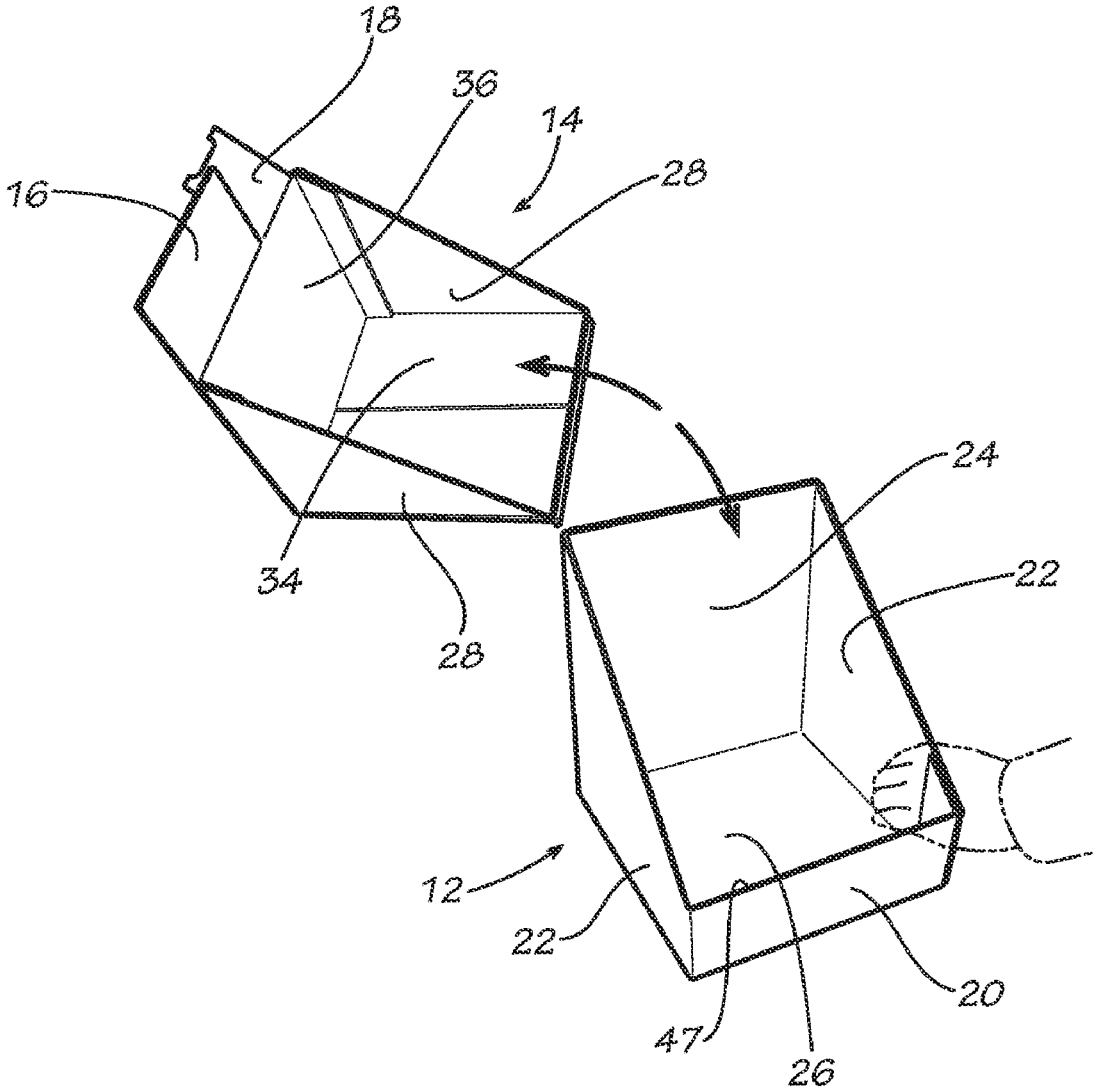

The shipper display 10 can be converted from its shipping configuration to its display configuration by means of the zones of weakness 30 in the side panels 32 of the shipper display 10. Once the zones of weakness 30 have been broken, side panel 32 separates into an upper side panel 28 and a lower side panel 22. Once separated, as shown in FIG. 6, hood portion 14, as well as reinforcement panel 16 that is attached to hood portion 14, can be separated from tray portion 12 by breaking the perforation line 45 at the top of rear panel 24, as shown in FIGS. 5-6 and 8. Use of tab 18 or similar structure can facilitate removal of hood portion 14 from tray portion 12. Tab 18 is not necessary to practice the invention, however, and if used, can be of any size and configuration, and can be located anywhere on reinforcement panel 16, or on the hood portion 14. For example, as shown FIGS. 9-14, which is an alternate embodiment of the shipper display system, tab 18 instead can be replaced with a cutout 118 in the reinforcement panel.

Figure 7:
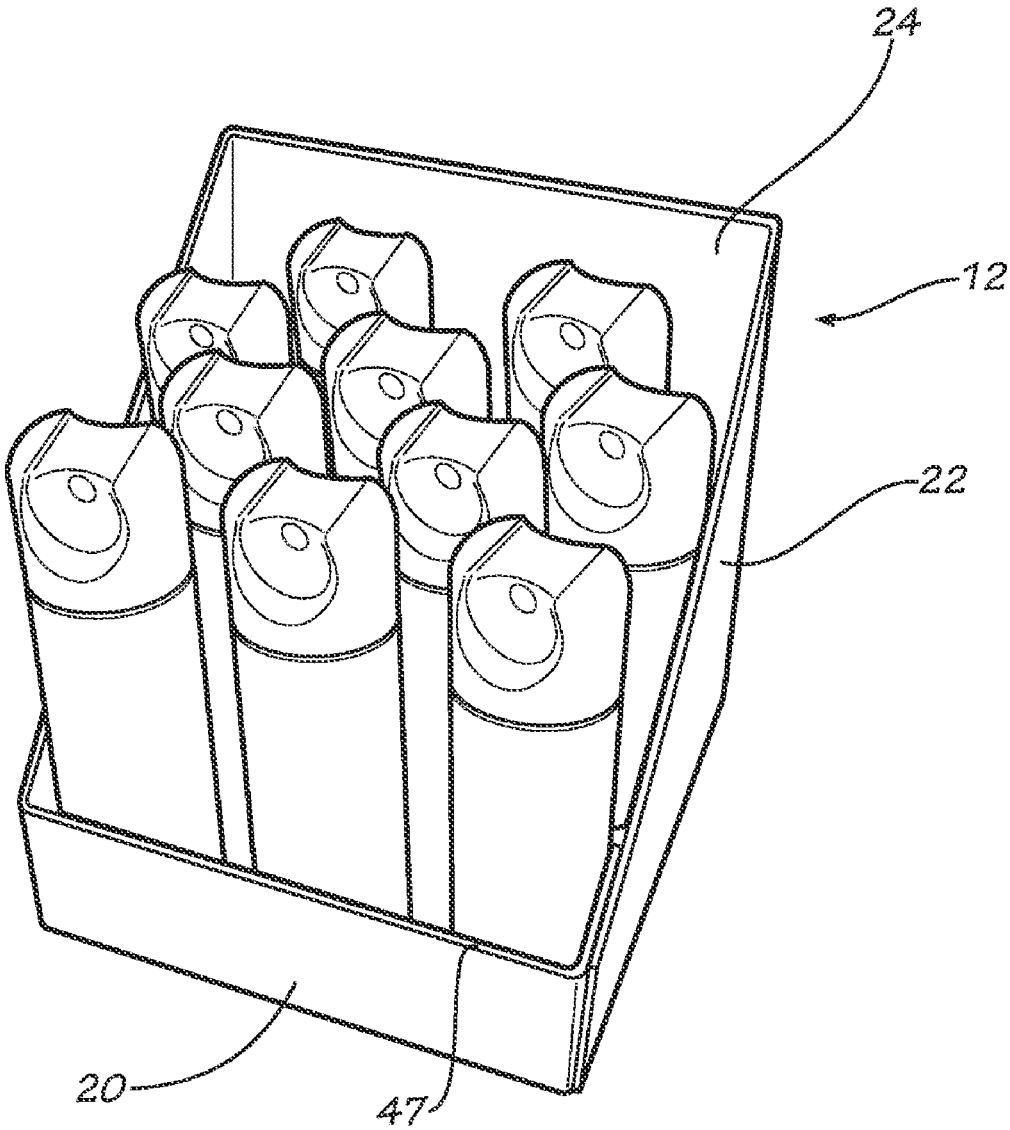
FIG. 7 is a perspective view of the shipper display system of FIG. 1, shown in the display configuration.

Once the hood portion 14 is removed, product housed within the tray portion 12 is exposed and ready for merchandising by a consumer, as shown in FIG. 7. Moreover, the tray front panel 20 of the tray portion 12 and any associated graphics are also visible. Thus, the shipper display 10 in its display configuration is shelf ready.

As will be apparent from the various embodiments described below, there are various modifications that may be made to blank 100 without departing from the spirit of the invention. The following is a non-exhaustive list of the types of modifications that are considered to be within the scope of the invention: the dimensions of the overall blank (and thus the overall dimensions of the shipper display) may be modified based on customer preferences; the placement of certain flaps and/or panels relative to other flaps and/or panels may be moved to accommodate different types of equipment for forming the blank and/or packing the shipper display; the placement of the glue panel may be moved or excluded altogether; the glue areas may be moved or excluded; the number of glue areas may be altered (for example, more glue areas or larger glue areas may be required as the width of the front panel of the shipper display increases); the zones of weakness may have any suitable configuration and/or may be repositioned on the shipper display; additional lines of perforation may be included to assist with the conversion of the shipper display; the shape and/or configuration of the tray front panel may be modified as desired; various fold lines may be modified or added as appropriate; and/or the shipper display may optionally include a variety of cutouts, apertures, or tabs to assist with the conversion of the shipper display.

Figure 12:
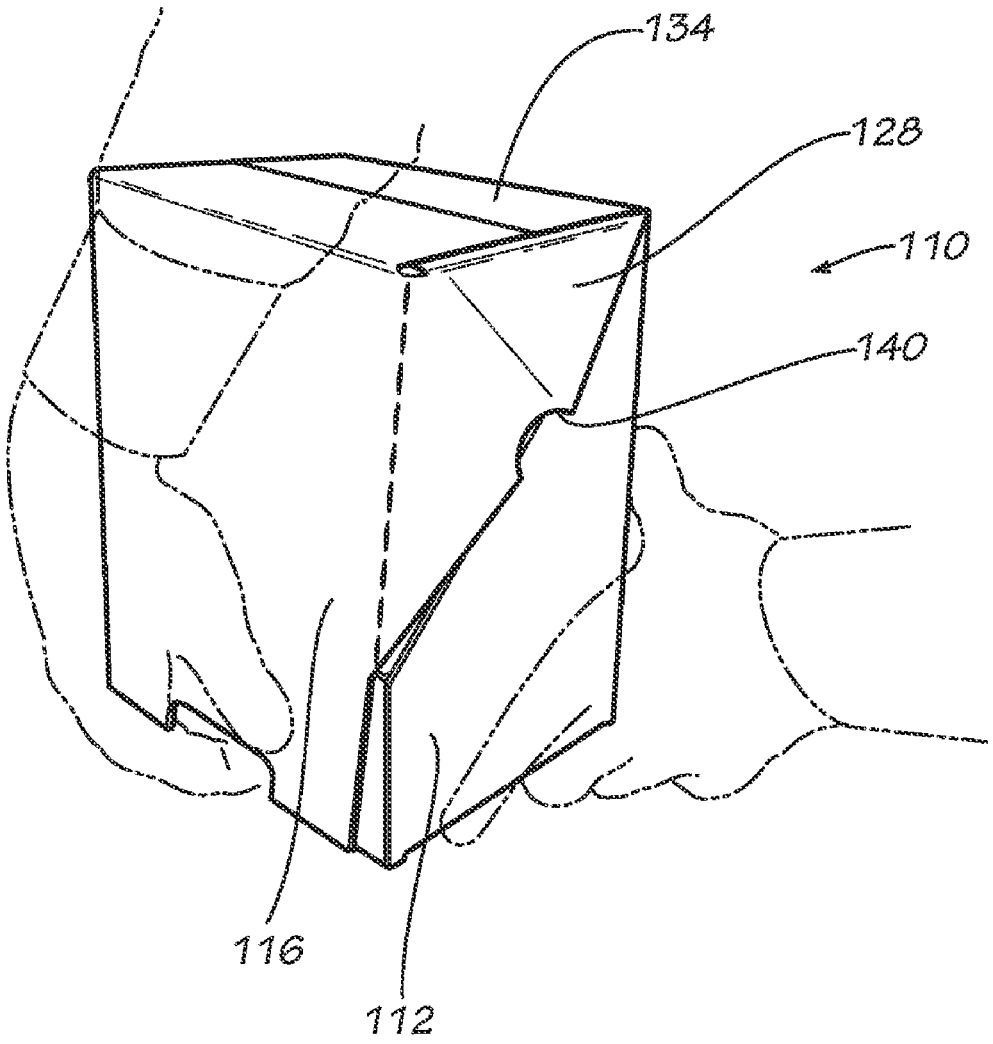
Figure 13:
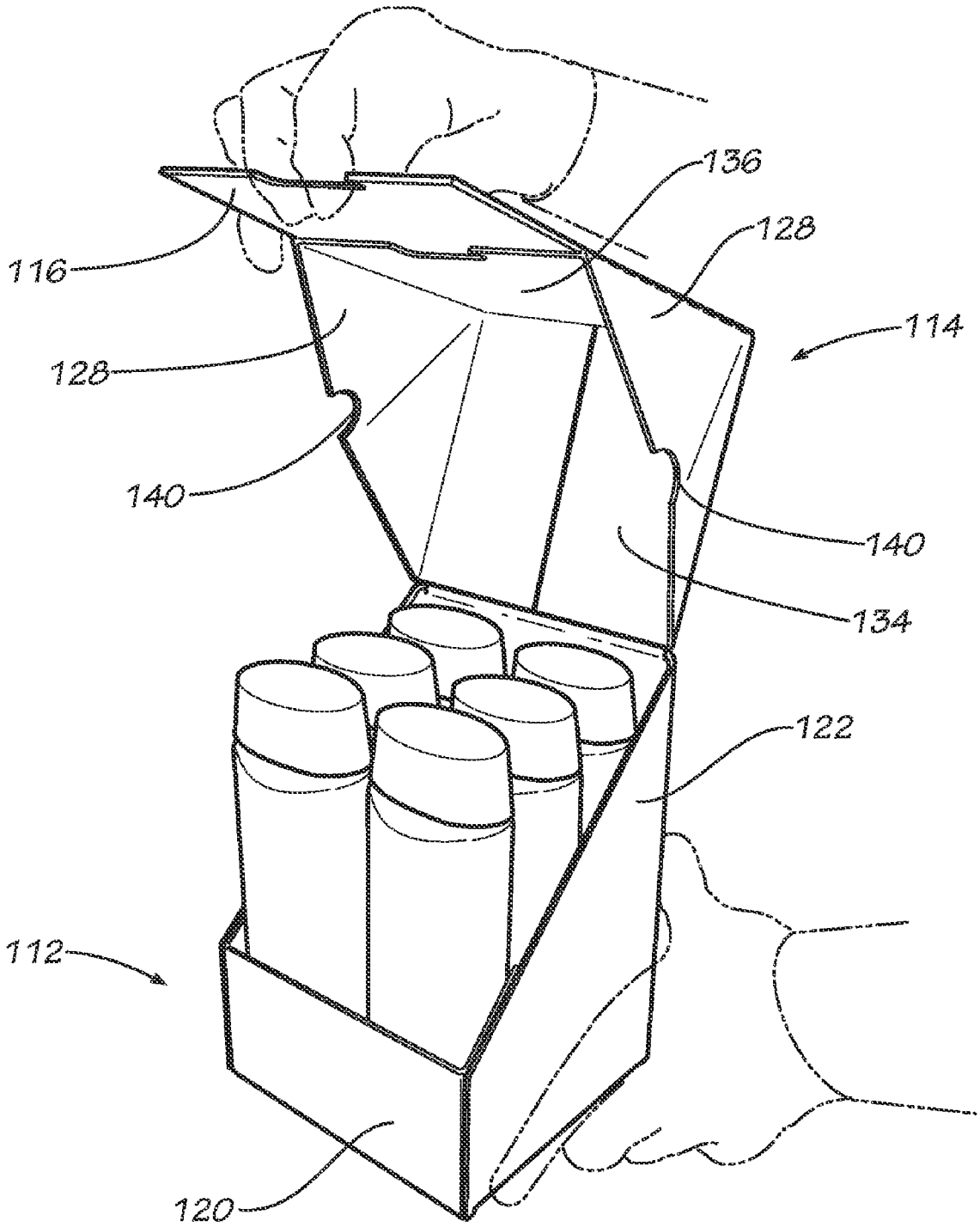
Figure 14:
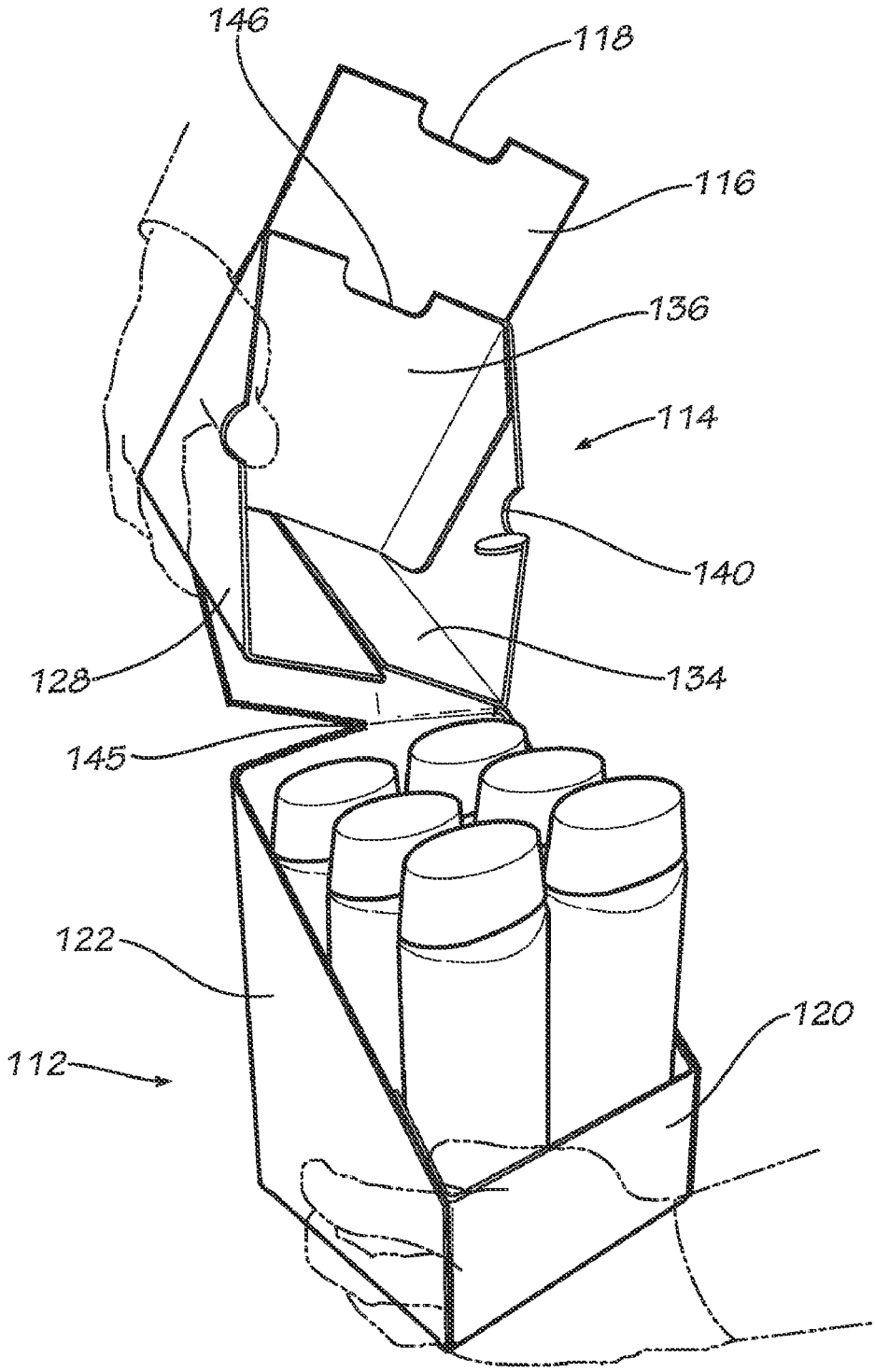
Figure 15:
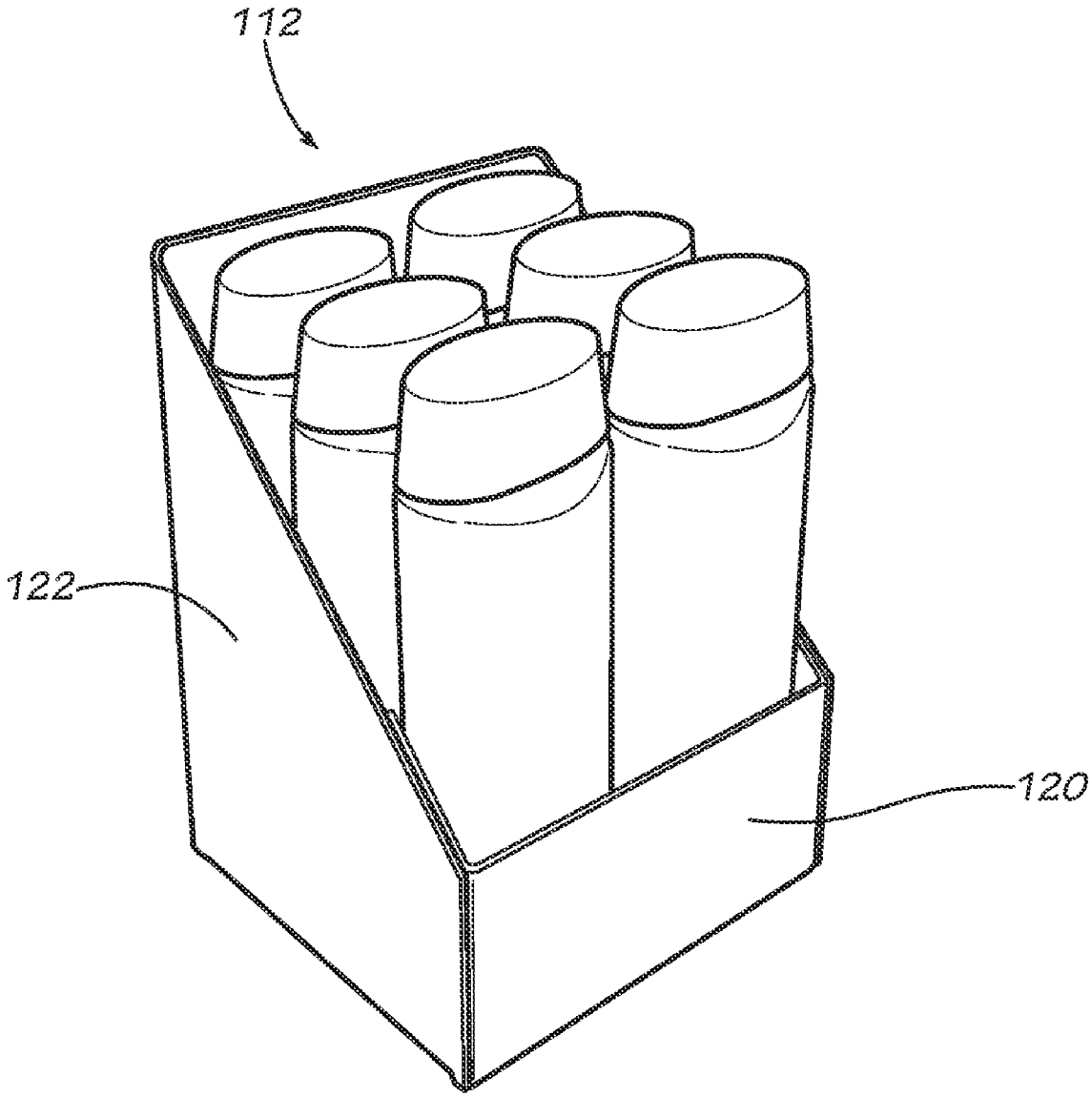
FIG. 15 is a perspective view of the shipper display system of FIG. 9, shown in the display configuration.
Figure 16:
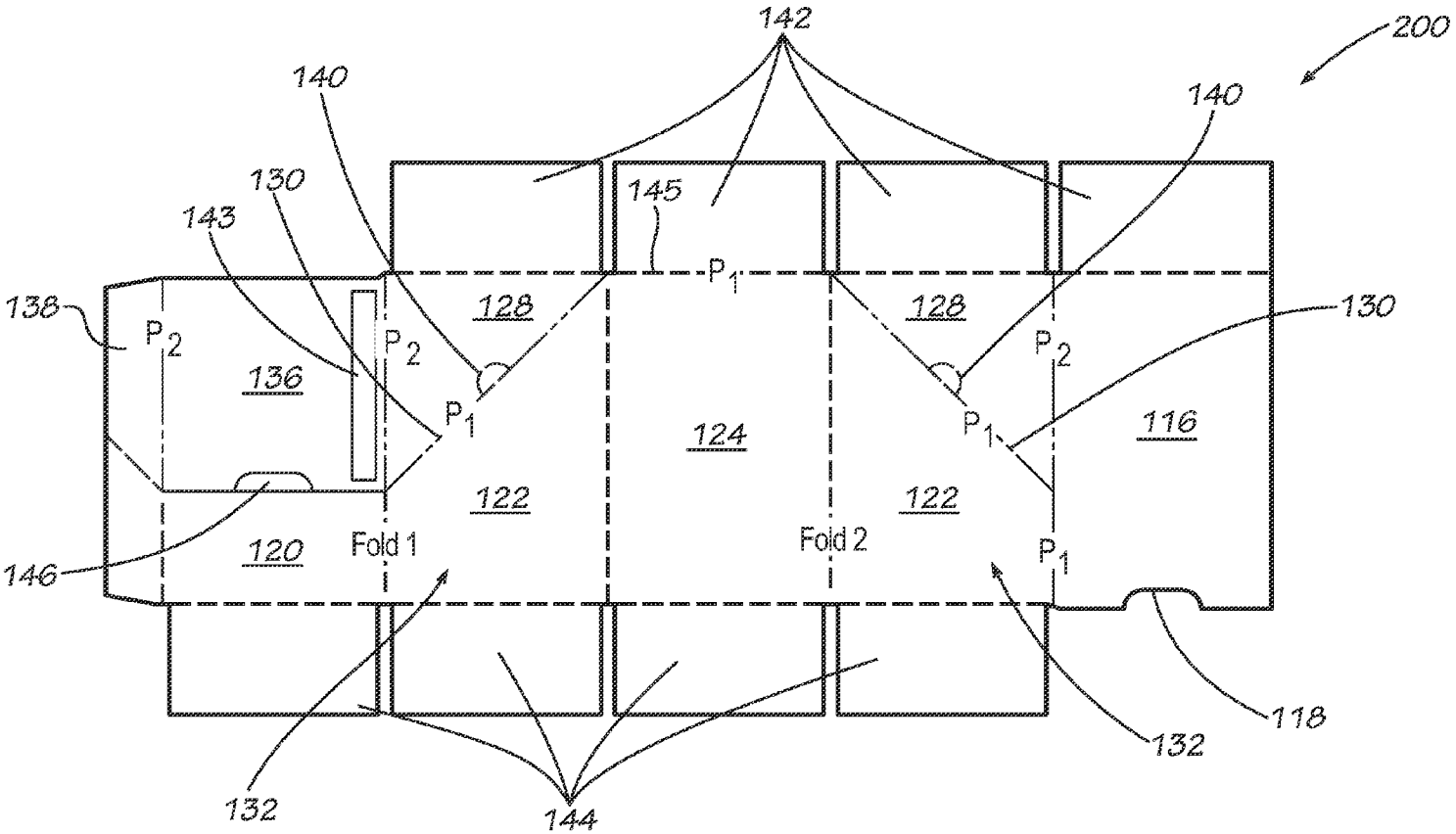
FIG. 16 is a top plan view of the blank from which the shipper display system of FIG. 9 is formed.

FIGS. 9-15 illustrate an alternate embodiment of the invention. As shown in FIGS. 9-15, shipper display 110 can be formed from a blank 200, shown in FIG. 16. Like shipper display 10, shipper display 110 can be converted from a shipping configuration into a display orientation. Shipper display 110 has many of the same features and benefits as shipper display 10. As shown in FIGS. 9-18, one or both side panels 132 can include cutouts 140 to facilitate separation of the lower side panel 122 from the upper side panel 128 by way of zone of weakness 130. Moreover, as shown in FIGS. 9-18, reinforcement panel 116 may include a cutout 118 to facilitate removal of the hood portion 114 from the tray portion 112. Cutout 118 can also be used if the flaps 144 of the bottom panel 126 are taped together to ensure that the reinforcement panel 116 is not taped, which would hinder separation of the hood portion 114 from the tray portion 112. Use of cutout 118 is not required to practice the invention. For example, if flaps 144 are glued together to form bottom panel 126, cutout 118 may not be necessary. Moreover, as shown in FIG. 14, hood front panel 136 of hood portion 114 may optionally include a slot 146 to further facilitate removal of hood portion 114 from tray portion 112 upon breaking of the perforation line 145 (FIGS. 14 and 16).

Figure 17:
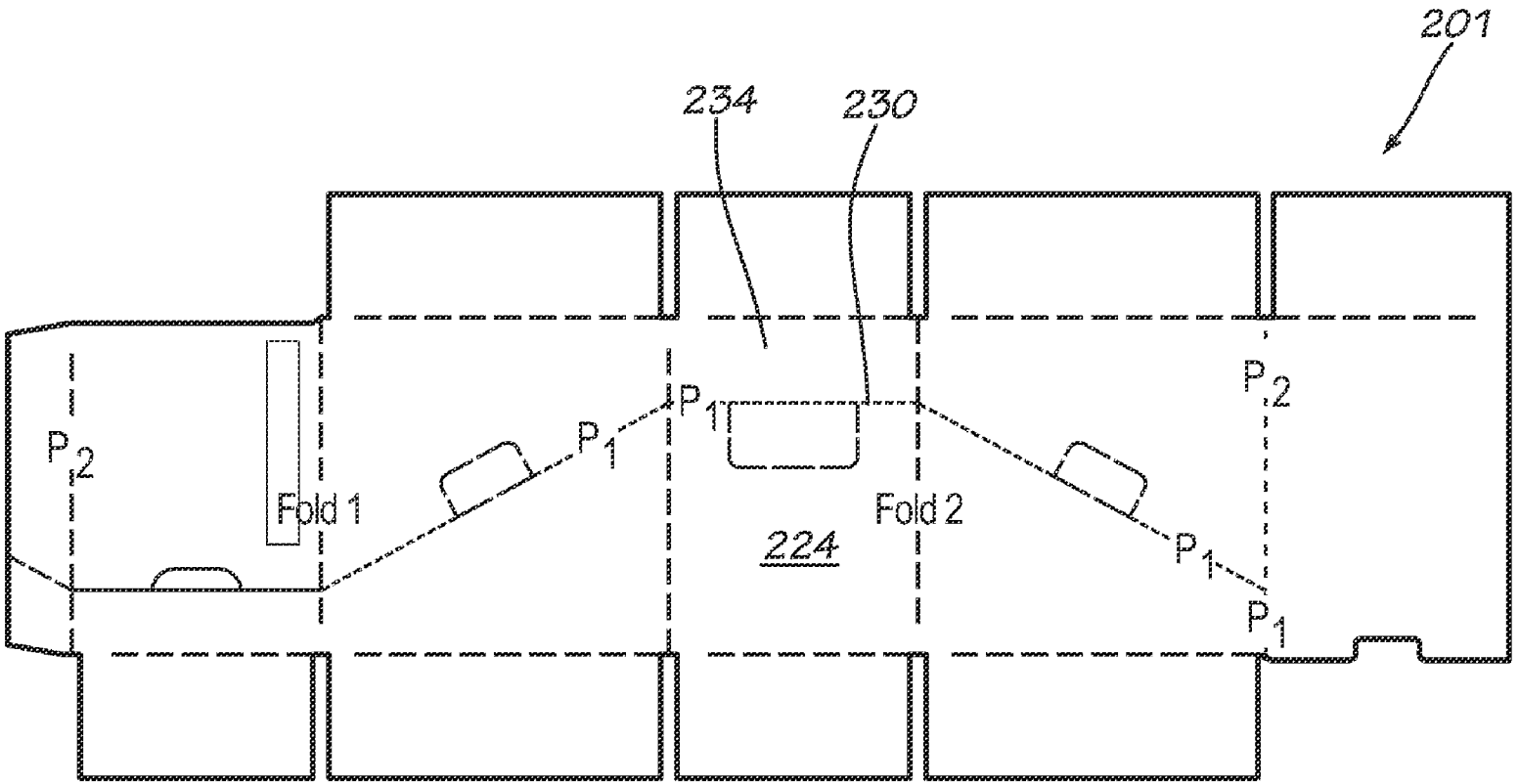
FIGS. 17-24 are top plan views of blanks from which shipper display systems according to other embodiments of the invention are formed.

In another embodiment of this invention, which can be formed from the blank 201 shown in FIG. 17, the rear panel 224 can also include a zone of weakness 230 that enables a top portion 234 of rear panel 224 to be removed when the hood portion is separated from the tray portion, as described above. In this manner, when the shipper display is on the retail shelf, a consumer can determine if there is another display behind the forward-most display on the shelf when the forward-most display is out of product.

Figure 18:
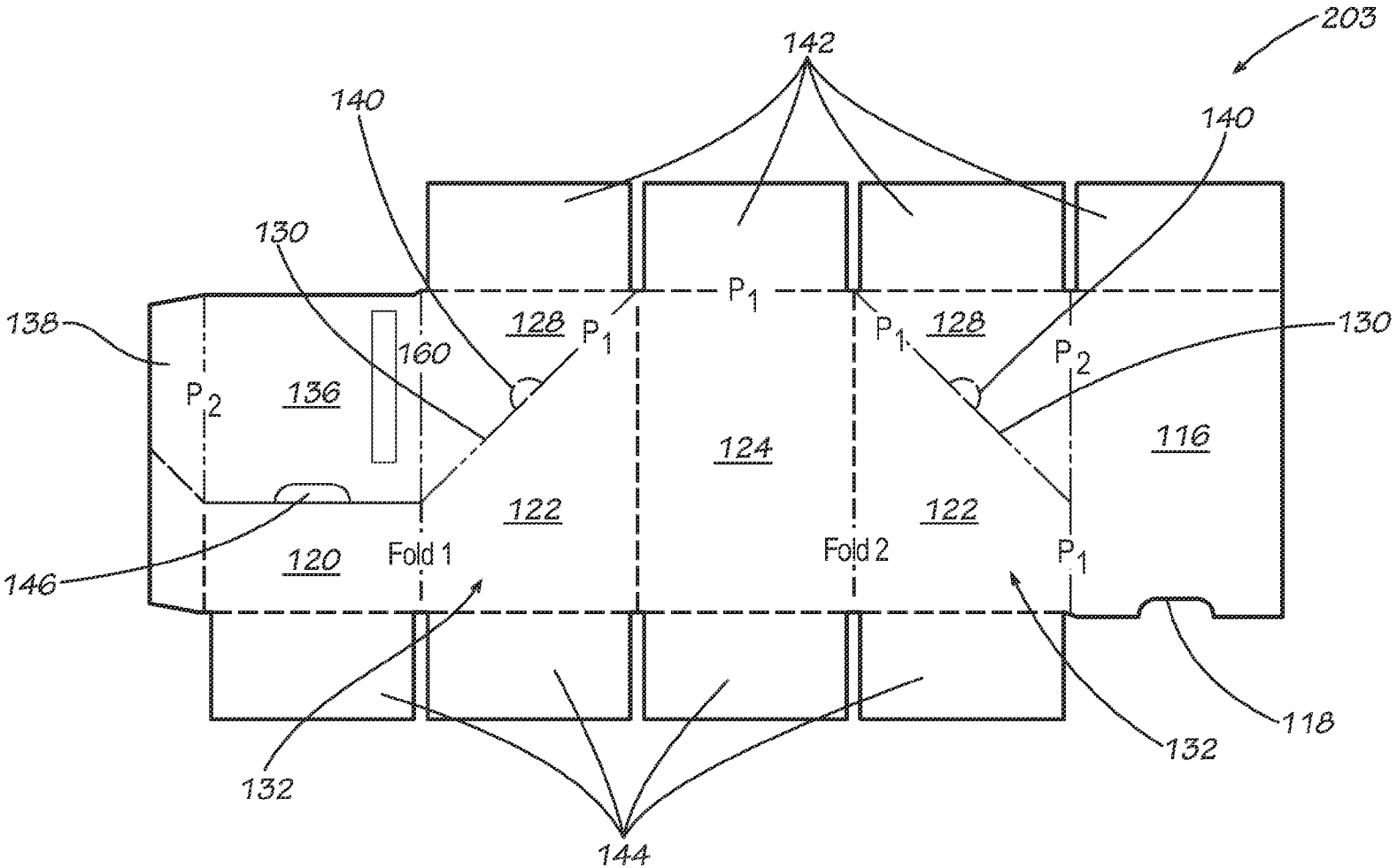

In the embodiment shown in FIG. 18, which is similar to the blank 200 shown in FIG. 16, an additional perforation line 160 is included on the fold line between the side panel 132 and the hood front panel 136 to help keep the blank 203 oriented properly as it is folded.

Figure 19:
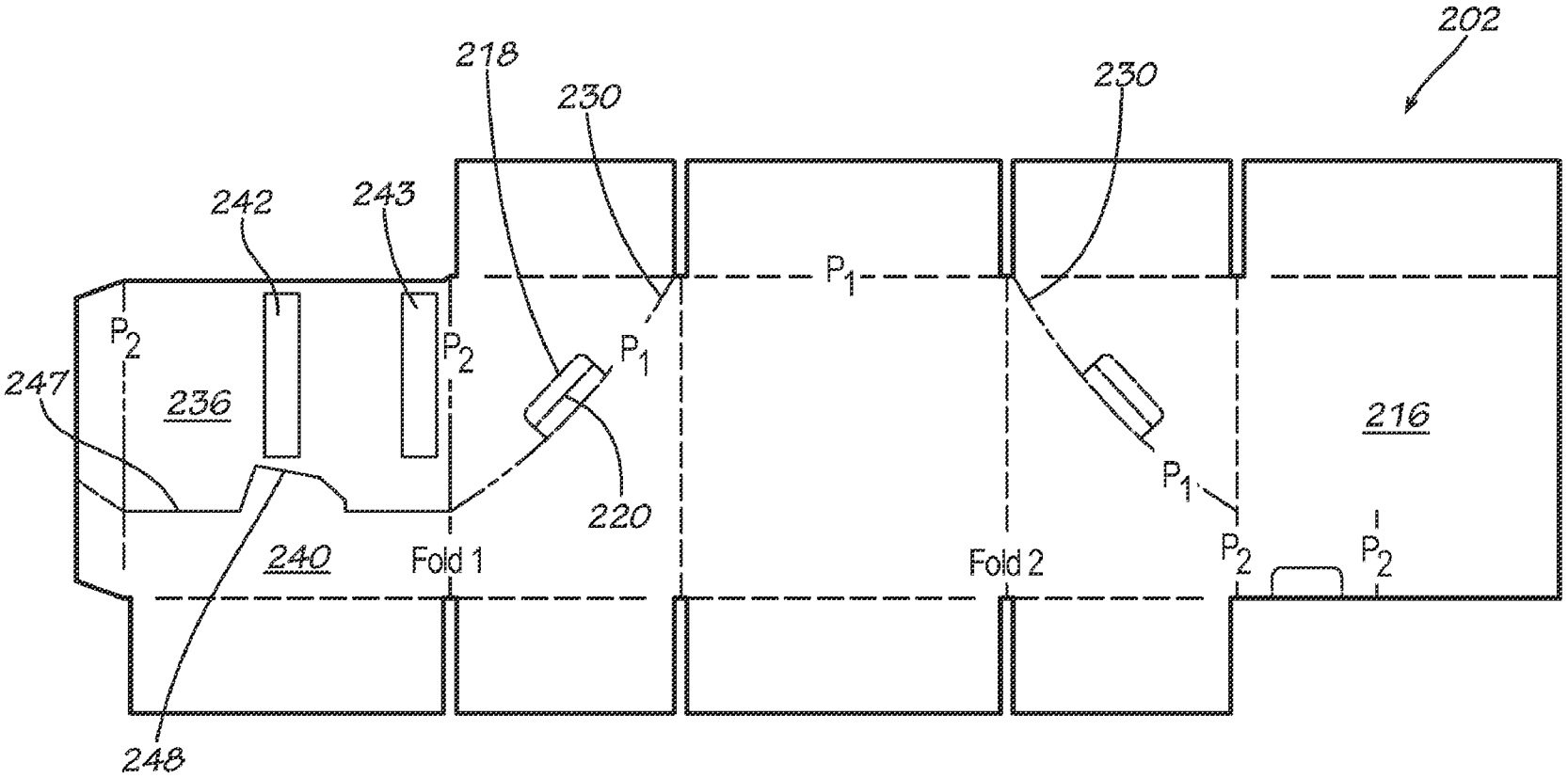

FIGS. 19-24 illustrate additional embodiments of the invention. The blanks shown in FIGS. 19-24 form shipper displays having many of the same features and benefits as shipper displays 10 and 110 detailed above. Blank 202 shown in FIG. 19 is similar to the blanks 200 and 203 in FIGS. 16 and 18. Blank 202, however, includes curved zones of weakness 230. Hood front panel 236 also includes two glue panels 242 and 243. Additional glue area 242 helps prevent the reinforcement panel 216 from bowing when the blank 202 is erected into the formed display. Further, optional cutouts 218, which facilitate the breaking of the zone of weakness 230, each include a perforation line 220 so that, as the shipper display is being converted from its shipping configuration to the display configuration upon separation of the zone of weakness 230, the cutouts 218 collapse and avoid collision with product housed within the erected shipper display. Moreover, top edge 247 of tray front panel 240 includes a lip 248. Lip 248 may be of any suitable shape and dimensions, and may include graphics or other promotional material that would be visible to a consumer once the shipper display is converted to its display configuration.

Figure 20:
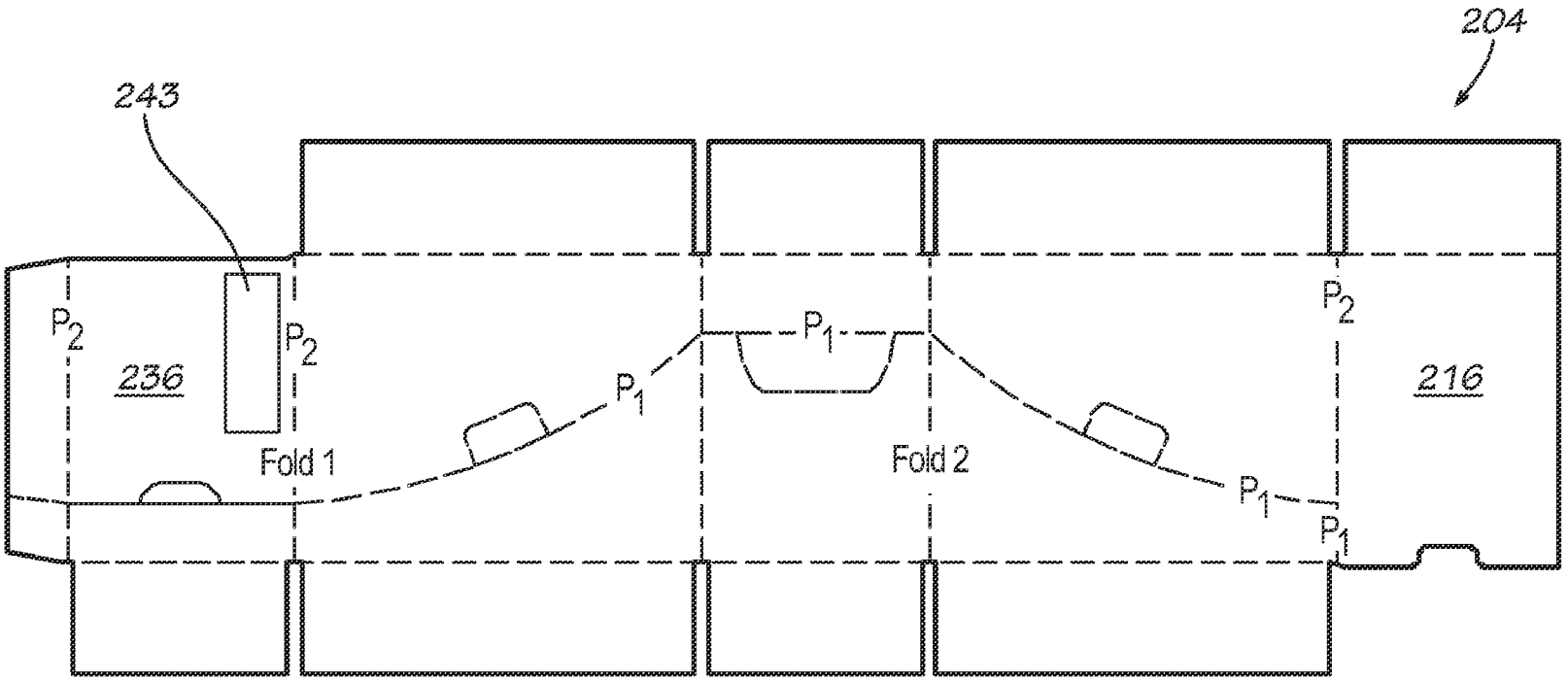
Figure 21:
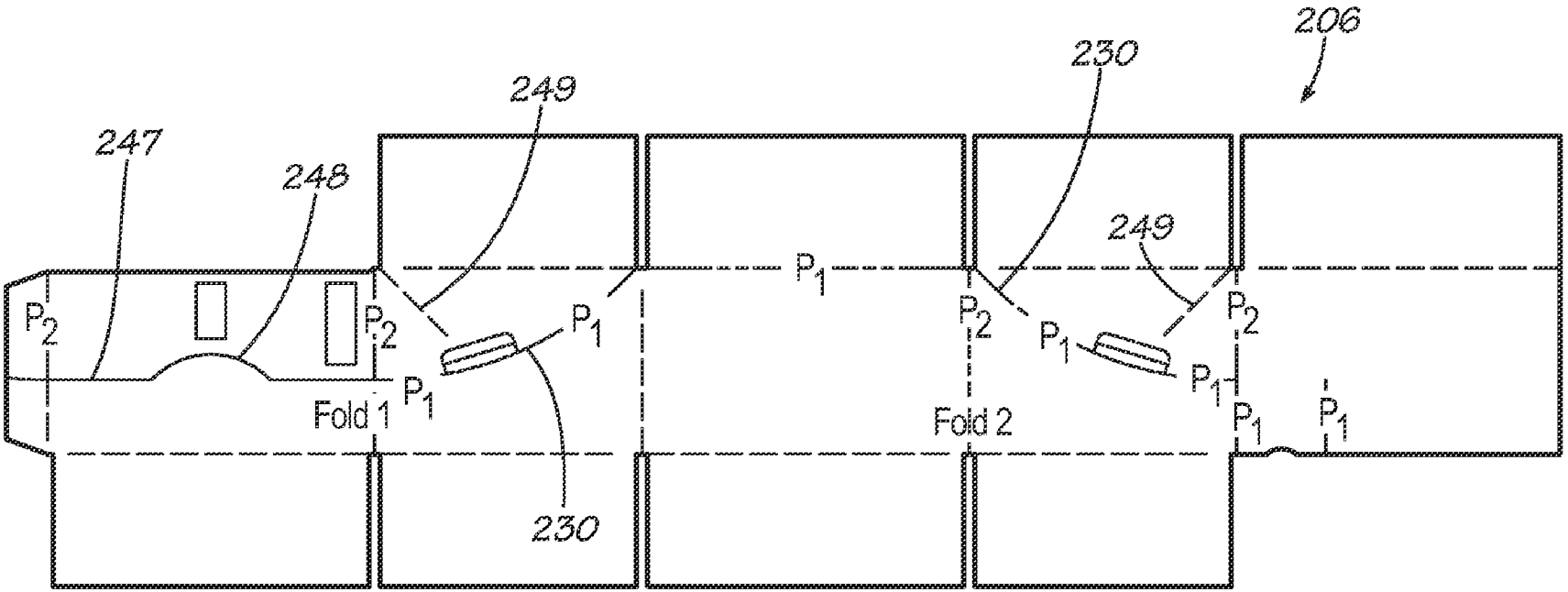

Blank 204 illustrated in FIG. 20 is similar to blank 300 of FIG. 17, and has an additional glue panel 243 to help secure the hood front panel 236 to reinforcement panel 216. Blank 206 illustrated in FIG. 21 is similar to blank 202 of FIG. 19. Top edge 247 includes a curved lip 248. Moreover, blank 206 includes additional perforation or score lines 249 to facilitate the tearing of the zones of weakness 230 as the shipper display is converted from its shipping configuration to its display configuration.

Figure 22:
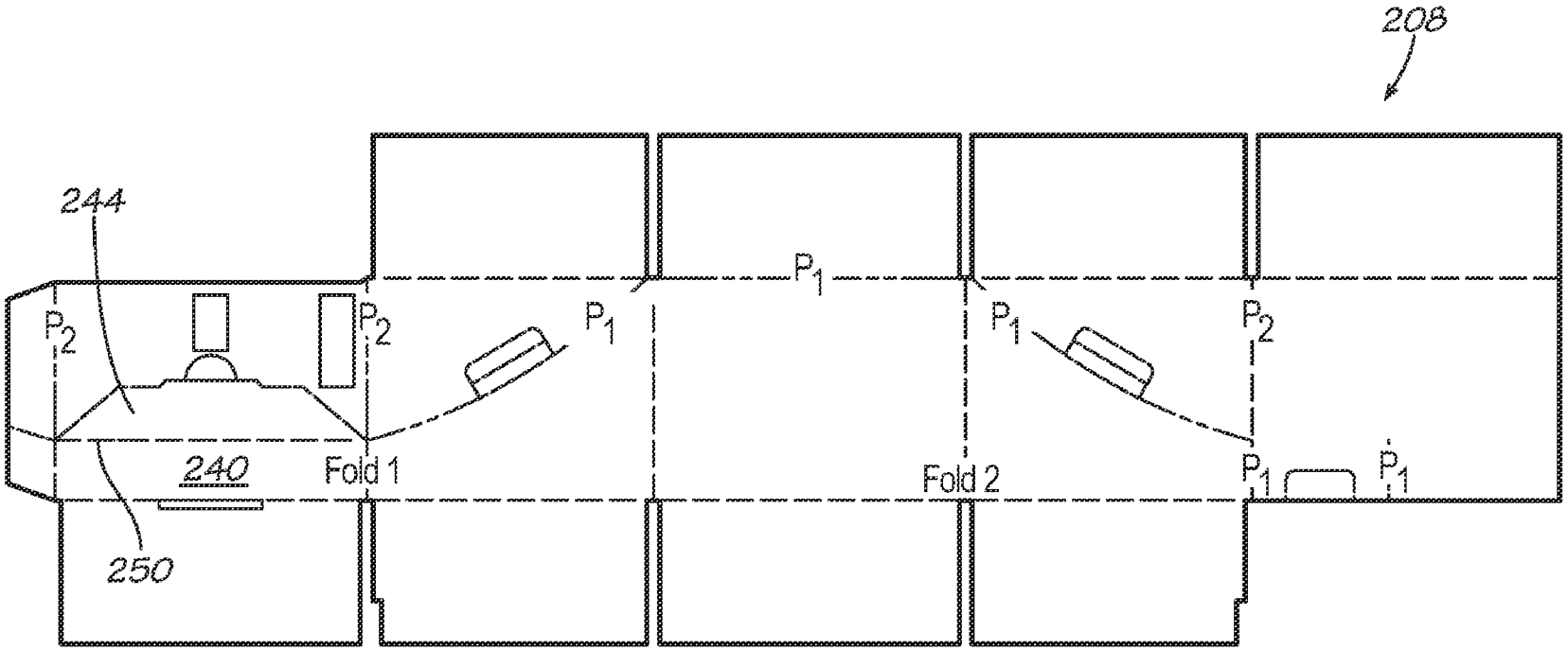

Blank 208 illustrated in FIG. 22 is similar to blank 206 of FIG. 21. The tray front panel 240 includes a fold-over flap 244 and a fold line 250. Specifically, before the shipper display is loaded with product, fold-over flap 244 may be folded about fold line 250. This results in a cleaner top edge for the tray front panel, and also provides additional strength to the tray front panel 240.

Figure 23:
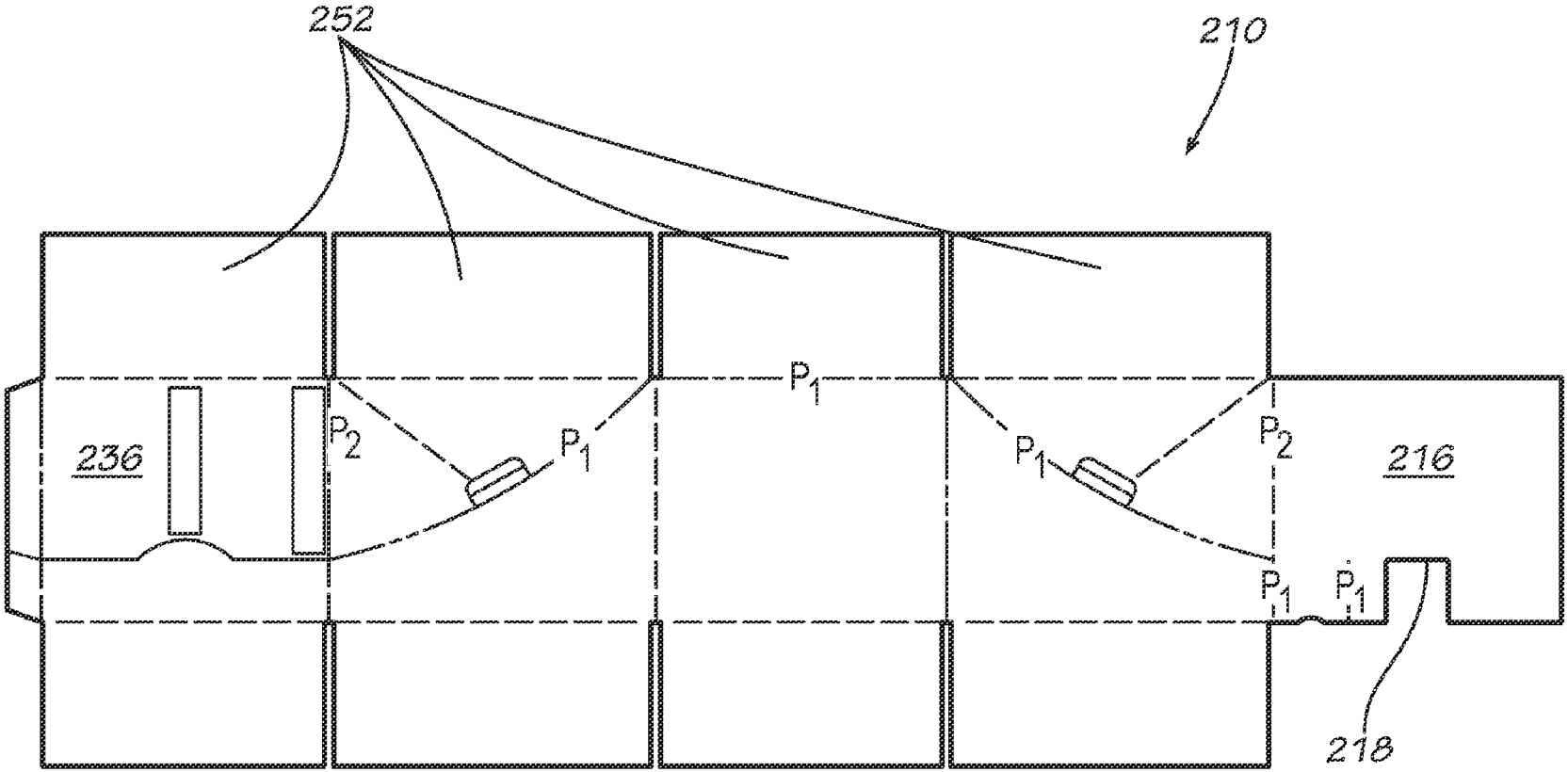
Figure 24:
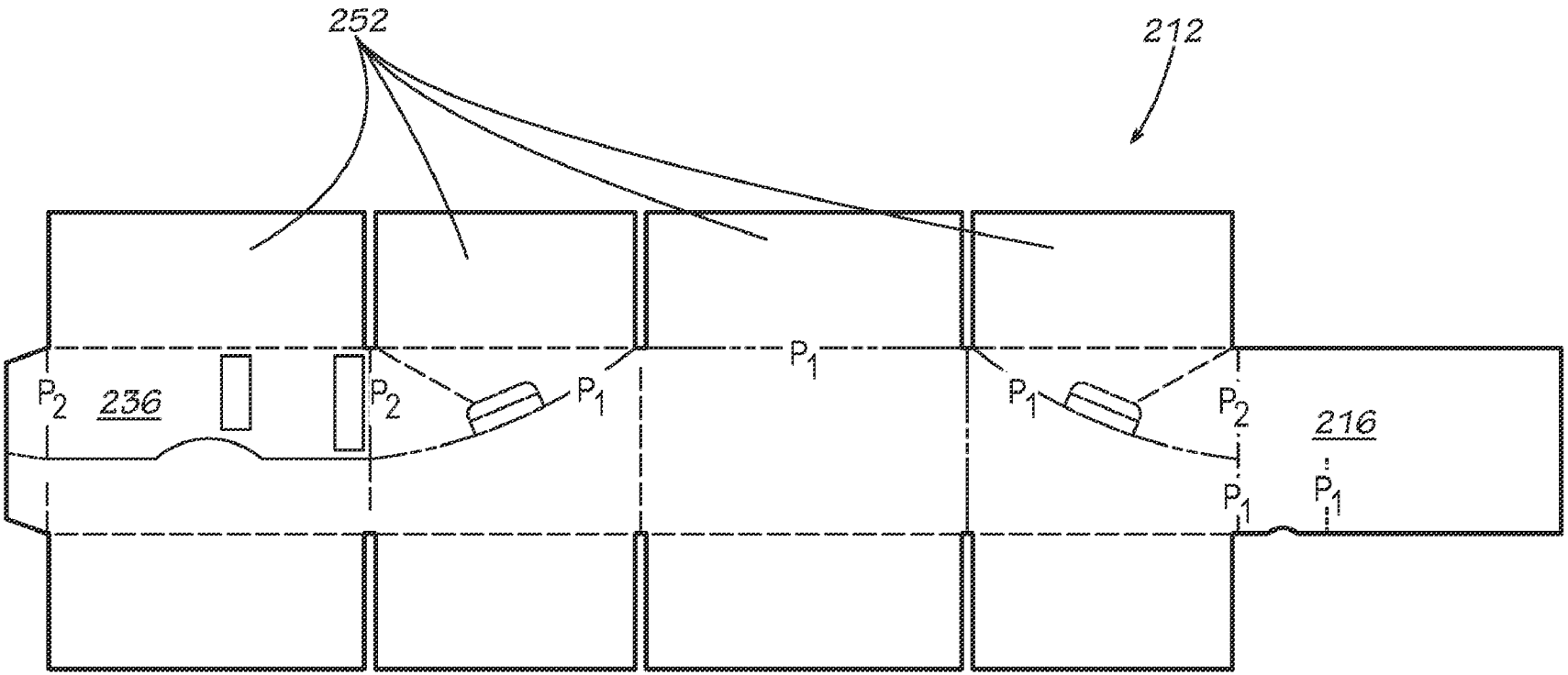

FIGS. 23-24 illustrate additional embodiments of the invention. The blanks shown in FIGS. 23-24 form displays having many of the same features and benefits as shipper displays 10 and 110 detailed above. FIGS. 23-24 illustrate blanks 210 and 212, which are similar to blank 206 shown in FIG. 21. Like blank 206, blanks 210 and 212 include top flaps 252 that form the top panel 234 of the hood portion. As illustrated in FIGS. 23-24, however, one of the top flaps 252 is positioned relative to the hood front panel 236, instead of relative to reinforcement panel 216. Adjusting the placement of this particular top flap 252 helps keep blanks 210 and 212 aligned properly during forming of the shipper display. With certain machinery, the squaring process lines up the edges of blanks 210 and 212 during folding of the blanks to create the erected shipper displays. Moreover, the hood front panel 236 of blank 210 includes additional glue panels, described above, and an additional cutout 218 in the reinforcement panel 216, as described above.

Figure 25:
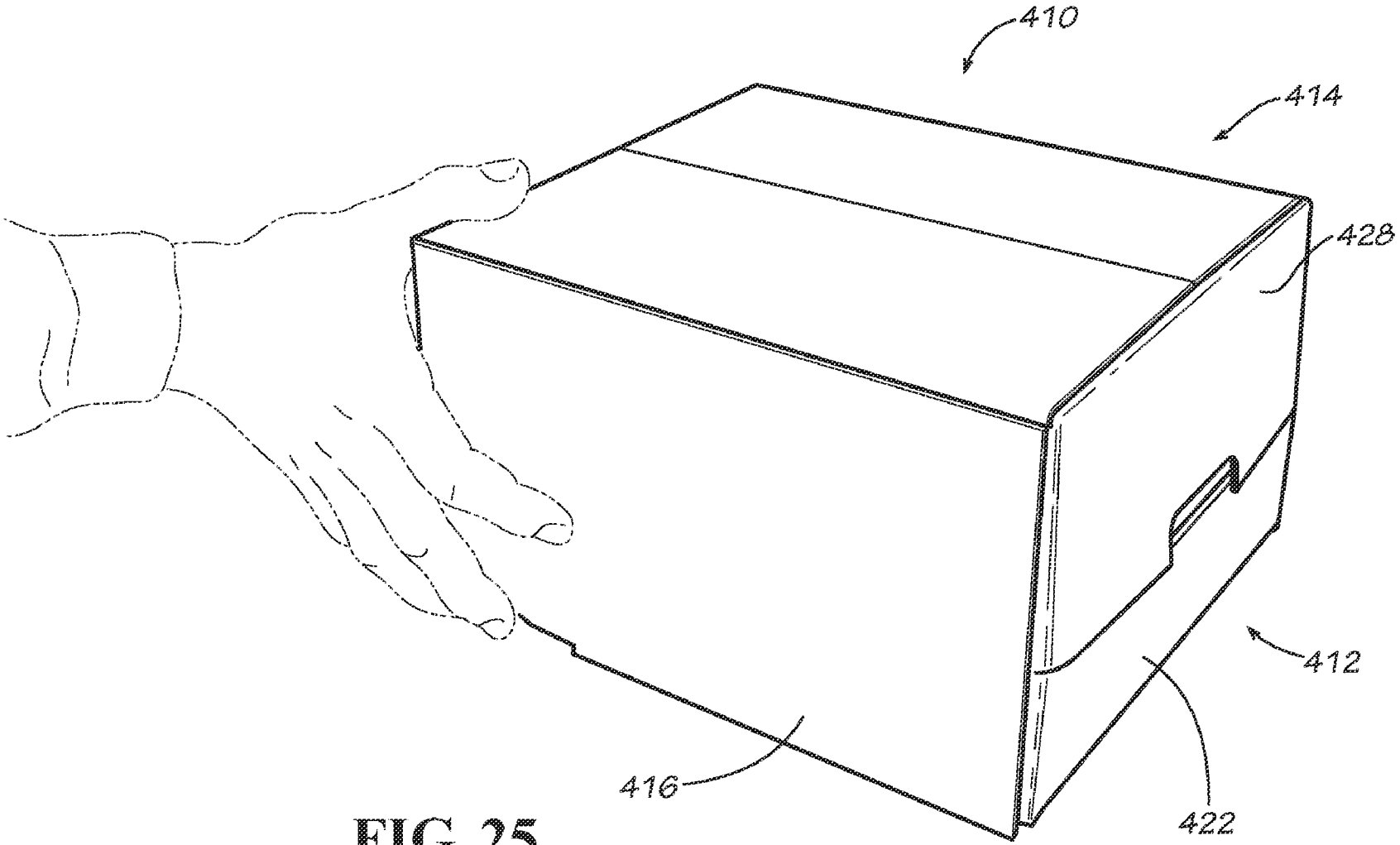
FIG. 25 is a perspective view of a shipper display system according to one embodiment of the invention, shown in the shipping configuration.
Figure 26:
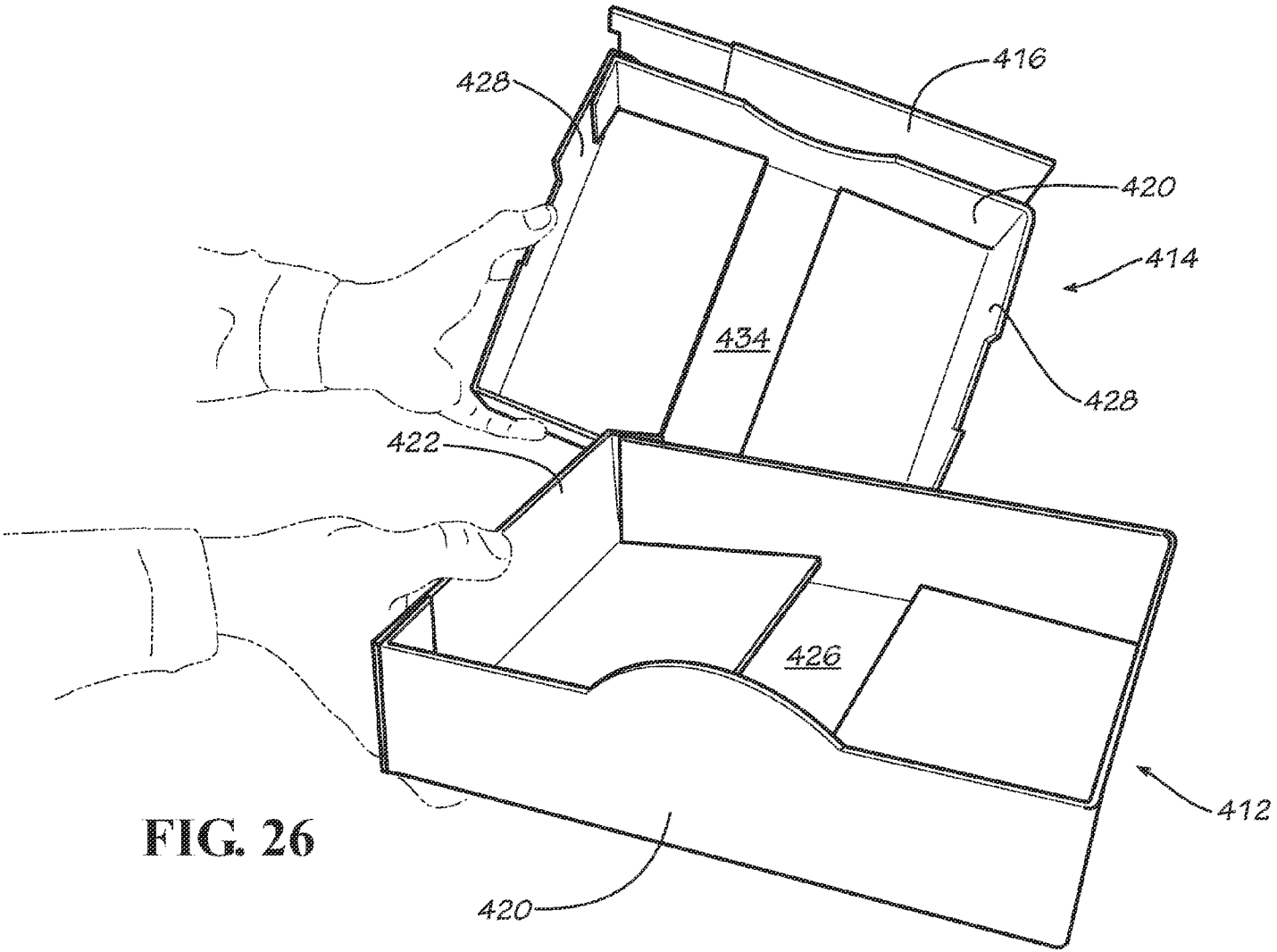
FIG. 26 is a perspective views of the shipper display system of FIG. 25 as it is being converted from the shipping configuration to the display configuration.
Figure 27:
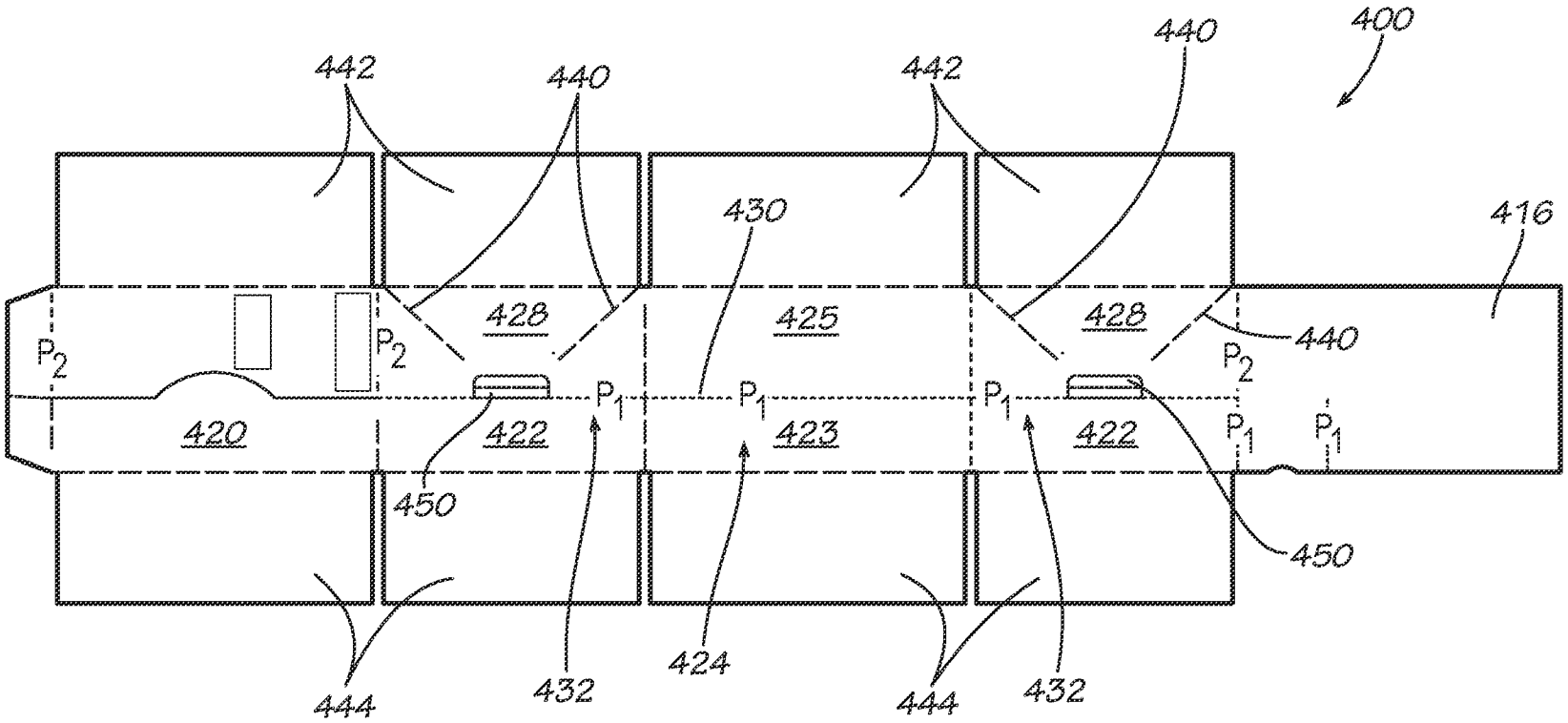
FIG. 27 is a top plan view of the blank from which the shipper display system of FIG. 25 is formed.
Figure 28:
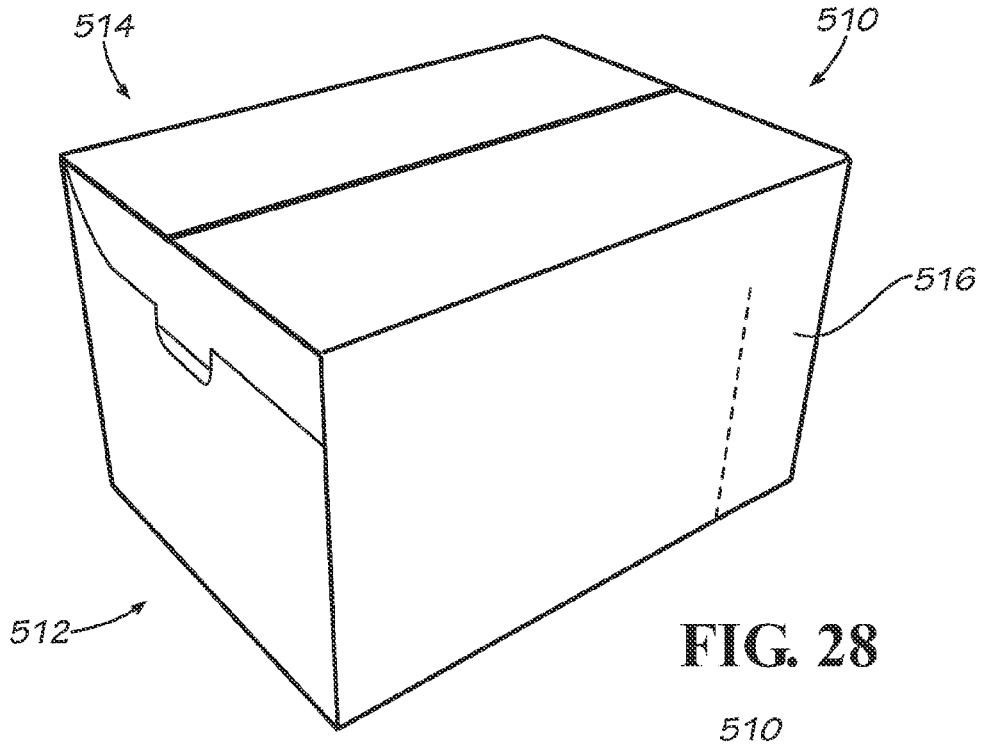
FIG. 28 is a perspective view of a shipper display system according to one embodiment of the invention, shown in the shipping configuration.
Figure 29:
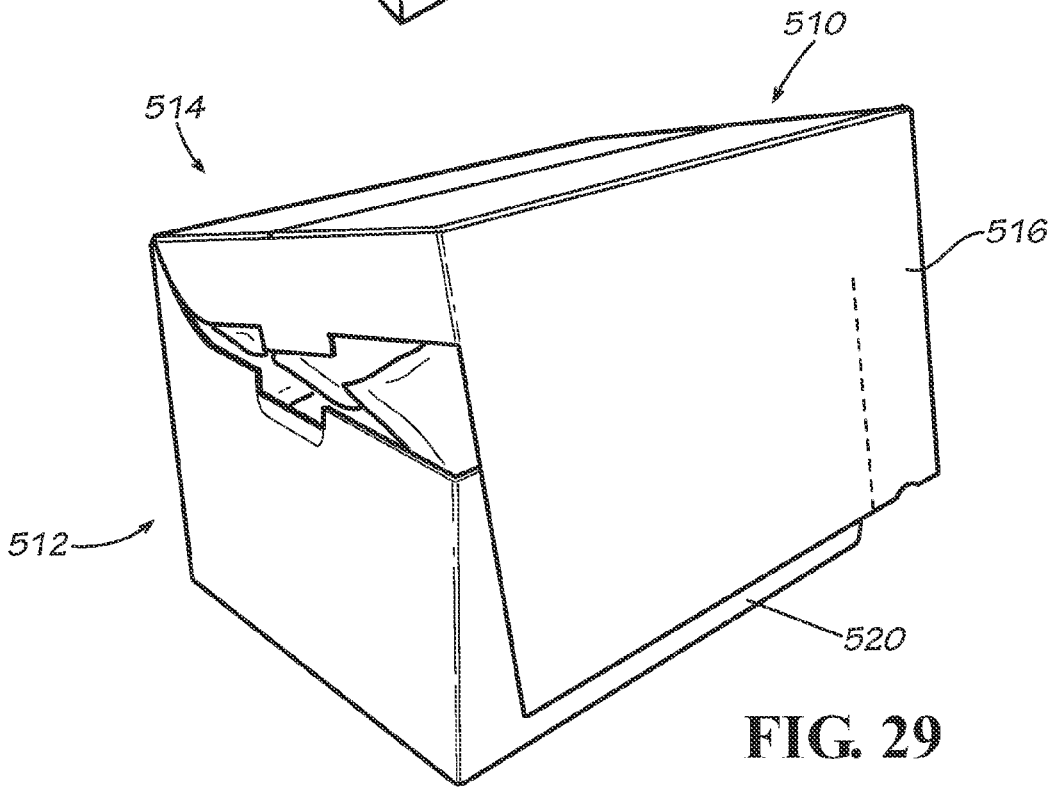
FIGS. 29-30 are various perspective views of the shipper display system of FIG. 28 as it is being converted from the shipping configuration to the display configuration.

FIGS. 25-27 illustrate another embodiment of the invention. Shipper display 410 illustrated in FIGS. 25-26 is similar to the embodiments described and has many of the same features and benefits as shipper displays 10 and 110 detailed above, except, as shown in FIG. 26, the configuration of shipper display 410 is such that, after shipper display 410 has been converted from its shipping configuration to its display configuration, tray portion 412 is lower in height in the rear and side dimensions than, for example, the tray portion 12 of shipper display 10.

Like shipper display 10, shipper display 410 includes a tray portion 412, a hood portion 414, and a reinforcement panel 416. Shipper display 410 may be formed from a single blank 400, shown in FIG. 27. Blank 400 includes side panels 432, each side panel 432 having a zone of weakness 430 that separates the side panel 432 into a lower side panel 422 and an upper side panel 428. Instead of having a zone of weakness that extends in a generally diagonal direction across the side panels 432, however, blank 400 includes a relatively horizontal zone of weakness 430 that extends partially around the perimeter of the tray portion 412. This zone of weakness 430 also serves to separate rear panel 424 into an upper rear panel 425 (which is part of the hood portion 414 of the formed shipper display 410) and a lower rear panel 423 (which is part of the tray portion 412 of the formed shipper display 410). Lines of perforation or scores 440, as well as cutouts 450, in the side panels 432 facilitate removal of the hood portion 414 from the tray portion 412 when the shipper display 410 is converted from its shipping configuration (FIG. 25) to its display configuration (FIG. 26).

Bottom flaps 444 form bottom panel 426 of the tray portion 412 of the formed shipper display, and top flaps 442 form top panel 434 of the hood portion 414 of the formed shipper display. Shipper display 410 may be formed in a similar manner to shipper displays 10 and 110 described above. Reinforcement panel 416 of shipper display 410 functions in a similar manner to reinforcement panel 16 of shipper display 10, in that it protects tray front panel 420 in the shipping configuration and provides strength and support to the shipper display 410.

Figure 30:
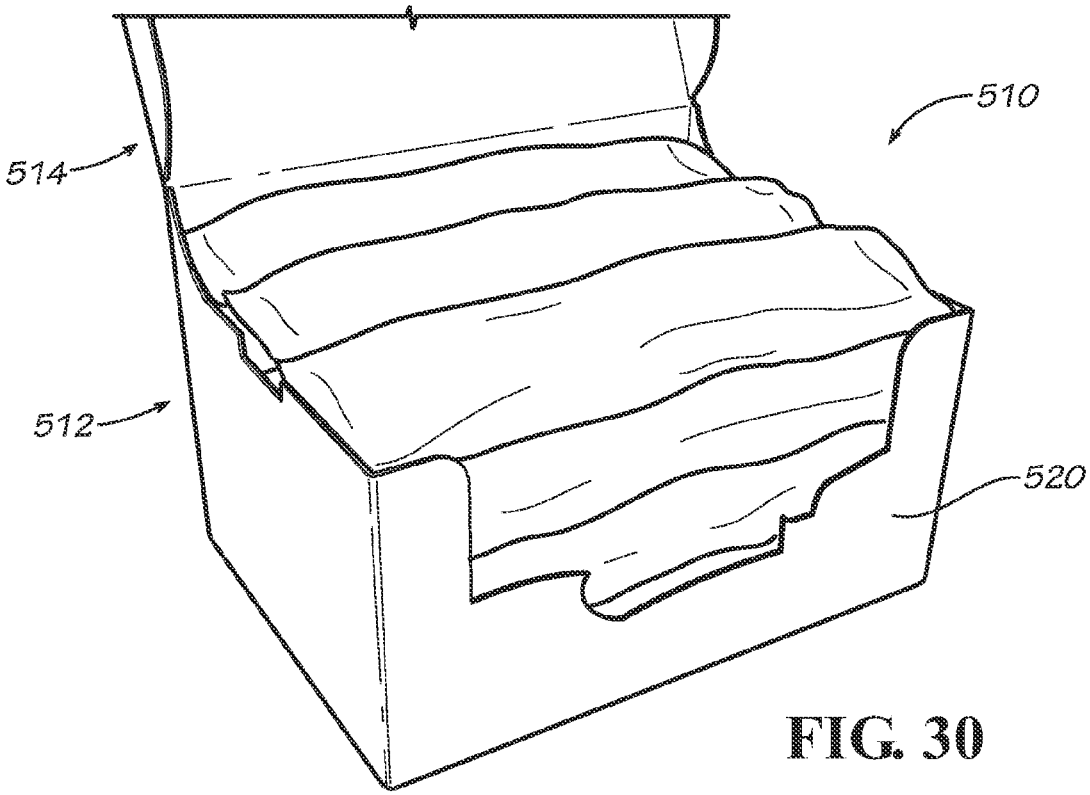
Figure 31:
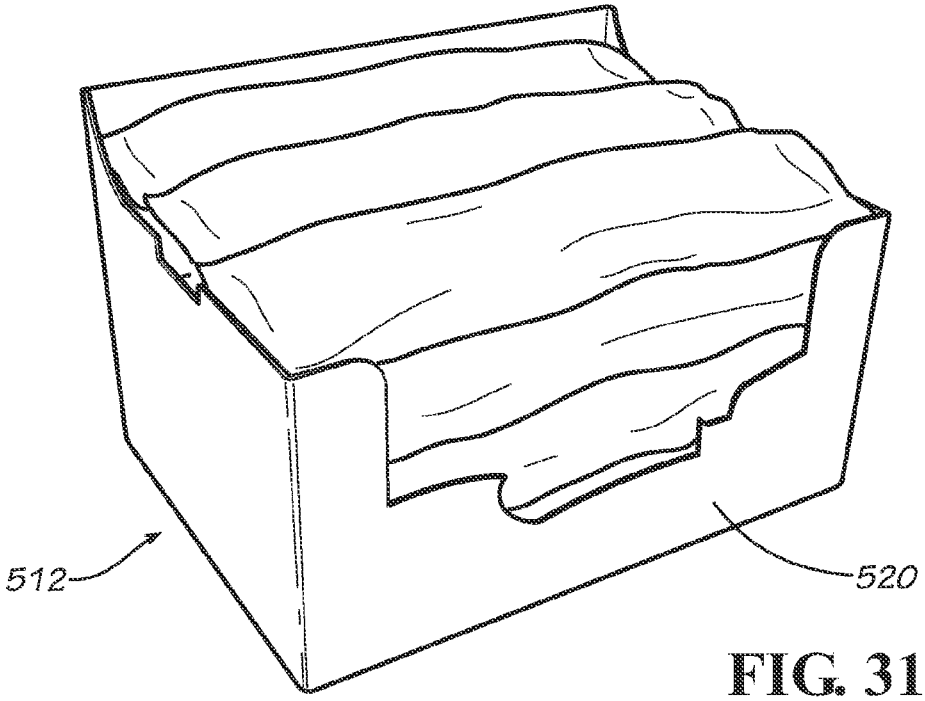
FIG. 31 is a perspective view of the shipper display system of FIG. 28, shown in the display configuration.
Figure 32:
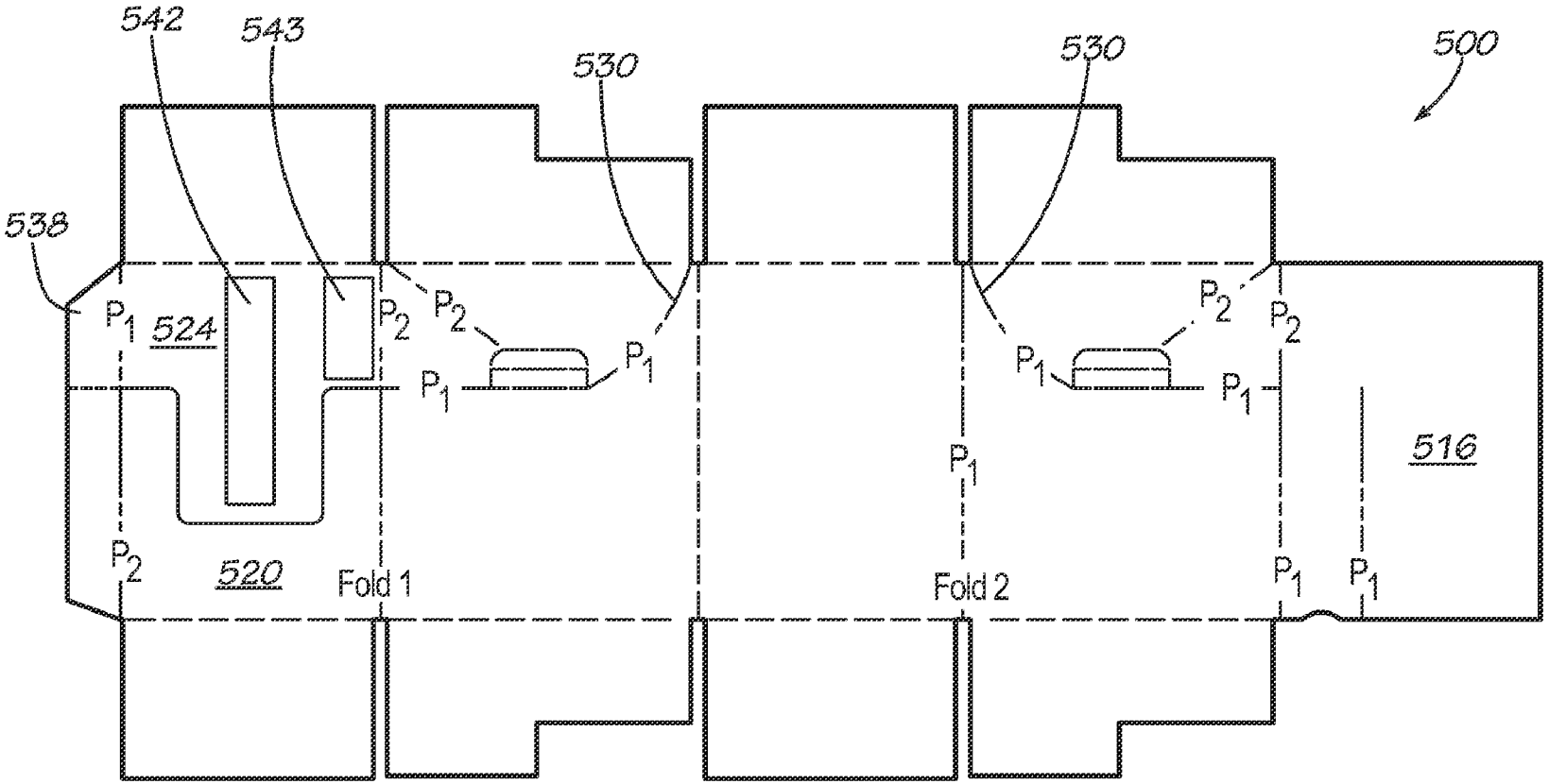
FIG. 32 is a top plan view of the blank from which the shipper display system of FIG. 28 is formed.

FIGS. 28-32 illustrate yet another embodiment of the invention. Shipper display 510 illustrated in FIGS. 28-32 is similar to the embodiments described and has many of the same features and benefits as shipper displays 10 and 110 detailed above, for example, except its dimensions, as well as the configuration and positioning of the zones of weakness 530 and the configuration of the front display panel 520, are particularly well suited for thin products. FIG. 32 illustrates the blank 500 used to form shipper display 510. Once the shipper display 510 is separated along the zones of weakness 530 into a tray portion 512 and a hood portion 514, the tray front panel 520, which may have graphics or other advertising materials, is visible to consumers. As shown in FIGS. 32 and 30-31, tray front panel 520 is dimensioned so it is particularly well suited to display flatter, thin products. The dimensions of tray front panel 520 may be further adjusted based on the dimensions of the particular product housed inside tray portion 512 so that the product is visible and easily accessible to consumers. As with the other embodiments described above, reinforcement panel 516 protects the tray front panel 520 during shipment while shipper display 510 is in the shipping configuration (FIG. 28), and provides strength and support to shipper display 510. Blank 500 may include many of the same features of the blanks described above, such as glue areas 542 and 543, and glue panel 538, to glue reinforcement panel 516 to hood rear panel 524.

FIGS. 33-38 illustrate another embodiment of the current invention. Shipper display 610 illustrated in FIGS. 33-38 is similar to the embodiments described and has many of the same features and benefits as shipper displays 10 and 110 detailed above. For example, like the embodiments described above, shipper display 610 includes a tray portion 612, a hood portion 614, and a reinforcement panel 616. Also like the embodiments described above and as shown in FIG. 38, shipper display 610 includes a tray front panel 620 (part of tray portion 612 of formed shipper display 610), a top panel 634 (part of hood portion 614 of formed shipper display 610), side panels 632, and top flaps 642. Each side panel 632 includes a zone of weakness 630 that separates side panel 632 into an upper side panel 628 and a lower side panel 622. Blank 600 also includes flap 640, as well as bottom flaps 644 that each include a zone of weakness 608 that separates bottom flap 644 into an upper bottom flap 646 and a lower bottom flap 648.

Figure 38:
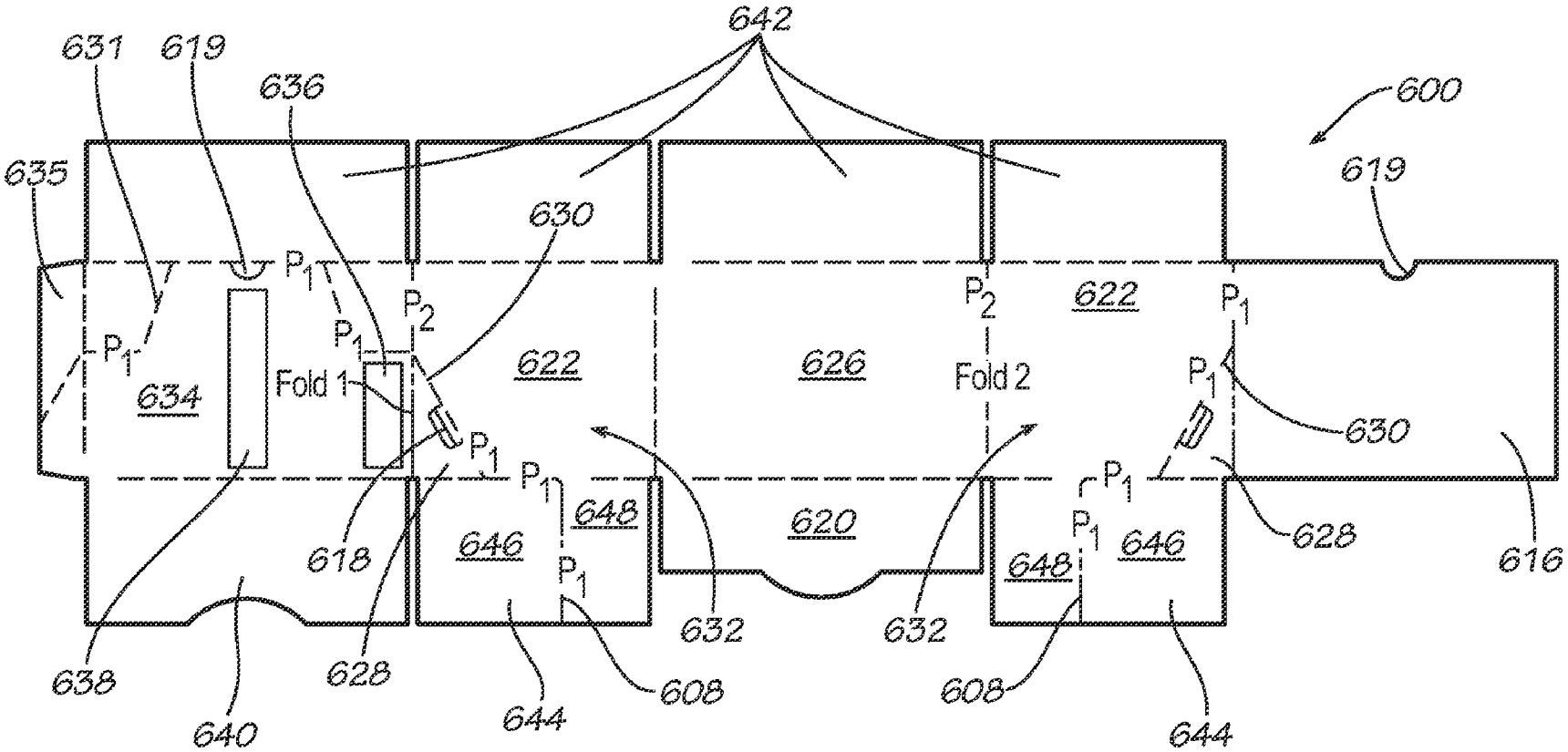
FIG. 38 is a top plan view of the blank from which the shipper display system of FIG. 33 is formed.

Like other embodiments, top panel 634 may include one or more glue areas, such as glue areas 636 and 638, to attach top panel 634 to reinforcement panel 616. Glue areas may be located anywhere along hood top panel 634 or reinforcement panel 616. Blank 600 may also include glue panel 635 to secure top panel 634 to side panel 632. Glue panel 635 may be located adjacent to top panel 634 or reinforcement panel 616. Glue panel 635 may also include a perforation line 631 to facilitate separation of the hood portion 614 from tray portion 612 of formed shipper display 610. During shipment, perforation line 631 prevents premature separation of the shipper display 610. The embodiment shown in FIGS. 33-36 shows reinforcement panel 616 being positioned so that it is interior to top panel 634, although in other embodiments, reinforcement panel 616 may be positioned so that it is exterior to top panel 634 (FIG. 38).

Flap 640, bottom flaps 644, and tray front panel 620 fold together to form a floor panel against which product can be loaded when the shipper display 610 is in the first orientation. Tray front panel 620 is folded so that it is interior to flaps 644, so that flaps 644 protect tray front panel 620 (and any graphics included thereon) during shipment. As with other embodiments, tray front panel 620 may be of any desired configuration, and various patterns may optionally be die cut into tray front panel 620.

Shipper display 610 is configured so that it is loaded with product at a first orientation (FIG. 33) and then rotated 90° to a second orientation (FIG. 34) to orient the shipper display for conversion from its shipping configuration to its display configuration.

Figure 33:
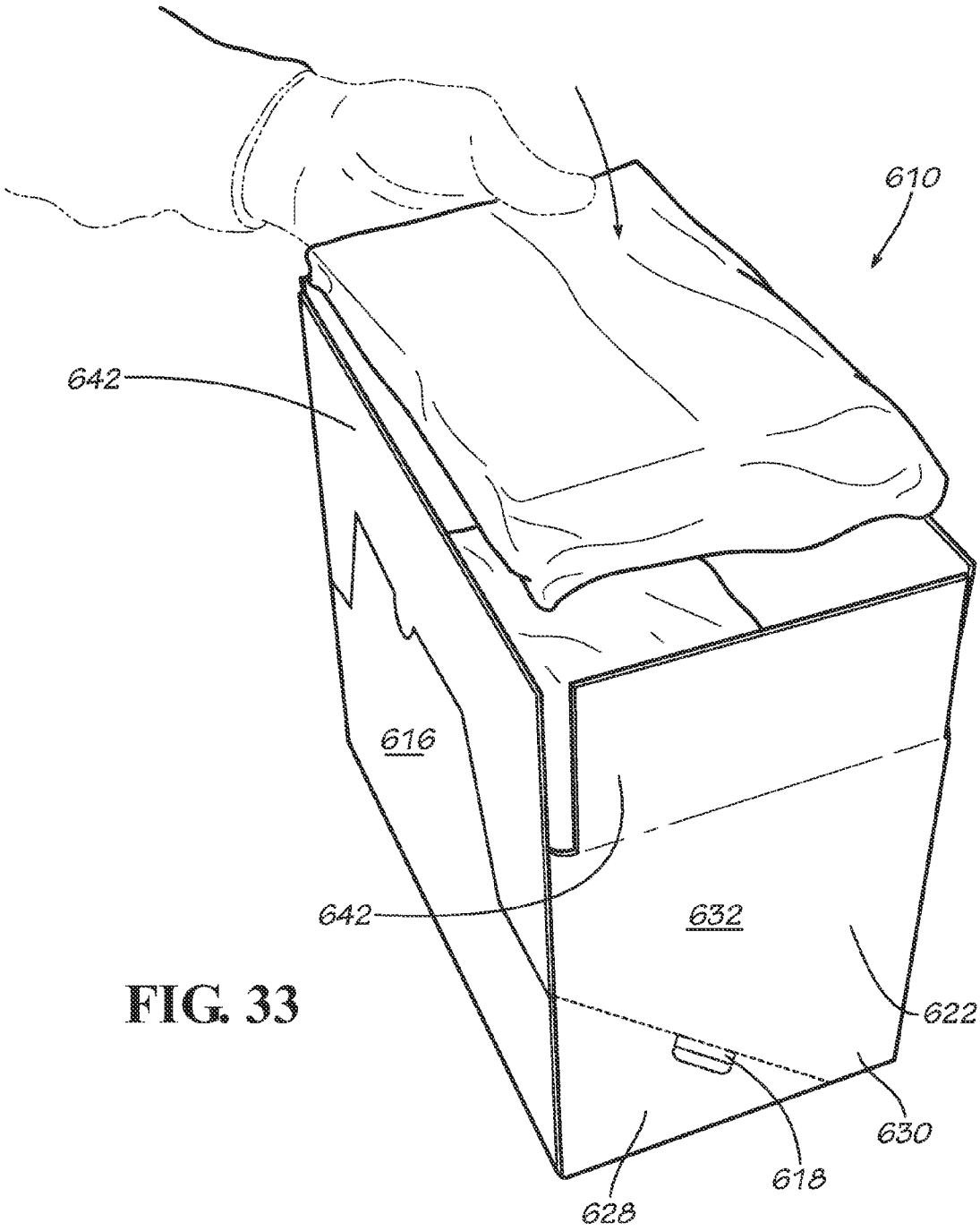
FIG. 33 is a perspective view of a shipper display system according to one embodiment of the invention, shown in the shipping configuration.
Figure 34:
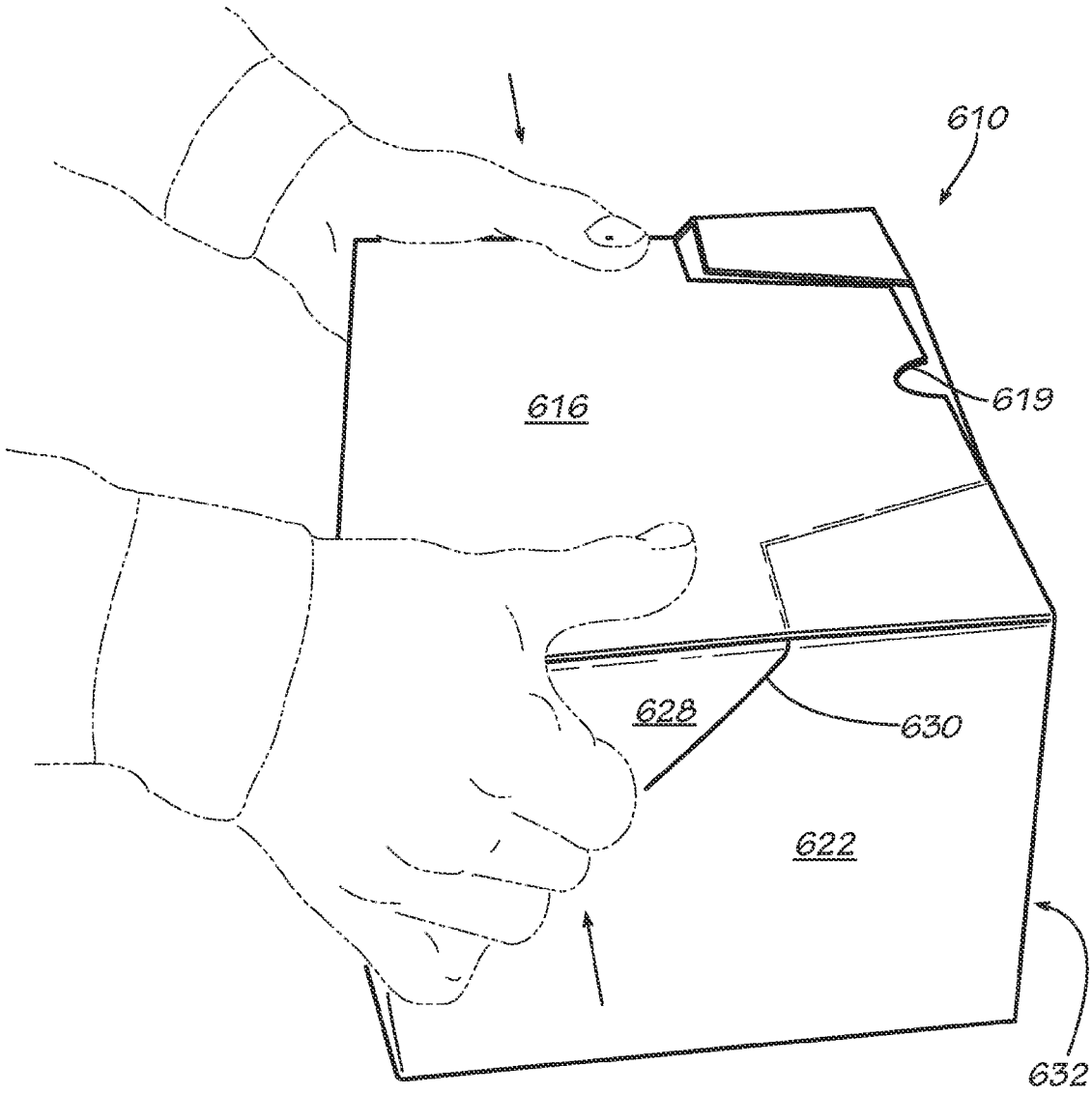
FIGS. 34-36 are various perspective views of the shipper display system of FIG. 33 as it is being converted from the shipping configuration to the display configuration.
Figure 35:
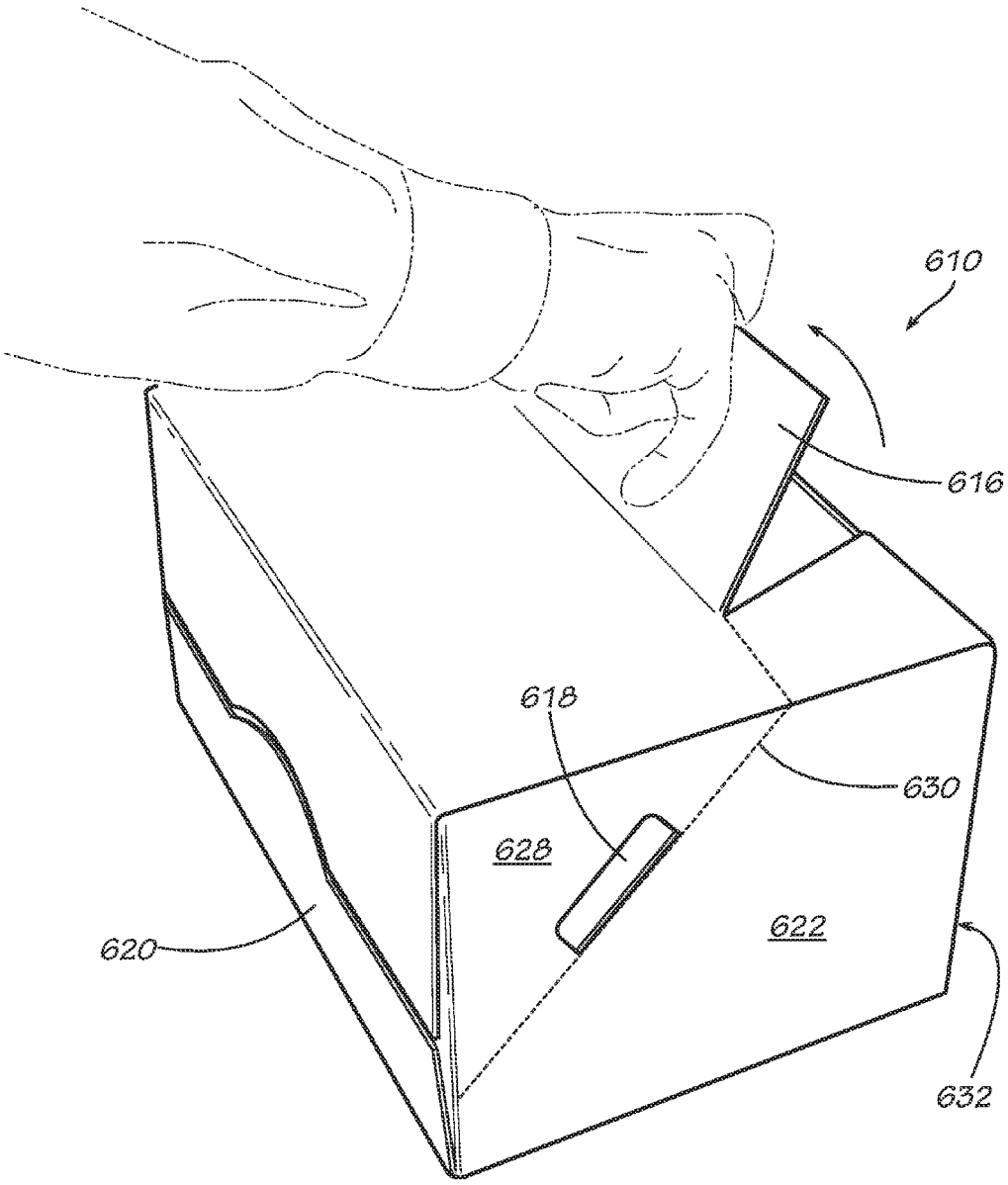
Figure 36:
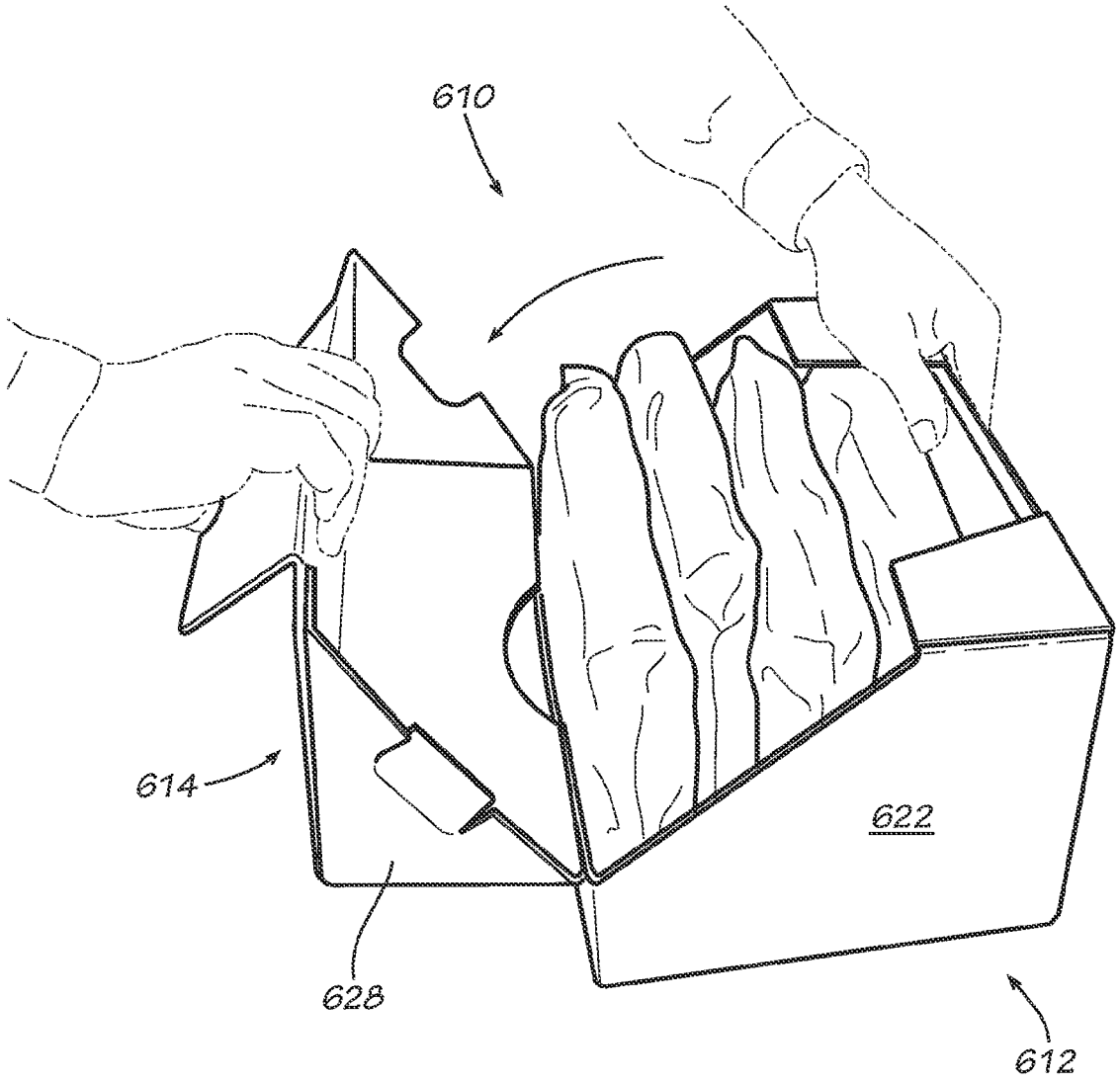
Figure 37:
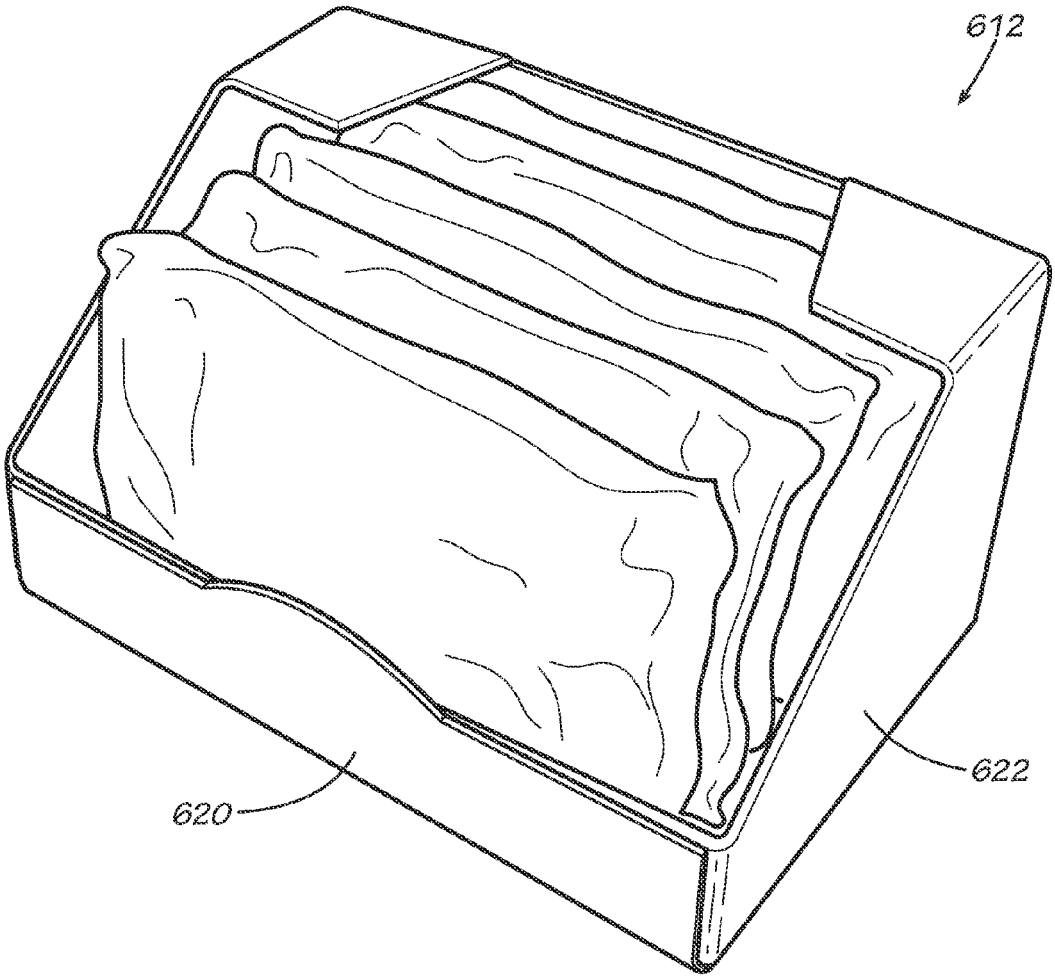
FIG. 37 is a perspective view of the shipper display system of FIG. 33, shown in the display configuration.

As shown in FIG. 33, in some embodiments, shipper display 610 may be top loaded, which accommodates customers having equipment only capable of top loading product into the shipper display. In particular, shipper display 610 can be oriented to its first position so it rests its floor panel (which is comprised of folded flap 640, bottom flaps 644, and front tray panel 620). As shown in FIG. 34, shipper display 610 is rotated 90° to its second orientation so that reinforcement panel 616 (which is secured to top panel 634) is oriented as the top of the shipper display and so that side panels 632 are oriented as the sides of the shipper display 610 and so that bottom panel 626 is oriented as the bottom of the shipper display and the product rests on bottom panel 626 in the second orientation. What was floor panel in the first orientation (folded flap 640, bottom flaps 644, and front tray panel 620) becomes the front of the shipper display 610 in the second orientation. Like the other embodiments described, reinforcement panel 616 provides strength to shipper display 610, although in certain embodiments, reinforcement panel 616 does not protect tray front panel 620 during shipment. Instead flap 640 and bottom flaps 644 may be folded around tray front panel 620 to protect it during shipment.

When pressure is applied along the zones of weakness 630 on side panels 632, as facilitated by optional cutouts 618, the zones of weakness 630 are broken and the side panels 632 separates. As pressure is applied and reinforcement panel 616 is lifted (FIG. 35), zone of weakness 631 and zones of weakness 608 also break to separate bottom flaps 644 into upper bottom flaps 646 (part of hood portion 614) and lower bottom flaps 648 (part of tray portion 612). Upper bottom flaps 646 can then be removed along with the rest of the hood portion 614 and reinforcement panel 616. Top panel 634 and/or reinforcement panel 616 may optionally include a cutout 619 to facilitate lifting and removal of hood portion 614.

Figure 39:
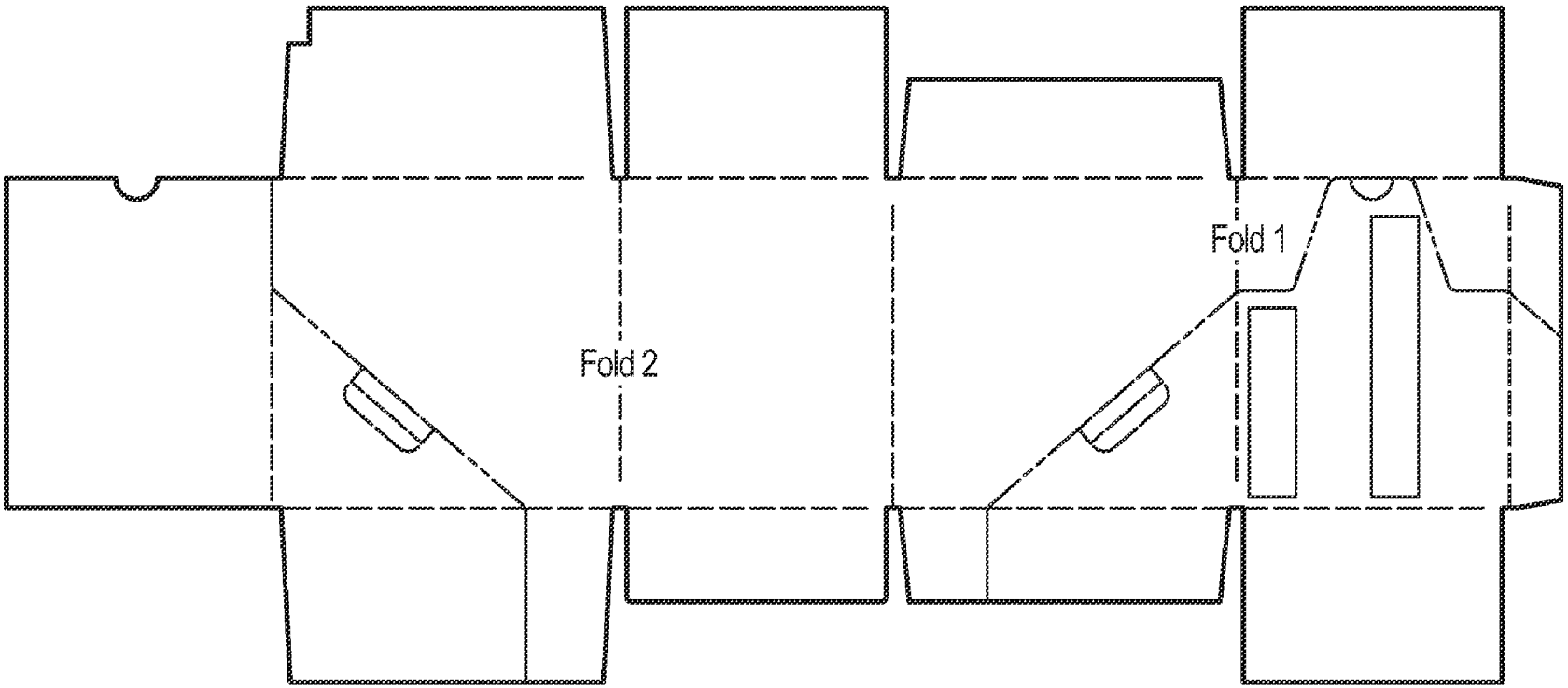
FIGS. 39-40 are top plan views of blanks from which shipper display systems are formed according to alternate embodiments of the invention.
Figure 40:
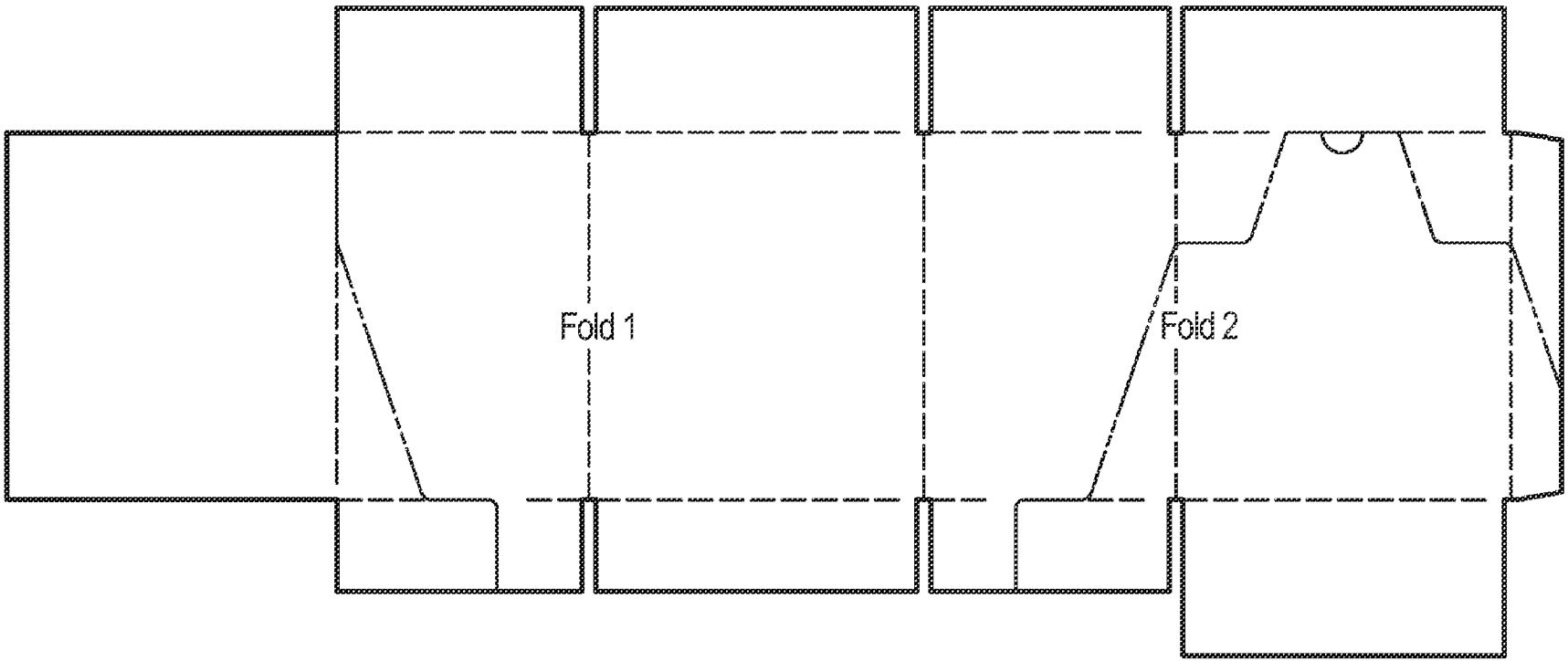

FIGS. 39-40 illustrate alternate blanks 601 and 602, which are similar to blank 600, but have variations in the configurations, positioning, and placement of various flaps, panels, and zones of weakness.

FIGS. 41-47 illustrate yet another embodiment of the invention. Shipper display 710 illustrated in FIGS. 41-47 is similar to the embodiments described and has many of the same features and benefits as shipper displays 10 and 110 detailed above. Shipper display 710 is configured, however, so that it can be used with standard packing equipment that side loads the shipper display 710 with product, as illustrated manually in FIG. 41. Like the other embodiments described above, shipper display 710 includes a tray portion 712, hood portion 714, and a reinforcement panel 716. As with the other embodiments described above, the hood portion 714 and the reinforcement panel 716 are configured so that they may be separated from the tray portion 712 when the shipper display is converted from a shipping configuration into a display configuration.

Figure 47:
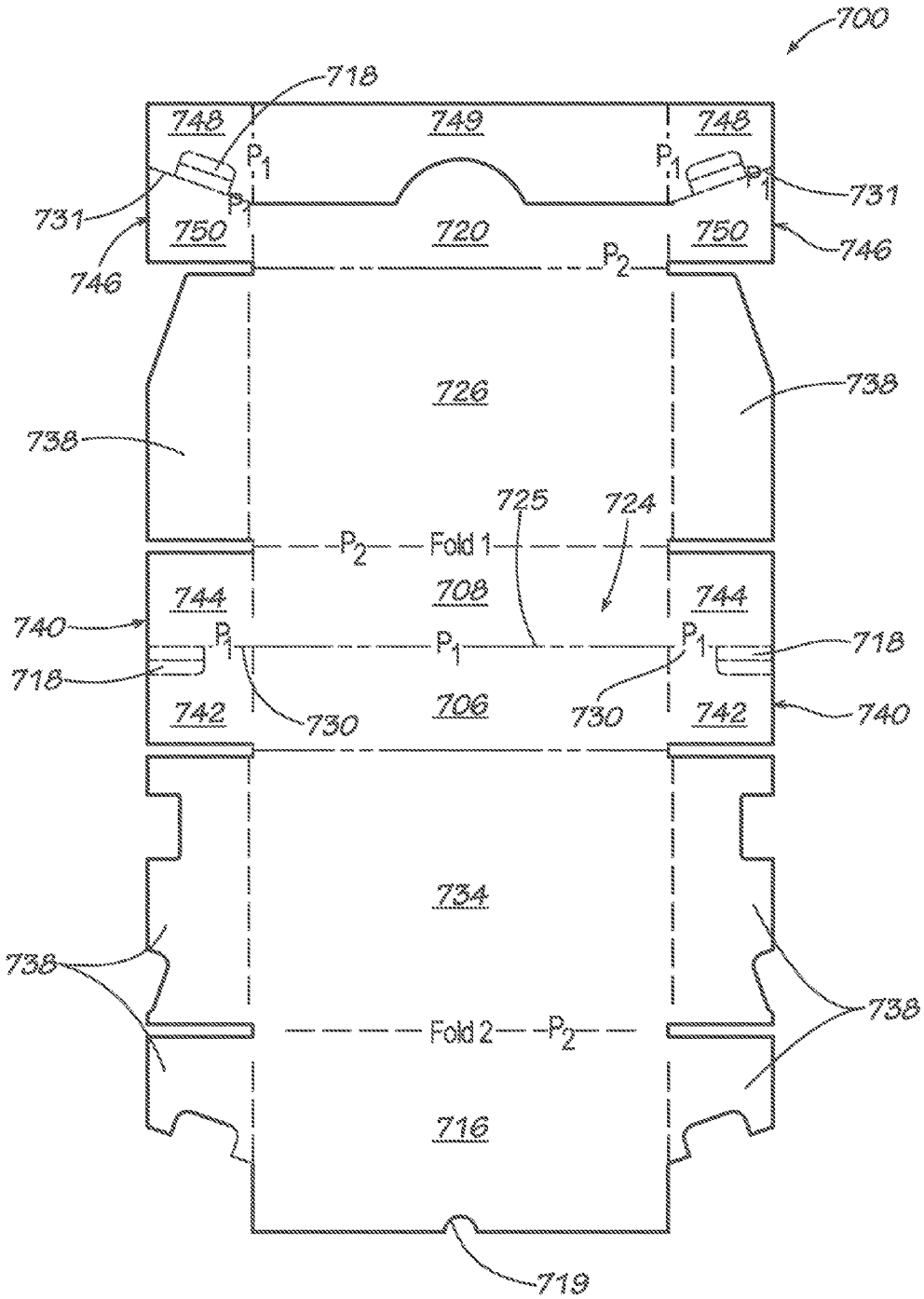
FIG. 47 is a top plan view of the blank from which the shipper display system of FIG. 41 is formed.

Shipper display 710 may be formed from a single blank 700 shown in FIG. 47. As shown in FIG. 47, shipper display 710 also includes a tray front panel 720, a bottom panel 726 (which is part of tray portion 712 of formed shipper display 710), and a top panel 734 (which is part of hood portion 714 of formed shipper display 710). Shipper display 700 also includes a rear panel 724 having a perforation line 725 that separates rear panel 724 into upper rear panel 706 and lower rear panel 708.

Blank 700 also includes flaps 738 that fold together to form the sides of formed display 710. Middle flaps 740 each include a zone of weakness 730 that separates middle flap 740 into an upper middle flap 742 and a lower middle flap 744. Similarly, front flaps 746 each include a zone of weakness 731 that separates front flap 746 into an upper front flat 748 and a lower front flap 750. Blank 700 may further include glue panel 749 that attaches to reinforcement panel 716. In some embodiments, one or both of upper front flaps 748 may also include glue areas (not shown). In other embodiments, reinforcement panel 716 instead includes a glue area to attach the panel to panel 749 and/or upper front flaps 748. As with the other embodiments, zone of weaknesses 730 and/or 731 may cooperate with one or more cutouts 718 to facilitate separate of the tray portion 712 from the hood portion 714.

Figure 41:
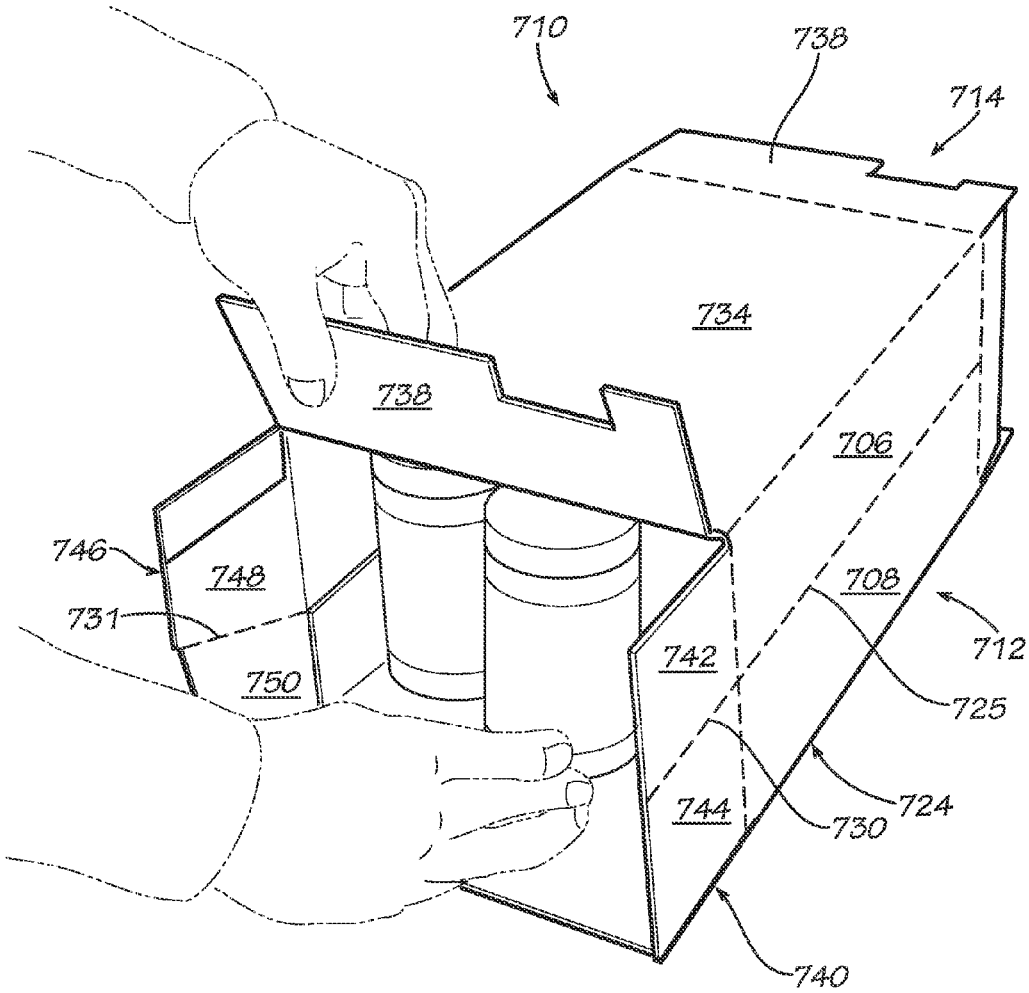
FIG. 41 is a perspective view of a shipper display system according to one embodiment of the invention, shown as the shipper display is being loaded with product in the shipping configuration.
Figure 42:
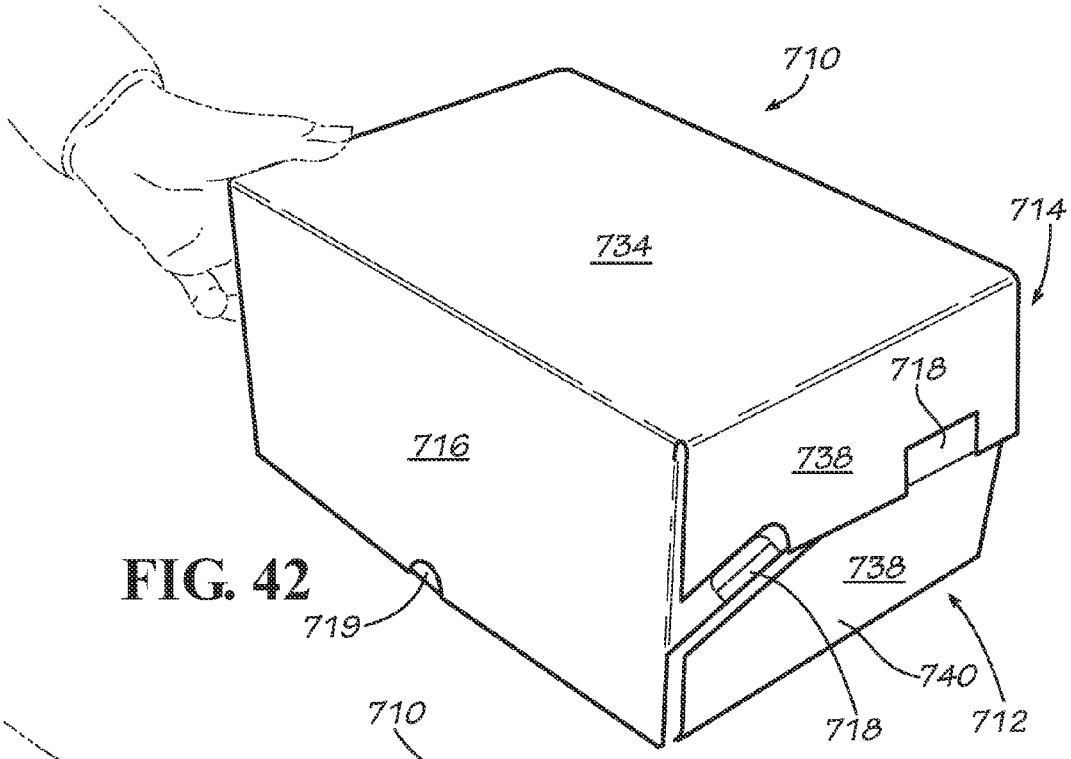
FIGS. 42-45 are various perspective views of the shipper display system of FIG. 41 as it is being converted from the shipping configuration to the display configuration.
Figure 43:
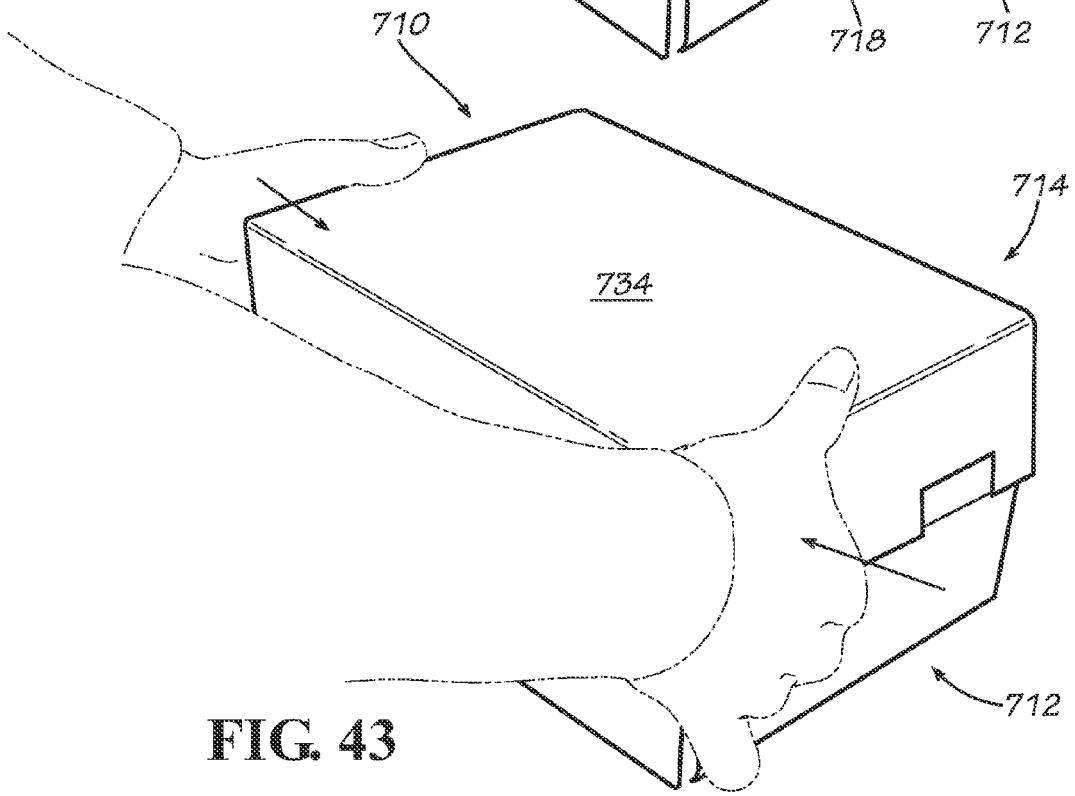

As shown in FIG. 41, shipper display 710 may be side loaded with product when in the shipping configuration, and the various flaps folded together and sealed. In some embodiments, shipper display 710 is shipped to a customer partially assembled and glued and ready for the customer to pack the shipper display 710 with product and finish gluing the various side flaps together. As with the other embodiments described above, when in the shipping configuration, reinforcement panel 716 provides strength to the shipper display 710 and protects front panel 720.

Figure 44:
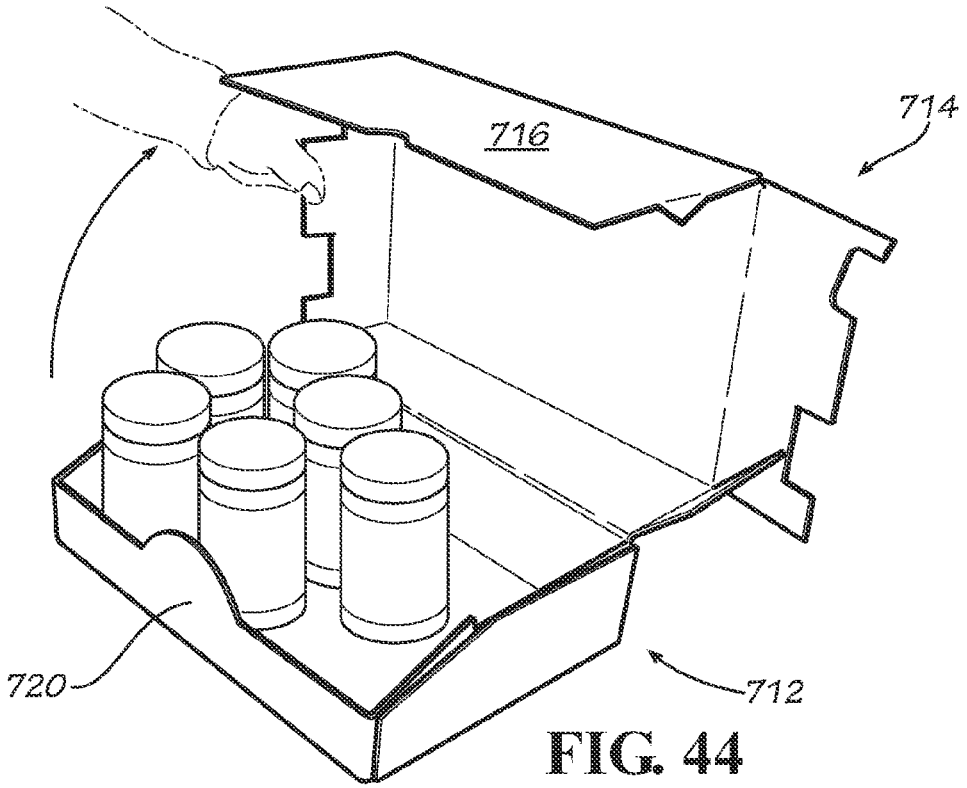
Figure 45:
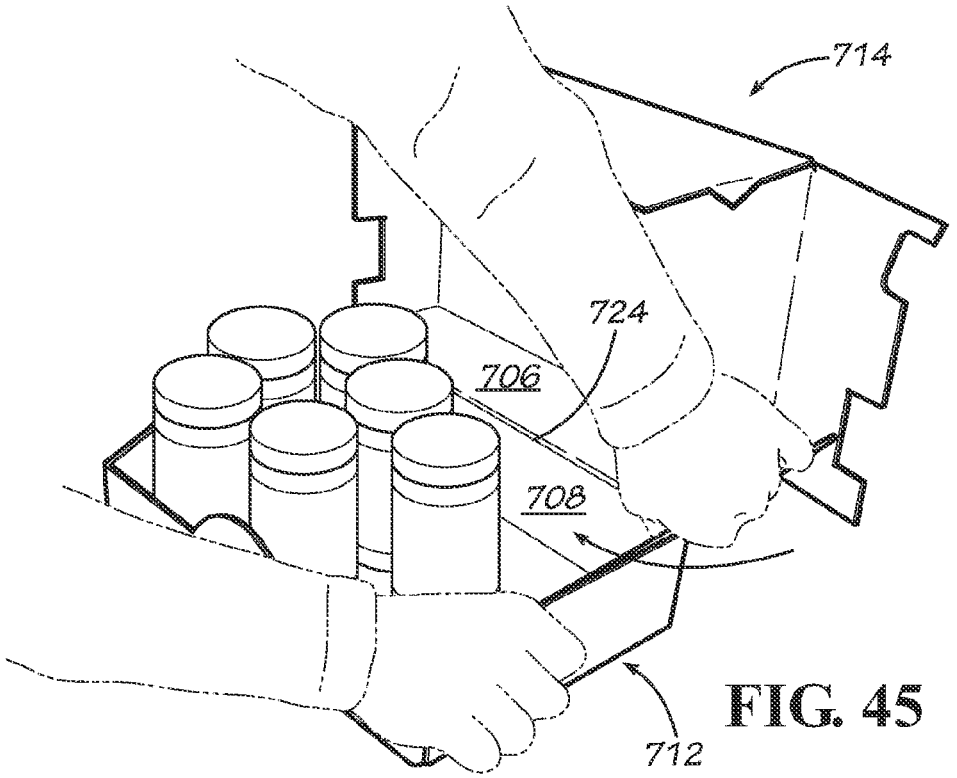
Figure 46:
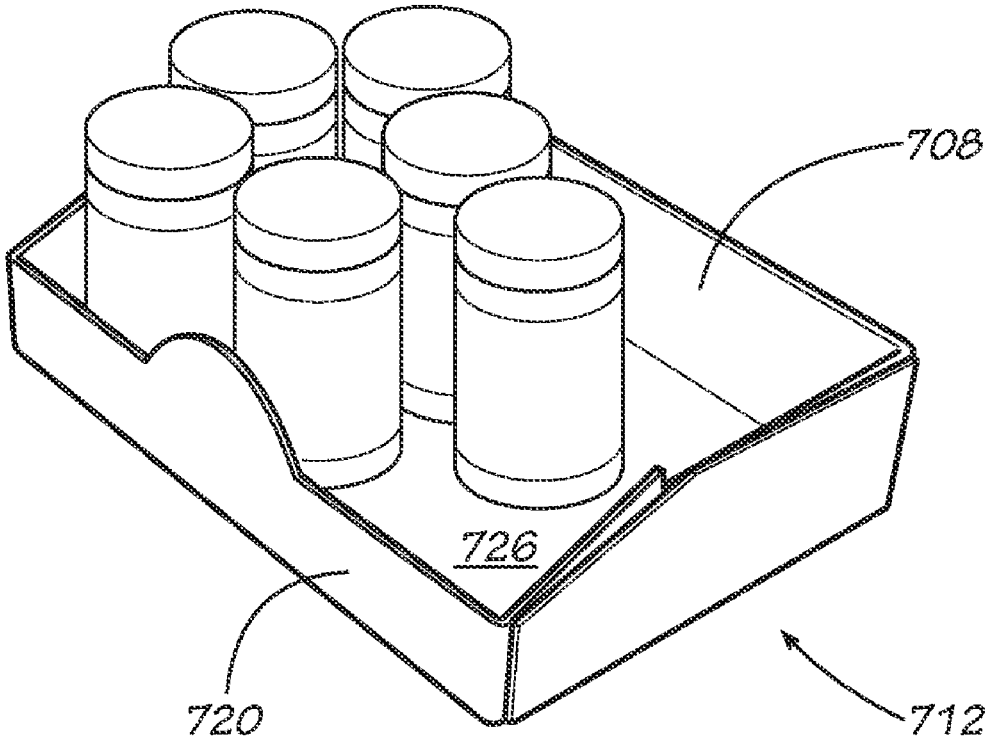
FIG. 46 is a perspective view of the shipper display system of FIG. 41, shown in the display configuration.

To convert shipper display 710 from its shipping configuration to its display configuration, zones of weakness 730 and 731 are broken to separate middle flaps 740 into upper middle flaps 742 and lower middle flaps 744 and to separate front flaps 746 into upper front flaps 748 and lower front flaps 750. As with other embodiments, optional cutouts 718 may be used to facilitate the separation of tray portion 712 from hood portion 714 and reinforcement panel 716. Once zones of weakness 730 have been broken, hood portion 714 is lifted away from tray portion 712, as shown in FIG. 44. Optionally, cutout 719 may be used to facilitate the removal of hood portion 714 from tray portion 712. As shown in FIG. 45, the rear panel is then torn along perforation line 725 to separate rear panel 724 into upper rear panel 706 and lower real panel 708. In this way, hood portion 714 and reinforcement panel 716 are completely separated from tray portion 712. FIG. 46 illustrates shipper display 710 in its display configuration.

Also disclosed are methods of using standard equipment to create the blanks described above for forming the shelf-ready shipper display system embodiments described above. The configuration of the shipper displays described above is such that the blanks used to form them can be manufactured and formed by conventional machinery standard in the industry. Specifically, because each shipper display is formed from a single blank, the shipper display can be manufactured and formed on standard equipment in one operation, such as on a standard "flexo-folder-gluer" that has the capability to print graphics on the blank, die cut the blank, apply any glue or other adhesive to the blank, and fold and assemble the blank into an erectible shipper display. The manufacturing and forming of the shipper display in a single operation results in both cost and time savings. Although not necessary, this equipment can have specialized cutting dies for customizing the blank to fit specific consumer product specifications. Use of a flexo-folder-gluer is not necessary, and other types of machinery standard in the industry could also be used to form the blanks described above. For example, the shipper display can also be formed on standard equipment in two operations by first using a suitable die cutter (such as a rotary, flat bed, or clam shell die cutter) and then using a standard folder-gluer machine to fold and seal the shipper display.

Figure 9:
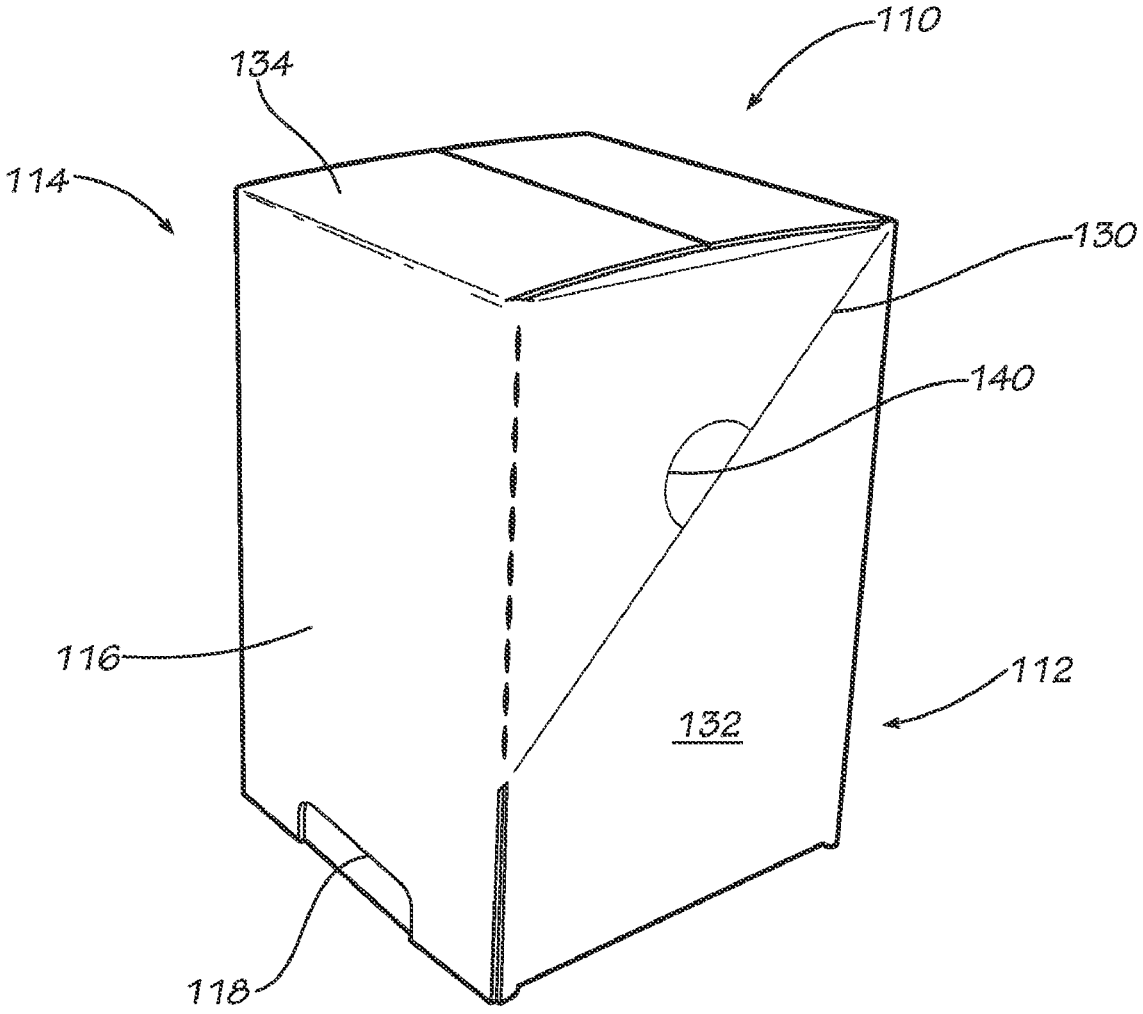
FIG. 9 is a perspective view of the shipper display system according to another embodiment of the invention, shown in the shipping configuration.

In some embodiments, the blank is first printed, glued, folded, and assembled into a partially completed shipper display. In some embodiments, the partially assembled shipper display is then shipped in a knock-down-flat (KDF) position to the supplier of the product to be shipped and displayed. Once the KDF shipper reaches the supplier, the supplier can then erect it into a position ready for filling, fill with product, and then close and seal in the shipping configuration, as shown in FIGS. 1 and 9. The configuration of the shipper display system according to certain embodiments of this invention allows the supplier to fill the shipper display with product using standard case packing machinery. Because the shipper display according to certain embodiments of this invention is capable of running on standard case packing machinery, the supplier can pack the shipper display with product without the use of a third party packer.

Figure 2:
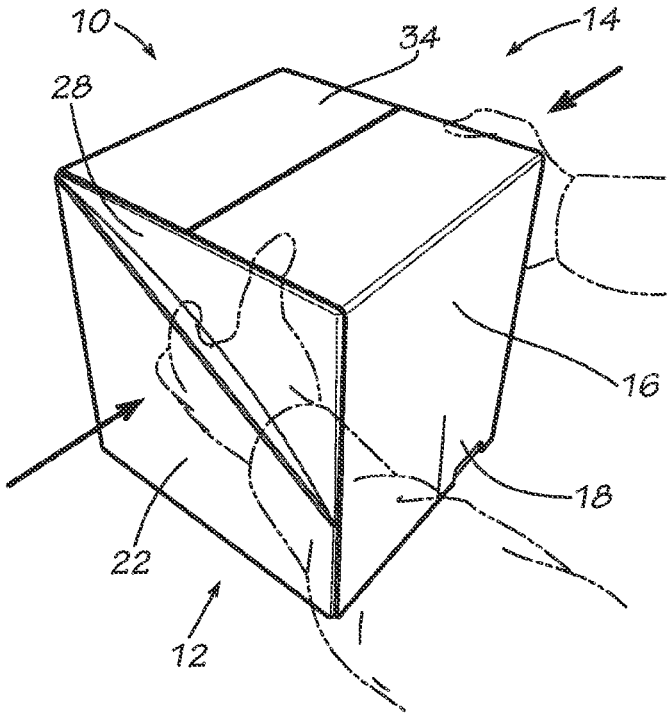
FIGS. 2-6 are various perspective views of the shipper display system of FIG. 1 as it is being converted from the shipping configuration to the display configuration.
Figure 3:
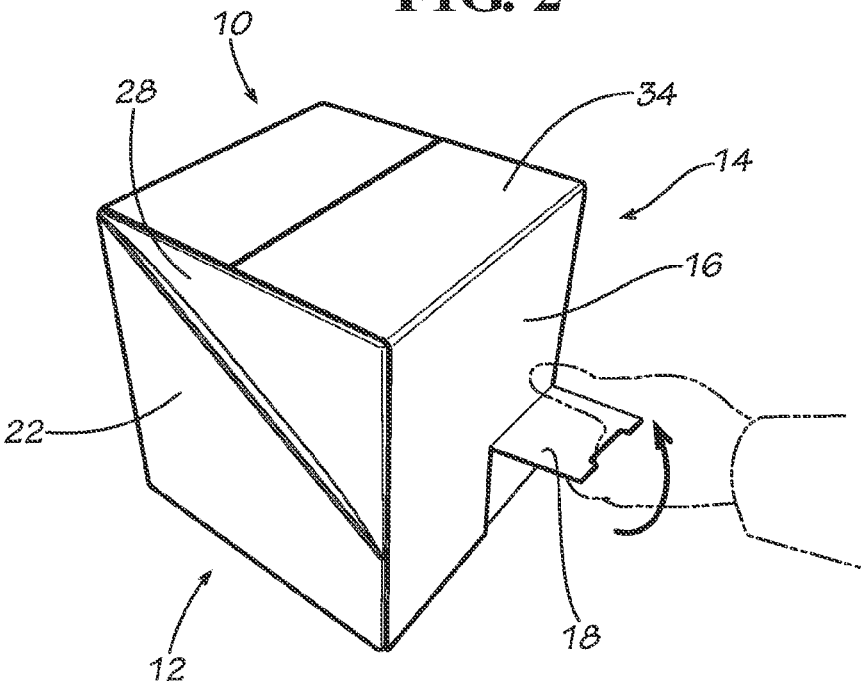
Figure 4:
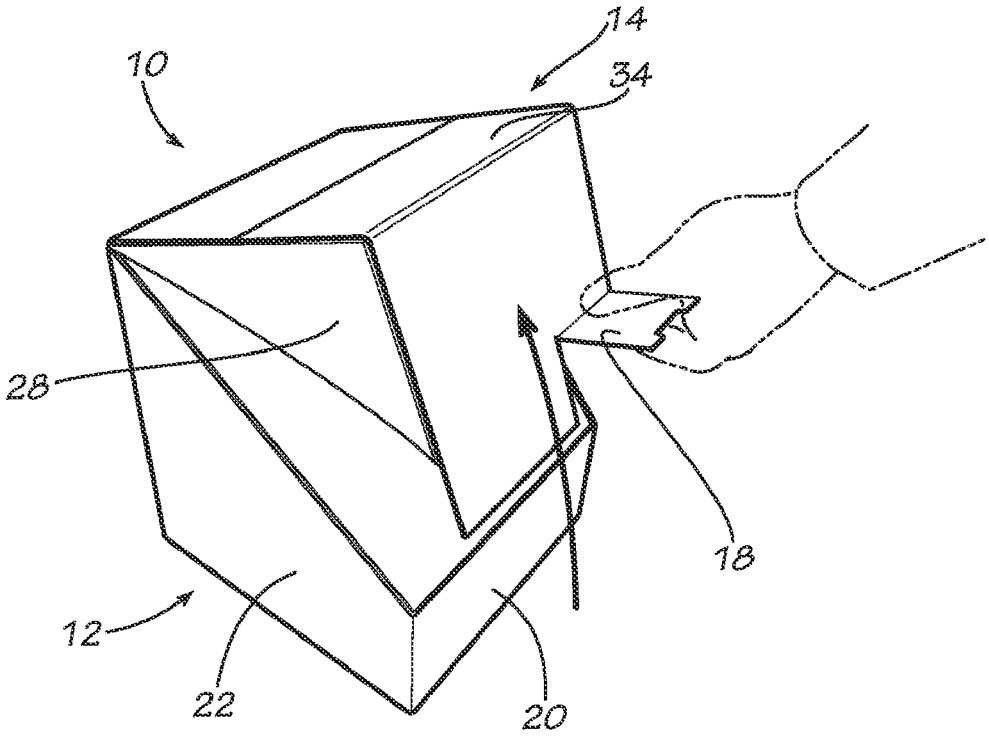

Also disclosed are methods of converting the shipper display system from its shipping configuration into its display configuration. Although many different embodiments have been described above, the methods used to convert the shipper displays from their shipping configurations into their display configurations are similar and only a few selected methods are described in detail for illustrative purposes only. Similar methods may be employed to convert the other embodiments described above. In one method of converting shipper display 10, as shown in FIG. 2, upper side panels 28 of the side panels 32 are pushed in to break the zones of weakness 30. As shown in FIG. 3, tab 18 is then lifted and hood portion 14 is lifted off of tray portion 12. Hood portion 14 can then be disposed. In another embodiment, lower side panels 22 of the side panels 32 are instead pushed in to break the zones of weakness 30 so that hood portion 14 can be removed. Once hood portion 14 is removed, shipper display 10 is in its display configuration and product housed within tray portion 12 is exposed and ready for merchandising, as shown in FIG. 7.

Figure 10:
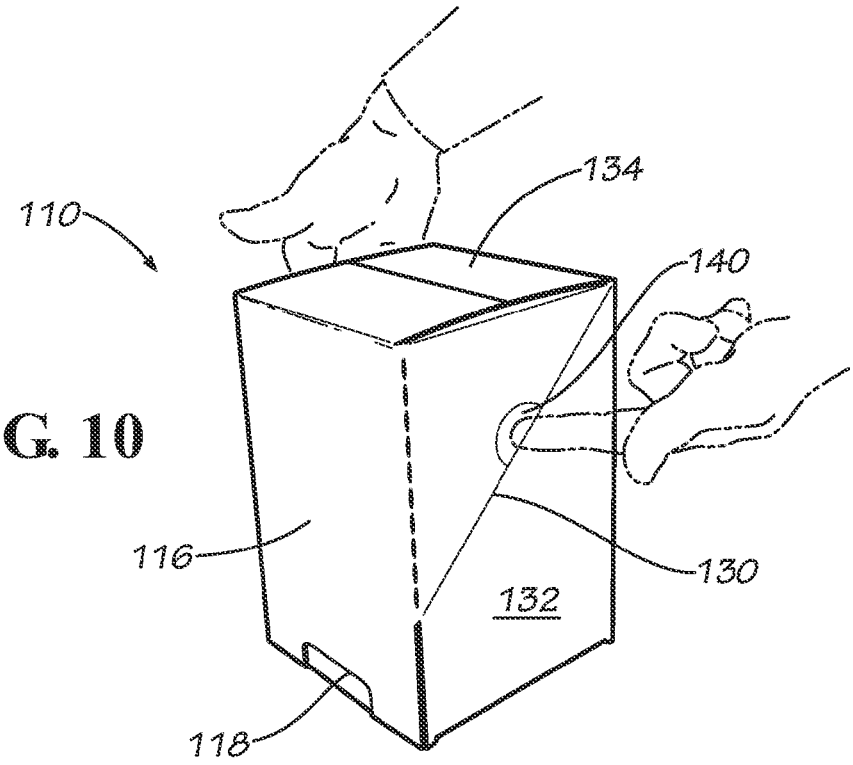
FIGS. 10-14 are various perspective views of the shipper display system of FIG. 9 as it is being converted from the shipping configuration to the display configuration.
Figure 11:
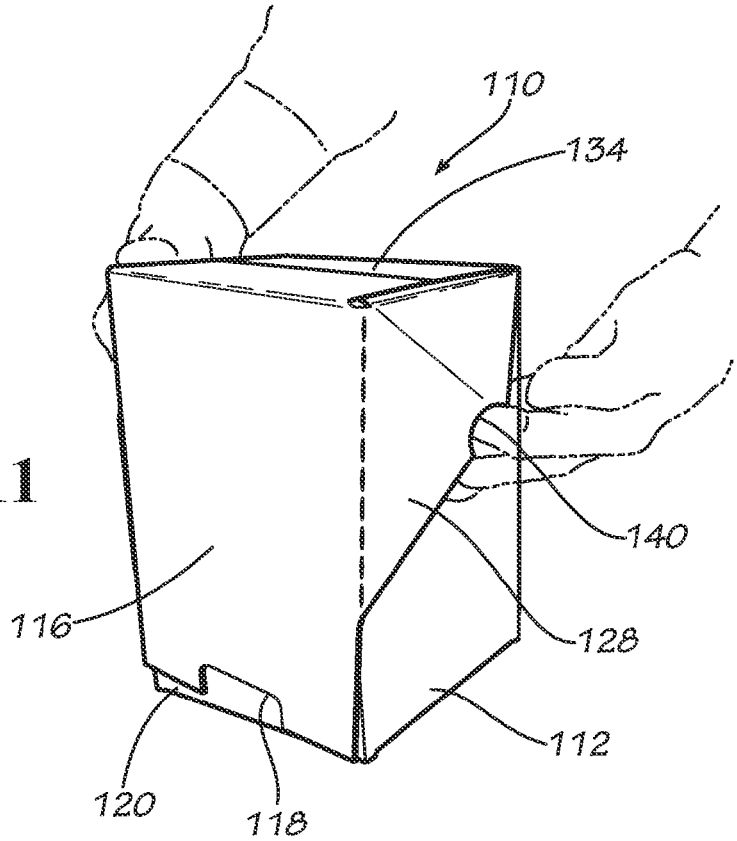

In another embodiment of a method of converting the shipper display 110 from its shipping configuration into its display configuration, as shown in FIGS. 10-11, a user pushes through the cutouts 140 on side panels 132. Cutouts 140 can be located either on lower side panel 122 or upper side panel 128. Preferably, cutouts 140 are located near or along the zone of weakness 130 to help break the zone of weakness 130. As shown in FIG. 11, cutouts 140 can then be used to pull the upper side panel 128 (or lower side panel 122, depending on where cutouts 140 are located) to break the zone of weakness 130 and separate hood portion 114 from tray portion 112. As shown in FIG. 12, reinforcement panel 116 may then be lifted to tear any connecting portions remaining along the corners of the zone of weakness 130. Hood portion 114 is then lifted off of tray portion 112, as shown in FIGS. 13-14. In some embodiments, as shown in FIG. 14, shipper display 110 may include a slot 146 in the reinforcement panel 116 to facilitate removal of hood portion 114 from tray portion 112. Once hood portion 114 is removed, shipper display 110 is in its display configuration and product housed within tray portion 112 is exposed and ready for merchandising, as shown in FIG. 15. Other disclosed shipper displays can be converted from a shipping configuration to a display configuration using similar techniques.

Figure 52:
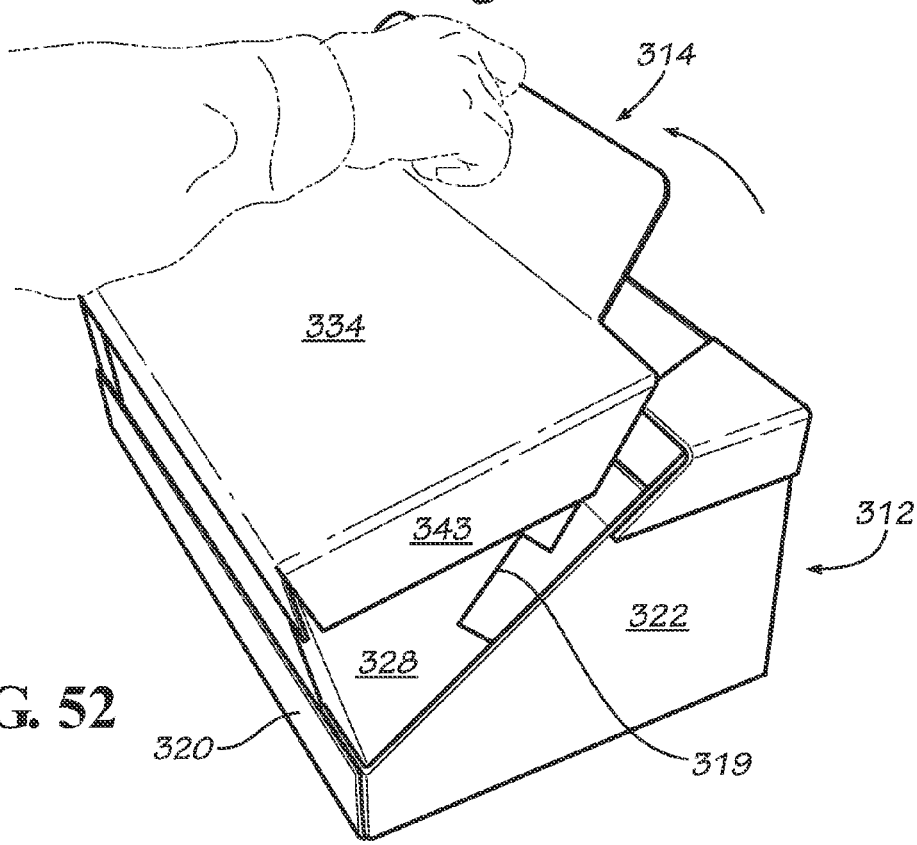
Figure 53:
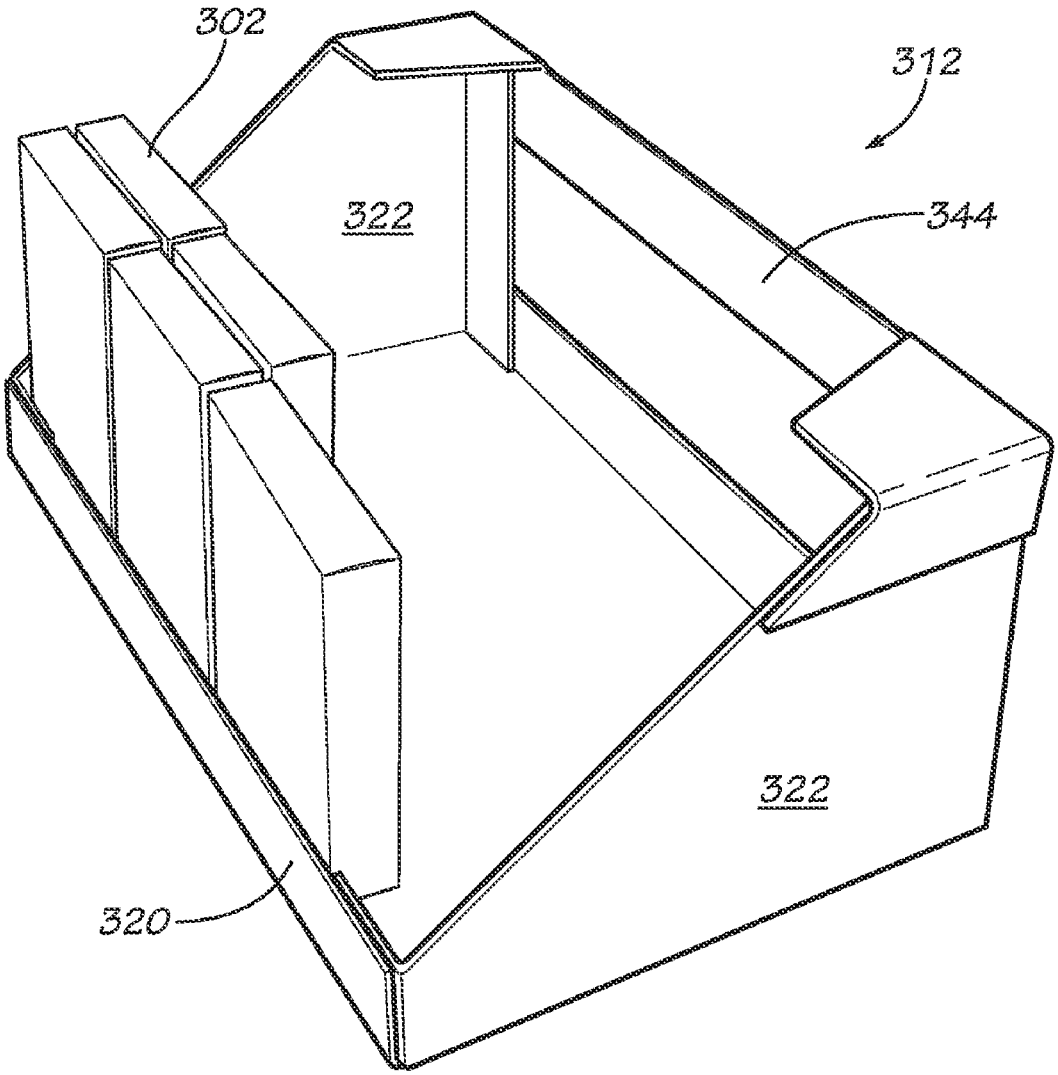
FIG. 53 is a perspective view of the shipper display system of FIGS. 48-50, shown in the display configuration.
Figure 54:
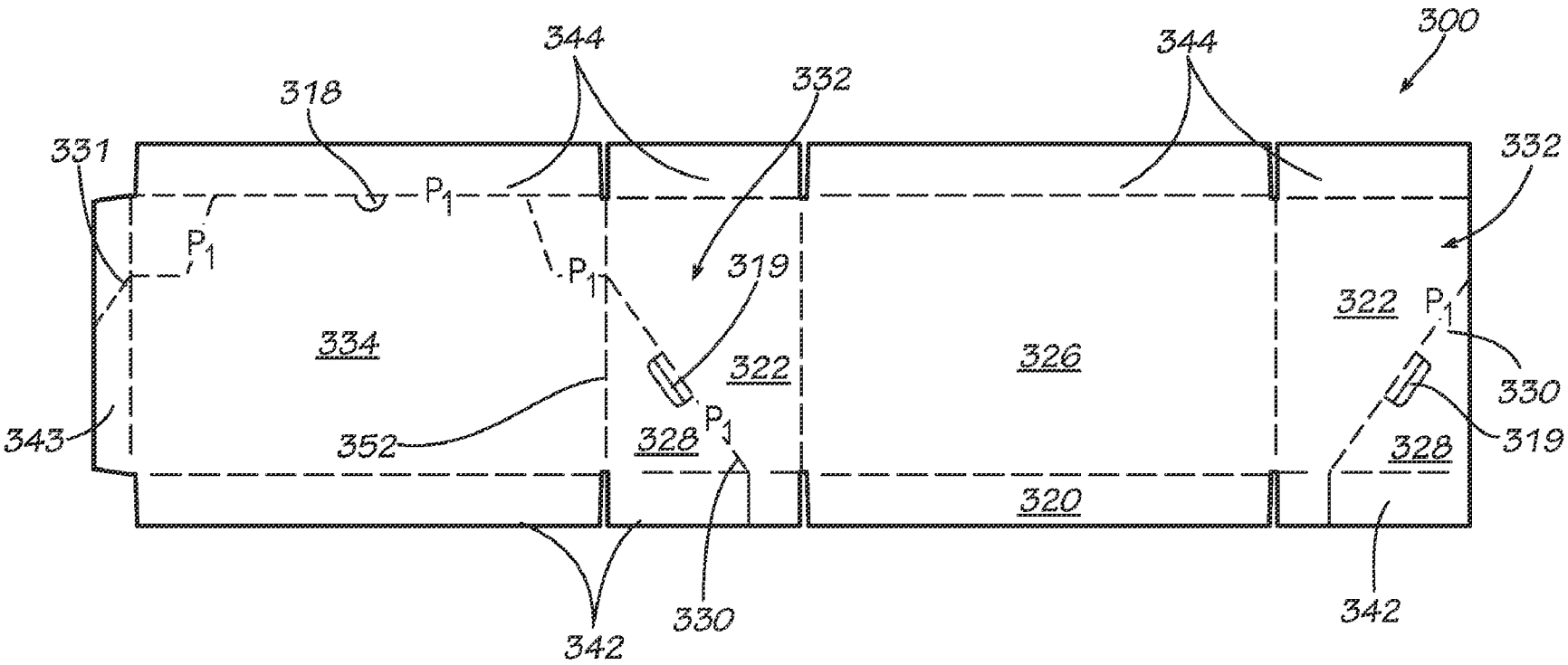
FIG. 54 is a top plan view of the blank from which the shipper display system of FIGS. 48-50 is formed.

FIGS. 48-55 illustrate yet another alternate embodiment of the invention. FIG. 54 shows the blank 300 used to form erected display 310 (shown in FIGS. 48-53). Erected shipper display 310 includes a tray portion 312 and a hood portion 314. In this embodiment, the hood portion 314 is configured so that it may be separated from the tray portion 312 when the shipper display is converted from a shipping configuration into a display configuration.

Shipper display 310 may be formed from a single blank 300, shown in FIG. 54. Blank 310 includes side panels 332, each side panel 332 including a zone of weakness 330 that separates side panel 332 into a lower side panel 322 and an upper side panel 328. Although zone of weakness 330 is shown as a straight line, zone of weakness 330 may instead be curved or have any other suitable configuration, as described above. The lower side panel 322 is part of the tray portion 312 of the formed shipper display 310, and the upper side panel 328 is part of the hood portion 314 of the formed shipper display 310. Blank 300 further includes a hood top panel 334, which is part of the hood portion 314 of formed shipper display 310, a tray bottom panel 326 and a tray front panel 320, which are part of the tray portion 312 of the formed shipper display 310. Blank 300 also includes front flaps 342 and back flaps 344.

Figure 48:
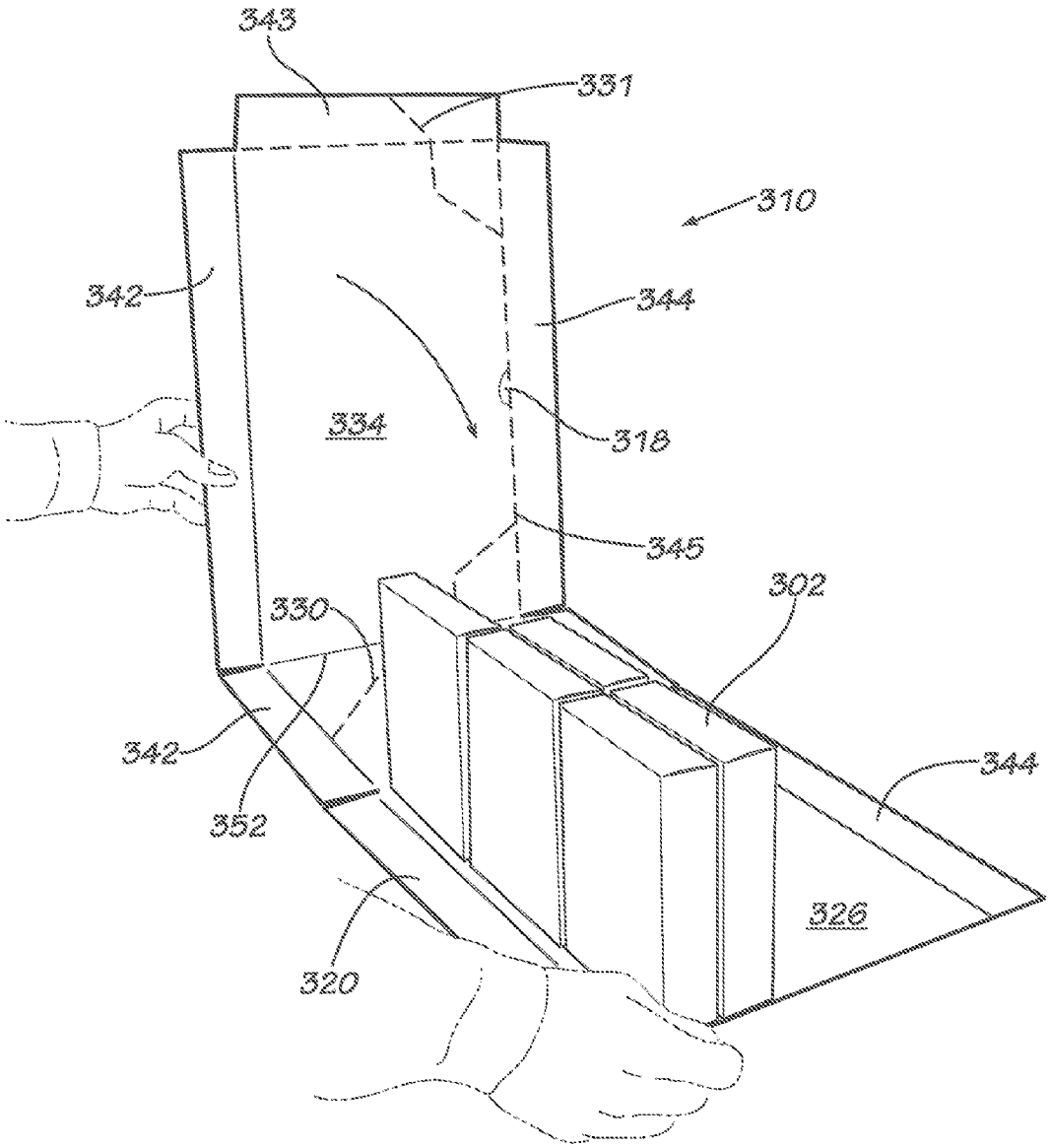
FIGS. 48-50 are perspective views of a shipper display system according to one embodiment of the invention, shown as it is assembled into its shipping configuration.
Figure 49:
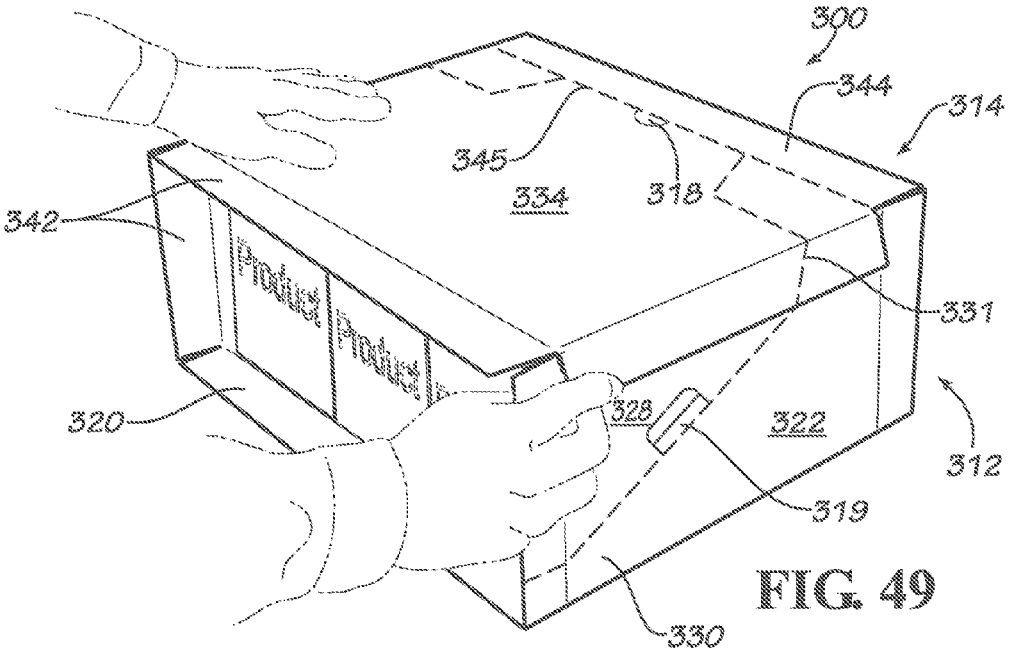

In some embodiments, blank 300 may be shipped flat to the customer, who can then use standard machinery to pack the blank 300 with product 302 as the blank is formed into shipper display 310. FIG. 48 illustrates blank 300 as it is being loaded with product 302 and folded into shipper display 310. As shown in FIG. 48, product may be placed on tray bottom panel 326 in some embodiments. Hood top panel 334 is then folded about fold line 352, as shown in FIGS. 48-49 so that hood top panel 334 covers the top of product 302. As shown in FIGS. 48-50 and 54, hood top panel 334 may be attached to one of the end side panels 332 by way of glue panel 343. Glue panel 343 is positioned with respect to hood top panel 334, although glue panel 343 could be positioned with respect to side panel 332 in other embodiments. Glue panel may be located anywhere along hood top panel 334 or side panel 332, or both. As shown in the Figures, depending on the location and dimensions of glue panel 343, glue panel 343 may include a zone of weakness 331 to facilitate conversion of the shipper display 310 into its display configuration. When forming shipper display 310, as described below, side panel 332 may be glued or otherwise attached via glue panel 343 to the hood front panel 336.

Figure 50:
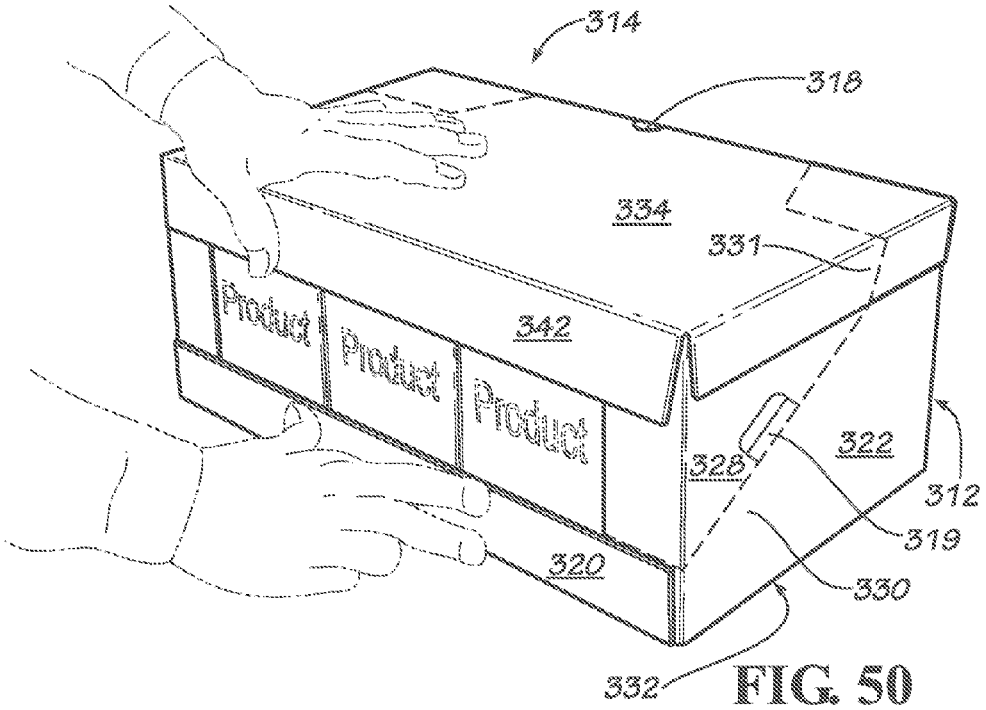

As shown in FIGS. 49-50, the front flaps 342 and the back flaps 344 may be folded to cover or partially cover the front and back of product 302. FIGS. 49 and 50 illustrate shipper display 310 in the shipping configuration after blank 300 has been folded and assembled. The hood portion 314 of the shipper display 310 protects the product 302 housed within the tray portion 312 during shipment. In certain embodiments, tray front panel 320 may include graphics or other advertising and promotional materials. Unlike the other embodiments described above, shipper display 310 does not include a reinforcement panel; rather the material and configuration of the shipper display 310 holds the shipper display together.

Figure 51:
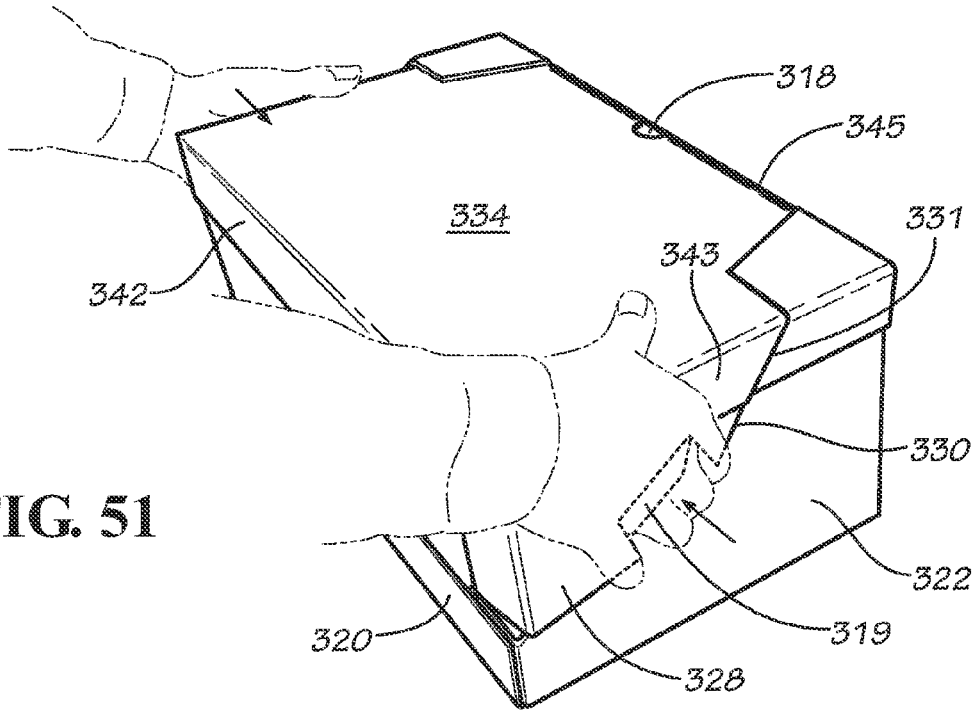
FIGS. 51-52 are various perspective views of the shipper display system of FIGS. 48-50 as it is being converted from the shipping configuration to the display configuration.

The shipper display 310 can be converted from its shipping configuration to its display configuration by means of the zones of weakness 330 in the side panels 332 of the shipper display 310, and optional zone of weakness 331 in glue panel 343. Once the zones of weakness 330 and 331 have been broken, side panel 332 separates into an upper side panel 328 and a lower side panel 322, as shown in FIGS. 51-52, and glue panel 343 separates. Cutouts 319 may optionally be used to facilitate the breaking of the zones of weakness 330. Once separated, as shown in FIG. 52, hood portion 314 may be separated from tray portion 314 by breaking the perforation line 345 on top panel 334, as shown in FIGS. 51-52. Use of tab 318 or other similar structure on hood top panel 334 can facilitate removal of hood portion 314 from tray portion 312. Tab 318 is not necessary to practice the invention, however, and if used, can be any size and configuration, and can be located anywhere on hood portion 314. Once the hood portion 314 is removed, product housed within the tray portion 312 is exposed and ready for merchandising by a consumer, as shown in FIG. 53. Thus, the shipper display 310 in its display configuration is shelf ready.

FIG. 55 illustrates another blank 301 that may be used to form a shipper display similar to shipper display 310 in another embodiment of the invention. FIG. 55 illustrates how glue panel 343 may be positioned with respect to side panel 332, and how front panel 320 may be of any desired configuration. FIG. 55 also illustrates how the dimensions of the various panels of the shipper display may be altered.

Blank 300 may be shipped before it is folded and glued. A customer/distributor can then pack product onto the bottom panel 326 of blank 300, and then the blank 300 may be folded and erected into shipper display 310. Blank 300 may be formed folded manually or using a standard case wrapper machine.

Because the shipper displays according to certain embodiments of this invention may be formed using a single blank, the shipper displays take less time to assemble than conventional two-piece shipper displays. Moreover, the shipper displays of this invention require less material than two-piece shipper displays and therefore are less expensive to manufacture. The shipper displays are also dimensioned to eliminate empty space on the retail shelf.

Changes and modifications, additions and deletions may be made to the structures and methods recited above and shown in the drawings without departing from the scope or spirit of the invention and the following claims.

The invention claimed is:

1. A shipper display system for containing and displaying product comprising:

(1) a tray front panel, a hood front panel, a rear panel, a bottom panel, and a top panel;

(2) side panels, each side panel comprising a zone of weakness that extends at least partially across the side panel, the zone of weakness enabling separation of the side panel into an upper side panel and a lower side panel;

(3) a reinforcement panel attached to the hood front panel, wherein the reinforcement panel is positioned adjacent to the tray front panel; and wherein the shipper display system is convertible from a shipping configuration to a display configuration upon separation of the zones of weakness; and wherein when the shipper display system is in the shipping configuration, the upper side panels and the lower side panels are joined along the zones of weakness, and wherein, when the shipper display system is in the display configuration, the shipper display system is separated into (1) a hood portion that comprises the hood front panel, the upper side panels, and at least a portion of the top panel and (2) a tray portion that comprises the lower side panels, the tray front panel, the bottom panel, and at least a portion of the rear panel;

wherein the shipper display system is made from a single blank; and wherein the tray front panel comprises graphics and wherein the reinforcement panel protects those graphics when the shipper display system is in the shipping configuration.

2. The shipper display system of claim 1, wherein the tray front panel comprises a top edge that is free of any perforations.

3. The shipper display system of claim 1, wherein the reinforcement panel substantially covers the tray front panel when the shipper display system is in the shipping configuration.

4. The shipper display system of claim 1, further comprising at least one cutout for facilitating the conversion of the shipper display system from the shipping configuration to the display configuration.

5. The shipper display system of claim 4, wherein the at least one cutout is positioned adjacent to at least one of the zones of weakness.

6. The shipper display system of claim 1, wherein the zone of weakness is configured to maintain a structural integrity of the shipper display system while still enabling separation of each of the side panels into the upper side panel and the lower side panel.

7. The shipper display system of claim 1, wherein the rear panel further comprises a line of perforation that enables a top portion of the rear panel to be separated from a bottom portion of the rear panel when the shipper display system is converted from the shipping configuration to the display configuration.

8. The shipper display system of claim 1, wherein the tray front panel comprises a fold line or a perforation line.

9. The shipper display system of claim 1, wherein the zone of weakness extends at least partially in a generally diagonal direction across the side panel.

10. The shipper display system of claim 1, wherein the zone of weakness extends at least partially in a generally horizontal direction across the side panel.

11. The shipper display system of claim 1, wherein the zone of weakness extends in a first direction that is generally diagonal across the side panel and in a second direction that is generally horizontal across the side panel.

12. The shipper display system of claim 1, wherein at least one of the upper side panels further comprises a perforation line.

13. A shipper display system for containing and displaying product comprising:

(1) a tray front panel, a hood front panel, a rear panel, a bottom panel, and a top panel;

(2) side panels, each side panel comprising a zone of weakness that extends at least partially across the side panel, the zone of weakness enabling separation of the side panel into an upper side panel and a lower side panel;

(3) a reinforcement panel attached to the hood front panel, wherein the reinforcement panel is positioned adjacent to the tray front panel; and wherein the shipper display system is convertible from a shipping configuration to a display configuration upon separation of the zones of weakness; and wherein when the shipper display system is in the shipping configuration, the upper side panels and the lower side panels are joined along the zones of weakness, and wherein, when the shipper display system is in the display configuration, the shipper display system is separated into (1) a hood portion that comprises the hood front panel, the upper side panels, and at least a portion of the top panel and (2) a tray portion that comprises the lower side panels, the tray front panel, the bottom panel, and at least a portion of the rear panel;

wherein the shipper display system is made from a single blank; and wherein the reinforcement panel is adjacent to one of the side panels and further comprising a perforation line positioned between the reinforcement panel and the lower side panel of one of the side panels, the perforation line separating the reinforcement panel from the lower side panel of the one of the side panels when the shipper display system is converted from the shipping configuration to the display configuration.

14. A blank for forming a shipper display system comprising:

(1) a tray front panel, a hood front panel, and a rear panel;

(2) side panels, each side panel comprising a zone of weakness that extends at least partially across the side panel, the zone of weakness enabling separation of the side panels into an upper side panel and a lower side panel;

(3) a reinforcement panel located adjacent to one of the side panels;

(4) a plurality of bottom flaps and a plurality of top flaps; and (5) a perforation line positioned between the reinforcement panel and the lower side panel of one of the side panels, the perforation line enabling separation between the lower side panel of one of the side panels and the reinforcement panel;

and wherein the tray front panel comprises graphics.

15. The blank of claim 14, wherein the tray front panel has a top edge that is free of any perforations.

16. The blank of claim 14, wherein one of the top flaps is positioned adjacent to the hood front panel.

17. The blank of claim 14, wherein one of the top flaps is positioned adjacent to the reinforcement panel.

18. The blank of claim 14, wherein the rear panel further comprises a line of peroration that enables a top portion of the rear panel to be separated from a bottom portion of the rear panel.

19. The blank of claim 14, wherein the tray front panel comprises a fold or perforation line.

20. The blank of claim 14, wherein the zone of weakness extends at least partially in a generally diagonal direction across the side panel.

21. The blank of claim 14, wherein the zone of weakness extends at least partially in a generally horizontal direction across the side panel.

22. The blank of claim 14, wherein the zone of weakness extends in a first direction that is generally diagonal across the side panel and in a second direction that is generally horizontal across the side panel.

23. The blank of claim 14, wherein at least one of the upper side panels further comprises a perforation line.

24. A method of assembling a shipper display comprising:

providing a blank comprising a tray front panel including graphics, a hood front panel, a rear panel, a bottom panel, a top panel; side panels, each side panel comprising a zone of weakness that extends at least partially across the side panel, the zone of weakness enabling separation of the side panels into an upper side panel and a lower side panel; a reinforcement panel located adjacent to one of the side panels; and a plurality of bottom flaps and a plurality of top flaps;

erecting the blank into a formed shipper display so that the reinforcement panel is positioned adjacent to the tray front panel to at least partially cover the tray front panel to protect the graphics of the formed shipper display.

25. The method of claim 24, further comprising filling the formed shipper display with product.

26. The method of claim 24, further comprising folding the tray front panel along a fold or perforation line.

27. A method of converting shipper display system from a shipping configuration to a display configuration comprising:

providing a shipper display formed from a single blank comprising a tray front panel, a hood front panel, a rear panel, a bottom panel, a top panel; side panels, each side panel comprising a zone of weakness that extends at least partially across the side panel, and each side panel comprising an upper side panel and a lower side panel joined along the zone of weakness; a reinforcement panel attached to the hood front panel, wherein the reinforcement panel is positioned adjacent to the display front panel and is adjacent to one of the side panels, and further comprises a perforation line positioned between the reinforcement panel and one of the side panels;

breaking the zones of weakness to convert the shipper display system from the shipping configuration to the display configuration so that the shipper display system is separated into (1) a hood portion that comprises the front panel, the upper side panel, and the hood top panel and (2) a tray portion that comprises the lower side panel, the tray front panel, the bottom panel, and the rear panel; wherein the perforation line positioned between the reinforcement panel and one of the side panels separates the reinforcement panel from the one of the side panels when the shipper display system is converted from the shipping configuration to the display configuration.

28. The method of claim 27, further comprising breaking a perforation line that joins the reinforcement panel and the lower side panel of one of the side panels.

29. The method of claim 27, further comprising breaking a perforation line located on the rear panel so the rear panel separates into a top portion and a bottom portion.

30. The method of claim 27, further comprising breaking a perforation line located on at least one of the upper side panels.

31. The method of claim 27, wherein the breaking of the zones of weakness comprises manipulating a cutout adjacent to at least one of the zones of weakness.

32. A shipper display system for containing and displaying product comprising:

(1) a tray front panel, a hood front panel, a rear panel, a bottom panel, and a top panel;

(2) side panels, each side panel comprising a zone of weakness that extends at least partially across the side panel, the zone of weakness enabling separation of the side panel into an upper side panel and a lower side panel;

(3) a reinforcement panel attached to the hood front panel, wherein the reinforcement panel is positioned adjacent to the tray front panel; and wherein the shipper display system is convertible from a shipping configuration to a display configuration upon separation of the zones of weakness; and wherein when the shipper display system is in the shipping configuration, the upper side panels and the lower side panels are joined along the zones of weakness, and wherein, when the shipper display system is in the display configuration, the shipper display system is separated into (1) a hood portion that comprises the hood front panel, the upper side panels, and at least a portion of the top panel and (2) a tray portion that comprises the lower side panels, the tray front panel, the bottom panel, and at least a portion of the rear panel;

wherein the shipper display system is made from a single blank; and wherein the reinforcement panel is adjacent to one of the side panels and further comprises a line of weakness positioned between the reinforcement panel and the one of the side panels, the line of weakness separating the reinforcement panel from the one of the side panels when the shipper display system is converted from the shipping configuration to the display configuration.

33. The shipper display system of claim 32, wherein the tray front panel comprises graphics and wherein the reinforcement panel protects those graphics when the shipper display system is in the shipping configuration.

* * * * *